US006309051B1

(12) United States Patent
Koitabashi et al.

(10) Patent No.: US 6,309,051 B1
(45) Date of Patent: Oct. 30, 2001

(54) INK-JET APPARATUS EMPLOYING INK-JET HEAD HAVING A PLURALITY OF INK EJECTION HEATERS CORRESPONDING TO EACH INK EJECTION OPENING

(75) Inventors: Noribumi Koitabashi, Yokohama; Jiro Moriyama, Kawasaki; Shigeyasu Nagoshi; Hiroshi Tajika, both of Yokohama; Fumihiro Gotoh, Kawasaki; Masao Kato, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/349,460

(22) Filed: Jul. 9, 1999

Related U.S. Application Data

(62) Division of application No. 08/579,241.

(30) Foreign Application Priority Data

| | | |
|---|---|---|
| Dec. 29, 1994 | (JP) | 6-340264 |
| Dec. 29, 1994 | (JP) | 6-340266 |
| Dec. 29, 1994 | (JP) | 6-340267 |
| Dec. 29, 1994 | (JP) | 6-340268 |

(51) Int. Cl.[7] ..... B41J 2/05; B41J 2/14
(52) U.S. Cl. ..... 347/57; 347/48
(58) Field of Search ..... 347/57, 48, 14, 347/15

(56) References Cited

U.S. PATENT DOCUMENTS

| | | | |
|---|---|---|---|
| 4,251,824 | 2/1981 | Hara et al. . | |
| 4,313,124 | 1/1982 | Hara . | |
| 4,345,262 | 8/1982 | Shirato et al. . | |
| 4,353,079 * | 10/1982 | Kawanabe | 347/15 |
| 4,459,600 | 7/1984 | Sato et al. . | |
| 4,463,359 | 7/1984 | Ayata et al. . | |
| 4,499,479 | 2/1985 | Chee-Shuen Lee et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,983,994 | 1/1991 | Mori et al. | 347/16 |
| 5,731,828 * | 3/1998 | Ishinaga et al. | 347/48 |

FOREIGN PATENT DOCUMENTS

| | | |
|---|---|---|
| 0 372 097 | 6/1990 | (EP) . |
| 0 378 387 | 7/1990 | (EP) . |
| 0 496 525 | 7/1992 | (EP) . |
| 54-56847 | 5/1979 | (JP) . |
| 55-73568 | 6/1980 | (JP) . |
| 55-132259 | 10/1980 | (JP) . |
| 57-95470 | 6/1982 | (JP) . |
| 59-123670 | 7/1984 | (JP) . |
| 59-138461 | 8/1984 | (JP) . |
| 60-71260 | 4/1985 | (JP) . |
| 61-146556 | 7/1986 | (JP) . |
| 62-290568 | 12/1987 | (JP) . |

(List continued on next page.)

*Primary Examiner*—Huan Tran
*Assistant Examiner*—An H. Do
(74) *Attorney, Agent, or Firm*—Fitzpatrick, Cella, Harper & Scinto

(57) ABSTRACT

In an ink-jet apparatus employing an ink-jet head having a plurality of heaters corresponding to one ink ejection opening, appropriate preliminary ejection is performed per each ejection amount mode set by a heater to be used among a plurality of heaters. Depending upon a set printing mode, printing is performed in one of large, medium and small ejection amount modes. For example, after printing is performed for a predetermined amount by the small ejection amount mode, preliminary ejection during printing is performed in the medium ejection amount mode which is greater in ejection amount than the small ejection amount mode. By this, the interval between preliminary ejections during printing can be set to be longer to prevent lowering of throughput due to the preliminary ejection operations.

36 Claims, 81 Drawing Sheets

FOREIGN PATENT DOCUMENTS

| | | |
|---|---|---|
| 63-286356 | 11/1988 | (JP) . |
| 64-14045 | 1/1989 | (JP) . |
| 2-3324 | 1/1990 | (JP) . |
| 2-243354 | 9/1990 | (JP) . |
| 2-301446 | 12/1990 | (JP) . |
| 3-234535 | 10/1991 | (JP) . |
| 3-234666 | 10/1991 | (JP) . |
| 3-256749 | 11/1991 | (JP) . |
| 3-284951 | 12/1991 | (JP) . |
| 5-31905 | 2/1993 | (JP) . |
| 6-191142 | 7/1994 | (JP) . |
| 6-226963 | 8/1994 | (JP) . |
| 6-238902 | 8/1994 | (JP) . |
| 7-232441 | 9/1995 | (JP) . |
| WO 87/03363 | 6/1987 | (WO) . |

* cited by examiner

| FIG.5A |
| --- |
| FIG.5B |

| FIG. 7A |
| --- |
| FIG. 7B |

| TABLE NO. | ① | ② | ③ | ④ | ⑤ | ⑥ | ⑦ | ⑧ | ⑨ | ⑩ | ⑪ |
|---|---|---|---|---|---|---|---|---|---|---|---|
| HEAD TEMPERATURE Th (℃) | LESS THAN 26 | 26 OR MORE ~ LESS THAN 29 | 29 OR MORE ~ LESS THAN 32 | 32 OR MORE ~ LESS THAN 35 | 35 OR MORE ~ LESS THAN 38 | 38 OR MORE ~ LESS THAN 41 | 41 OR MORE ~ LESS THAN 44 | 44 OR MORE ~ LESS THAN 47 | 47 OR MORE ~ LESS THAN 50 | 50 OR MORE ~ LESS THAN 53 | 53 OR MORE |
| OFFSET PERIOD τ(μsec) | 0 | 0.8 | 1.2 | 1.5 | 1.8 | 2.1 | 2.4 | 2.7 | 3.0 | 3.4 | 4.0 |

*FIG. 12*

| TABLE NO. | ① | ② | ③ | ④ | ⑤ | ⑥ | ⑦ | ⑧ | ⑨ | ⑩ | ⑪ |
|---|---|---|---|---|---|---|---|---|---|---|---|
| HEAD TEMPERATURE Th (℃) | LESS THAN 26 | 26 OR MORE ~ LESS THAN 29 | 29 OR MORE ~ LESS THAN 32 | 32 OR MORE ~ LESS THAN 35 | 35 OR MORE ~ LESS THAN 38 | 38 OR MORE ~ LESS THAN 41 | 41 OR MORE ~ LESS THAN 44 | 44 OR MORE ~ LESS THAN 47 | 47 OR MORE ~ LESS THAN 50 | 50 OR MORE ~ LESS THAN 53 | 53 OR MORE |
| OFFSET PERIOD τ(μsec) | 0 | -0.8 | -1.2 | -1.5 | -1.8 | -2.1 | -2.4 | -2.7 | -3.0 | -3.4 | -4.0 |

*FIG. 15*

| TABLE NO. | ① | ② | ③ | ④ | ⑤ | ⑥ | ⑦ | ⑧ |
|---|---|---|---|---|---|---|---|---|
| HEAD TEMPERATURE Th (℃) | LESS THAN 26 | 26 OR MORE ~ LESS THAN 29 | 29 OR MORE ~ LESS THAN 32 | 32 OR MORE ~ LESS THAN 35 | 35 OR MORE ~ LESS THAN 38 | 38 OR MORE ~ LESS THAN 41 | 41 OR MORE ~ LESS THAN 44 | 44 OR MORE |
| OFFSET PERIOD τ(μsec) | 1.2 | 1.5 | 1.8 | 2.1 | 2.4 | 2.7 | 3.0 | 3.3 |

FIG. 16

LARGE EJECTION AMOUNT MODE (40pl/dot)

| TABLE NO. | ① | ② | ③ | ④ | ⑤ | ⑥ | ⑦ | ⑧ | ⑨ | ⑩ |
|---|---|---|---|---|---|---|---|---|---|---|
| HEAD TEMPERATURE Th (℃) | LESS THAN 26 | 26 OR MORE ~ LESS THAN 29 | 29 OR MORE ~ LESS THAN 32 | 32 OR MORE ~ LESS THAN 35 | 35 OR MORE ~ LESS THAN 38 | 38 OR MORE ~ LESS THAN 41 | 41 OR MORE ~ LESS THAN 44 | 44 OR MORE ~ LESS THAN 47 | 47 OR MORE ~ LESS THAN 50 | 50 OR MORE |
| OFFSET PERIOD τ(μsec) | 0 | 0.4 | 0.6 | 0.8 | 1.0 | 1.2 | 1.4 | 1.6 | 1.8 | 2.0 |

MEDIUM EJECTION AMOUNT MODE (25pl/dot)

| TABLE NO. | ① | ② | ③ | ④ | ⑤ | ⑥ | ⑦ | ⑧ | ⑨ | ⑩ |
|---|---|---|---|---|---|---|---|---|---|---|
| HEAD TEMPERATURE Th (℃) | LESS THAN 26 | 26 OR MORE ~ LESS THAN 29 | 29 OR MORE ~ LESS THAN 32 | 32 OR MORE ~ LESS THAN 35 | 35 OR MORE ~ LESS THAN 38 | 38 OR MORE ~ LESS THAN 41 | 41 OR MORE ~ LESS THAN 44 | 44 OR MORE ~ LESS THAN 47 | 47 OR MORE ~ LESS THAN 50 | 50 OR MORE |
| OFFSET PERIOD τ(μsec) | 3.5 | 3.8 | 4.1 | 4.4 | 4.7 | 5.0 | 5.3 | 5.7 | 6.1 | 6.5 |

LARGE EJECTION AMOUNT MODE (40pl/dot)

| TABLE NO. | ① | ② | ③ | ④ | ⑤ | ⑥ | ⑦ | ⑧ | ⑨ | ⑩ |
|---|---|---|---|---|---|---|---|---|---|---|
| HEAD TEMPERATURE Th (℃) | LESS THAN 26 | 26 OR MORE ~ LESS THAN 29 | 29 OR MORE ~ LESS THAN 32 | 32 OR MORE ~ LESS THAN 35 | 35 OR MORE ~ LESS THAN 38 | 38 OR MORE ~ LESS THAN 41 | 41 OR MORE ~ LESS THAN 44 | 44 OR MORE ~ LESS THAN 47 | 47 OR MORE ~ LESS THAN 50 | 50 OR MORE |
| OFFSET PERIOD τ(μsec) | 0 | 0.6 | 0.9 | 1.2 | 1.5 | 1.8 | 2.1 | 2.4 | 2.7 | 3.0 |

MEDIUM EJECTION AMOUNT MODE (25pl/dot)

| TABLE NO. | ① | ② | ③ | ④ | ⑤ | ⑥ | ⑦ | ⑧ | ⑨ | ⑩ |
|---|---|---|---|---|---|---|---|---|---|---|
| HEAD TEMPERATURE Th (℃) | LESS THAN 26 | 26 OR MORE ~ LESS THAN 29 | 29 OR MORE ~ LESS THAN 32 | 32 OR MORE ~ LESS THAN 35 | 35 OR MORE ~ LESS THAN 38 | 38 OR MORE ~ LESS THAN 41 | 41 OR MORE ~ LESS THAN 44 | 44 OR MORE ~ LESS THAN 47 | 47 OR MORE ~ LESS THAN 50 | 50 OR MORE |
| OFFSET PERIOD τ(μsec) | 3.5 | 3.8 | 4.1 | 4.4 | 4.7 | 5.0 | 5.3 | 5.7 | 6.1 | 6.5 |

SH1: SMALL HEATER
SH2: LARGE HEATER 213 214

| EJECTION AMOUNT MODE | MAIN HEAT PULSE DRIVEN HEATER | PRE-HEAD PULSE DRIVEN HEATER |
|---|---|---|
| SMALL | SH1 | SH1 |
| | | SH2 |
| | | SH1+SH2 |
| MEDIUM | SH2 | SH1 |
| | | SH2 |
| | | SH1+SH2 |
| LARGE | SH1+SH2 | SH1 |
| | | SH2 |
| | | SH1+SH2 |

FIG.29

$P_1$ TABLE FOR SMALL EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER PRE-PULSE (μsec) | 1.0 | 0.95 | 0.90 | 0.85 | 0.80 | 0.75 | 0.70 | 0.65 | 0.60 | 0.55 | 0.50 | 0.45 | 0.40 | 0.35 | 0.30 | 0.25 | 0.20 | 0.15 | 0.10 |
| LARGE HEATER PRE-PULSE (μsec) | 0 | 0 | 0 | 0 | 0 | 0 | 0 | 0 | 0 | 0 | 0 | 0 | 0 | 0 | 0 | 0 | 0 | 0 | 0 |

(15pl)

FIG.30A $P_1$ TABLE FOR MEDIUM EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER PRE-PULSE (μsec) | 0 | 0 | 0 | 0 | 0 | 0 | 0 | 0 | 0 | 0 | 0 | 0 | 0 | 0 | 0 | 0 | 0 | 0 | 0 |
| LARGE HEATER PRE-PULSE (μsec) | 1.0 | 0.9 | 0.8 | 0.7 | 0.6 | 0.5 | 0.4 | 0.3 | 0.2 | 0.1 | 0 | 0 | 0 | 0 | 0 | 0 | 0 | 0 | 0 |

(25pl)

FIG.30B $P_1$ TABLE FOR LARGE EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER PRE-PULSE (μsec) | 1.0 | 0.95 | 0.90 | 0.85 | 0.80 | 0.75 | 0.70 | 0.65 | 0.60 | 0.55 | 0.50 | 0.45 | 0.40 | 0.35 | 0.30 | 0.25 | 0.20 | 0.15 | 0.10 |
| LARGE HEATER PRE-PULSE (μsec) | 1.0 | 0.95 | 0.90 | 0.85 | 0.80 | 0.75 | 0.70 | 0.65 | 0.60 | 0.55 | 0.50 | 0.45 | 0.40 | 0.35 | 0.30 | 0.25 | 0.20 | 0.15 | 0.10 |

(40pl)

FIG.30C (FOR SMALL EJECTION AMOUNT MODE)

(FOR MEDIUM EJECTION AMOUNT MODE)

(FOR LARGE EJECTION AMOUNT MODE)

$P_1$ TABLE FOR SMALL EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER PRE-PULSE (μsec) | 1.0 | 0.95 | 0.90 | 0.85 | 0.80 | 0.75 | 0.70 | 0.65 | 0.60 | 0.55 | 0.50 | 0.45 | 0.40 | 0.35 | 0.30 | 0.25 | 0.20 | 0.15 | 0.10 |
| LARGE HEATER PRE-PULSE (μsec) | 0 | 0 | 0 | 0 | 0 | 0 | 0 | 0 | 0 | 0 | 0 | 0 | 0 | 0 | 0 | 0 | 0 | 0 | 0 |

(15pl)

FIG.32A $P_1$ TABLE FOR MEDIUM EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER PRE-PULSE (μsec) | 1.0 | 1.0 | 1.0 | 1.0 | 1.0 | 1.0 | 1.0 | 1.0 | 1.0 | 1.0 | 1.0 | 0.8 | 0.6 | 0.4 | 0.2 | 0 | 0 | 0 | 0 |
| LARGE HEATER PRE-PULSE (μsec) | 1.0 | 0.9 | 0.8 | 0.7 | 0.6 | 0.5 | 0.4 | 0.3 | 0.2 | 0.1 | 0 | 0 | 0 | 0 | 0 | 0 | 0 | 0 | 0 |

(25pl)

*FIG.32B*

$P_1$ TABLE FOR LARGE EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER PRE-PULSE (μsec) | 1.0 | 1.0 | 1.0 | 1.0 | 1.0 | 1.0 | 1.0 | 1.0 | 1.0 | 1.0 | 1.0 | 0.9 | 0.8 | 0.7 | 0.6 | 0.5 | 0.4 | 0.3 | 0.2 |
| LARGE HEATER PRE-PULSE (μsec) | 1.0 | 0.9 | 0.8 | 0.7 | 0.6 | 0.5 | 0.4 | 0.3 | 0.2 | 0.1 | 0 | 0 | 0 | 0 | 0 | 0 | 0 | 0 | 0 |

(40pl)

FIG.32C (FOR SMALL EJECTION AMOUNT MODE)

(FOR MEDIUM EJECTION AMOUNT MODE)

(FOR LARGE EJECTION AMOUNT MODE)

$P_1$ TABLE FOR SMALL EJECTION AMOUNT MODE
(FOR LOW TEMPERATURE)

| HEAD T TEMPERATURE (℃) | ~16 | ~18 | ~20 | ~22 | ~24 | ~26 | ~28 | ~30 | ~32 | ~34 | ~36 | ~38 | ~40 | ~42 | ~44 | ~46 | ~48 | ~50 | 50~ |
|---|---|---|---|---|---|---|---|---|---|---|---|---|---|---|---|---|---|---|---|
| SMALL HEATER PRE-PULSE (μsec) | 0 | 0 | 0 | 0 | 0 | 0 | 0 | 0 | 0 | 0 | 0 | 0 | 0 | 0 | 0 | 0 | 0 | 0 | 0 |
| LARGE HEATER PRE-PULSE (μsec) | 2.0 | 1.93 | 1.86 | 1.8 | 1.73 | 1.66 | 1.6 | 1.53 | 1.46 | 1.4 | 1.33 | 1.26 | 1.2 | 1.13 | 1.06 | 1.0 | 0.93 | 0.87 | 0.80 |

(15pl)

FIG.34A $P_1$ TABLE FOR MEDIUM EJECTION AMOUNT MODE
(FOR LOW TEMPERATURE)

| HEAD T TEMPERATURE (℃) | ~16 | ~18 | ~20 | ~22 | ~24 | ~26 | ~28 | ~30 | ~32 | ~34 | ~36 | ~38 | ~40 | ~42 | ~44 | ~46 | ~48 | ~50 | 50~ |
|---|---|---|---|---|---|---|---|---|---|---|---|---|---|---|---|---|---|---|---|
| SMALL HEATER PRE-PULSE (μsec) | 3.0 | 2.8 | 2.6 | 2.4 | 2.2 | 2.0 | 1.8 | 1.6 | 1.4 | 1.2 | 1.0 | 0.8 | 0.6 | 0.4 | 0.2 | 0 | 0 | 0 | 0 |
| LARGE HEATER PRE-PULSE (μsec) | 0 | 0 | 0 | 0 | 0 | 0 | 0 | 0 | 0 | 0 | 0 | 0 | 0 | 0 | 0 | 0 | 0 | 0 | 0 |

(25pl)

FIG.34B $P_1$ TABLE FOR LARGE EJECTION AMOUNT MODE
(FOR LOW TEMPERATURE)

| HEAD T TEMPERATURE (℃) | ~16 | ~18 | ~20 | ~22 | ~24 | ~26 | ~28 | ~30 | ~32 | ~34 | ~36 | ~38 | ~40 | ~42 | ~44 | ~46 | ~48 | ~50 | 50~ |
|---|---|---|---|---|---|---|---|---|---|---|---|---|---|---|---|---|---|---|---|
| SMALL HEATER PRE-PULSE (μsec) | 0 | 0 | 0 | 0 | 0 | 0 | 0 | 0 | 0 | 0 | 0 | 0 | 0 | 0 | 0 | 0 | 0 | 0 | 0 |
| LARGE HEATER PRE-PULSE (μsec) | 2.0 | 1.9 | 1.8 | 1.7 | 1.6 | 1.5 | 1.4 | 1.3 | 1.2 | 1.1 | 1.0 | 0.9 | 0.8 | 0.7 | 0.6 | 0.5 | 0.4 | 0.3 | 0.2 |

(40pl)

FIG.35A $P_1$ TABLE FOR LARGE EJECTION AMOUNT MODE
(FOR HIGH TEMPERATURE)

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER PRE-PULSE (μsec) | 1.8 | 1.7 | 1.6 | 1.5 | 1.4 | 1.3 | 1.2 | 1.1 | 1.0 | 0.9 | 0.8 | 0.7 | 0.6 | 0.5 | 0.4 | 0.3 | 0.2 | 0.1 | 0 |
| LARGE HEATER PRE-PULSE (μsec) | 0 | 0 | 0 | 0 | 0 | 0 | 0 | 0 | 0 | 0 | 0 | 0 | 0 | 0 | 0 | 0 | 0 | 0 | 0 |

(40pl)

FIG.35B (FOR SMALL EJECTION AMOUNT MODE)

(FOR MEDIUM EJECTION AMOUNT MODE)

(FOR LARGE EJECTION AMOUNT MODE)

OFF TIME $P_2$ TABLE FOR SMALL EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER OFF TIME (μsec) | 4.0 | 3.9 | 3.8 | 3.7 | 3.6 | 3.5 | 3.4 | 3.3 | 3.2 | 3.1 | 3.0 | 2.9 | 2.8 | 2.7 | 2.6 | 2.5 | 2.4 | 2.3 | 2.2 |
| LARGE HEATER OFF TIME (μsec) | - | - | - | - | - | - | - | - | - | - | - | - | - | - | - | - | - | - | - |

(15pl)

*FIG.37A*

OFF TIME $P_2$ TABLE FOR MEDIUM EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER OFF TIME (μsec) | - | - | - | - | - | - | - | - | - | - | - | - | - | - | - | - | - | - | - |
| LARGE HEATER OFF TIME (μsec) | 4.0 | 3.8 | 3.6 | 3.4 | 3.2 | 3.0 | 2.8 | 2.6 | 2.4 | 2.2 | 2.0 | 1.8 | 1.6 | 1.4 | 1.2 | 1.0 | 0.8 | 0.6 | 0.4 |

(25pl)

FIG.37B

OFF TIME $P_2$ TABLE FOR LARGE EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER OFF TIME (μsec) | 4.0 | 3.9 | 3.8 | 3.7 | 3.6 | 3.5 | 3.4 | 3.3 | 3.2 | 3.1 | 3.0 | 2.9 | 2.8 | 2.7 | 2.6 | 2.5 | 2.4 | 2.3 | 2.2 |
| LARGE HEATER OFF TIME (μsec) | 4.0 | 3.9 | 3.8 | 3.7 | 3.6 | 3.5 | 3.4 | 3.3 | 3.2 | 3.1 | 3.0 | 2.9 | 2.8 | 2.7 | 2.6 | 2.5 | 2.4 | 2.3 | 2.2 |

(40pl)

*FIG.37C*

(FOR SMALL EJECTION AMOUNT MODE)

(FOR MEDIUM EJECTION AMOUNT MODE)

(FOR LARGE EJECTION AMOUNT MODE)

OFF TIME $P_2$ TABLE FOR SMALL EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER OFF TIME (μsec) | - | - | - | - | - | - | - | - | - | - | - | - | - | - | - | - | - | - | - |
| LARGE HEATER OFF TIME (μsec) | 4.0 | 3.8 | 3.6 | 3.4 | 3.2 | 3.0 | 2.8 | 2.6 | 2.4 | 2.2 | 2.0 | 1.8 | 1.6 | 1.4 | 1.2 | 1.0 | 0.8 | 0.6 | 0.4 |

(15pl)

FIG.39A

OFF TIME $P_2$ TABLE FOR MEDIUM EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER OFF TIME (μsec) | 4.0 | 3.6 | 3.2 | 2.8 | 2.4 | 2.0 | 1.6 | 1.2 | 0.8 | 0.4 | 0 | | | | | | | | |
| LARGE HEATER OFF TIME (μsec) | - | - | - | - | - | - | - | - | - | - | - | | | | | | | | |

(25pl)

FIG.39B

OFF TIME $P_2$ TABLE FOR LARGE EJECTION AMOUNT MODE

| HEAD T TEMPERATURE (℃) | ~26 | ~28 | ~30 | ~32 | ~34 | ~36 | ~38 | ~40 | ~42 | ~44 | ~46 | ~48 | ~50 | ~52 | ~54 | ~56 | ~58 | ~60 | 60~ |
|---|---|---|---|---|---|---|---|---|---|---|---|---|---|---|---|---|---|---|---|
| SMALL HEATER OFF TIME (μsec) | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 | 4.0 |
| LARGE HEATER OFF TIME (μsec) | 4.0 | 3.7 | 3.5 | 3.4 | 3.3 | 3.25 | 3.2 | 3.15 | 3.1 | 3.05 | 3.0 | 2.95 | 2.9 | 2.85 | 2.8 | 2.75 | 2.7 | 2.65 | 2.6 |

(40pl)

FIG.39C (FOR SMALL EJECTION AMOUNT MODE)

(FOR MEDIUM EJECTION AMOUNT MODE)

(FOR LARGE EJECTION AMOUNT MODE)

INK-JET APPARATUS EMPLOYING INK-JET HEAD HAVING A PLURALITY OF INK EJECTION HEATERS CORRESPONDING TO EACH INK EJECTION OPENING

This application is a divisional application of U.S. patent application Ser. No. 08/579,241.

BACKGROUND OF THE INVENTION

1. Field of the Invention

The present invention relates to an ink-jet apparatus. More specifically, the invention relates to an ink-jet apparatus employing an ink-jet head having a plurality of ink ejection heaters in an ink path corresponding to each ejection opening.

2. Description of the Related Art

An ink-jet apparatus has been mainly known as a printing apparatus in printers, copy machines and so forth. Among various ink-jet apparatuses, an ink-jet printing apparatus of the type utilizing thermal energy as an energy for ejecting an ink and ejecting ink by bubble utilizing the thermal energy has been spread, recently. In addition, as other applications of this type of ink-jet printing apparatus, an ink-jet textile printing apparatus for performing printing of a given pattern, picture or synthesized image and so forth on a cloth is becoming known, in the recent years.

An ink-jet head to be employed in the ink-jet printing apparatus such as those set forth above, has an electro-thermal transducing element (hereinafter also referred to as "heater") as a source of the thermal energy. In most cases, the ink-jet head is provided with one heater corresponding to one ejection opening. On the other hand, there has been known the ink-jet head employing a plurality of heaters for each ink ejection opening, in a viewpoint discussed below.

Firstly, it has been known to drive a plurality of heaters alternately or selectively for the purpose of expanding life of the ink-jet head. Secondly, a plurality of heaters are employed for widening range of variation of ink ejection amount. In the second case, by selecting the heater to be driven and/or by selecting number of heaters to be driven, the ink ejection amount is varied.

In the later case, as more concrete structure, a plurality of heaters are arranged in alignment along an ink ejecting direction in an ink path communicated with the ejection opening of the ink-jet head so that a distance between the ejection opening and the driven heater is varied by selecting the heater to be driven (namely heater to be heated) and/or by selecting number of heaters to be driven. By this, the ejection amount of the ink can be varied.

On the other hand, as other structure, there has been known the ink-jet head, in which a plurality of heaters having mutually different surface areas are arranged in the ink path to make the ink ejection amount variable by varying the heater to be driven and/or by varying number of heaters to be driven.

However, when printing is performed employing the ink-jet head having a plurality of heaters corresponding to each of the ejection openings, there should arise the following problems.

The first problem occurs in so-called preliminary ejection to be performed as a part of an ejection recovery process.

More specifically, the preliminary ejection is to perform ink ejection from the ink-jet head irrespective of printing generally at the predetermined position in the printing apparatus. By this, the ink of increased viscosity in the ink-jet head is removed to maintain good ink ejecting condition. Such preliminary ejection is generally performed upon on-set of the power supply or at a given constant time interval during printing. However, in the case where ink ejection can be done at various ejection amounts by a plurality of heaters as set forth above, it is possible that printing is performed with setting the ink ejection amount to a small ejection amount. In such printing operation, when the preliminary ejection is performed in the small ink ejection amount, the effect of the preliminary ejection can be varied depending upon the ejection amount. For instance, amount of the ink of the increased viscosity and bubble to be discharged out of the ink-jet head can become small in the case of small ink ejecting amount during the preliminary ejection. Also, it can be said that since the ejection amount and ejection speed in such mode of printing operation is small, viscosity of the ink is easily increased. Therefore, shortening the interval of the preliminary ejection may be required to lower a through put in printing.

The second problem is related to stabilization of ink ejection amount.

In the ink-jet head of the type ejecting the ink employing the heater, when a head temperature or an ink temperature is varied, the ink ejection amount can be varied though the variation range is not significant, in general. Therefore, when the heat temperature is elevated according to progress of printing operation, a problem of variation of the image quality can be caused due to variation of the ink ejection amount. It has been previously proposed to provide a structure for stabilizing the ink ejection amount regardless of variation of the head temperature as disclosed in Japanese Patent Application Laid-open No. 31905/1993. Here, two sequential pulses are applied to the heater for one time of ink ejection for controlling the head temperature by controlling a pulse width or so forth (hereinafter, occasionally referred to as "pre-heat control") of a preceding pulse among two pulses, so that a variation of the ink ejection amount can be decreased.

Incidentally, in structure to vary the ink ejection amount in a plurality of steps by selecting heaters to be driven in the ink-jet head by employing a plurality of heaters for ejection set forth above, it is of course desirable to maintain ejection amount stable at respective setting.

Japanese Patent Application Laid-open No. 132259/1980 discloses multi-tone expression in structure employing a plurality of heaters. However, it is clear that stabilization of the ink ejecting amount cannot be realized.

The third problem is a problem in the case where pre-heating control is employed relating to stabilization of the ejection amount associated with the second problem.

For stabilization of ejection of the ink-jet head having a plurality of heaters, it is considered to employ the structure of the pre-heat control. However, there are little problems to be considered when optimal ejection amount is to be controlled at respective ink ejection amount settings, such as a relationship between the drive heater in the set ejection amount and the heater performing pre-heating, a relationship between the set ejecting amount and the pulse width of the pre-heat pulse and so forth.

A fourth problem relates to multi-tone printing when a plurality of heaters are employed.

Regarding a plurality of heaters, the above-mentioned prior art only shows structure for making the ink ejection amount variable by selectively driving a plurality of heaters. Therefore, it is possible that good quality of image cannot be printed even when it is applied for the multi-tone printing as is.

For example, when the ejection amount is varied in a relatively wide range by employing a plurality of heaters, the ejection speed for each ejection amount is significantly varied associating therewith. In this case, so-called serial type printing apparatus, in which printing is performed with scanning the ink-jet head, a depositing position of an ejected ink can be offset by variation of the ejecting speed. As a result, a problem is encountered by lowering of the image quality.

SUMMARY OF THE INVENTION

It is a first object of the present invention to provide an ink-jet printing apparatus which can perform appropriate preliminary ejection for each ejection amount mode set by a heater selectively employed among a plurality of heaters.

Another object of the present invention, associated with the first object, is to provide an ink-jet printing apparatus which can effectively perform preliminary ejection with larger ejection amount than performing the preliminary ejection with a small ejection amount, when the preliminary ejection is performed at an interval between printing operation performed with setting the small ejection amount.

The second object of the present invention is to provide an ink-jet apparatus enabling stabilization of the ejection amount with relatively simple structure in the ink-jet apparatus with ink-jet head having a plurality of heaters corresponding to one ejection opening.

Another object of the present invention, associated with the second object, is to provide an ink-jet apparatus, in which ejection amount is reduced in comparison with the case where pulse is applied to all of the heaters simultaneously by shifting a pulse charging timing for respective of plurality of heaters in such manner that reduction amount becomes greater by increasing the shifting amount, and in which shifting period can be varied depending upon information relating to an ink temperature of the ink-jet head so as to stabilize the ejection amount, for instance, even if the ejection amount is increased due to elevating of the ink temperature, the increasing of the ink ejection amount can be suppressed by increasing the shifting period.

The third object of the present invention is to provide an ink-jet apparatus which can perform stable ejection amount control with respect to a plurality of set ejection amounts.

Associating with the above-mentioned third object, another object of the present invention is to provide an ink-jet apparatus which enables control of driving per combination of the heaters set to be driven among a plurality of heaters and which enables control of pre-pulse to be applied for stabilization of the ejection amount per combination.

The fourth object of the present invention is to provide an ink-jet apparatus which can constantly print good image even when tone printing and so forth is performed by varying the ejection amount.

Associating with the fourth object, another object of the present invention is to provide an ink-jet apparatus and ink-jet printing method which can perform printing in various modes by combination of ejection openings and ejection amount.

In a first aspect of the present invention, there is provided an ink-jet apparatus employing an ink-jet head capable of ejecting an ink in variable of an ejection amount in a plurality of steps and performing printing by ejecting an ink from the ink-jet head toward a printing medium, comprising:

printing means for performing printing operation in a predetermined ink ejection amount among the plurality of steps of ink ejection amounts in the ink-jet head; and preliminary ejection means for performing ink ejection not associated with printing, from the ink-jet head, at an ejection amount greater than the predetermined ink ejection amount among the plurality of steps of ink ejection amounts.

In a second aspect of the present invention, there is provided an ink-jet apparatus employing an ink-jet head having a plurality of energy generating elements corresponding to one ejection opening and performing printing by ejecting an ink to a printing medium utilizing the energy generated by the energy generating elements, comprising:

printing means for performing printing operation in a plurality of ink ejection amount modes established by combination of an energy generating element to be used among the plurality of energy generating elements; and preliminary ejection means for performing ink ejection not associated with printing, from the ink-jet head used for printing operation, while the printing operation is performed in one of the plurality of ejection amount modes, the ink ejection by the preliminary means being performed in the ejection amount mode having ejection amount greater than or equal to the ejection amount of the ejection amount mode employed in the printing operation.

In a third aspect of the present invention, there is provided an ink-jet apparatus employing an ink-jet head having a plurality of energy generating elements corresponding to one ejection opening and performing printing by ejecting an ink to a printing medium utilizing the energy generated by the energy generating elements, comprising:

printing means for performing printing operation in a plurality of ink ejection amount modes established by combination of an energy generating element to be used among the plurality of energy generating elements; and preliminary ejection executing means having preliminary ejection modes respectively corresponding to the plurality of ejection amount modes.

In a fourth aspect of the present invention, there is provided an ink-jet apparatus employing an ink-jet head having a plurality of heaters corresponding to one ejection opening and performing printing by ejecting an ink from the ink-jet head to a printing medium, comprising:

driving means for applying respective pulses to the plurality of heaters for bubbling the ink for ejecting the ink through the one ejection opening, the driving means being capable of mutually shifting timings of bubbling at respective of the plurality of heaters on a basis of information relating to an ink temperature of the ink-jet head.

In a fifth aspect of the present invention, there is provided an ejection amount controlling method in an ink-jet apparatus employing an ink ejecting portion having a plurality of heaters corresponding to one ejection opening and ejecting ink from the ink ejecting portion to a printing medium, the method comprising the step of:

adjusting an ink ejection amount by mutually shifting bubbling timing at respective of the plurality of heaters upon application of respective pulses to the plurality of heaters for causing bubbling of ink to eject ink through the ink ejection opening.

In a sixth aspect of the present invention, there is provided an ejection amount stabilizing method in an ink-jet apparatus employing an ink ejecting portion having a plurality of heaters corresponding to one ejection opening and ejecting ink from the ink ejecting portion to a printing medium, the method comprising the step of:

stabilizing an ink ejection amount by mutually shifting bubbling timing at respective of the plurality of heaters upon application of respective pulses to the plurality of heaters for causing bubbling of ink to eject ink through the ink ejection opening so as to adjust the ink ejection amount.

In a seventh aspect of the present invention, there is provided an ink jet apparatus employing an ink-jet head having a plurality of heaters corresponding to one ejection opening, and ejecting ink from the ink-jet head to a printing medium, comprising:

head driving means for applying a preceding pulse which does not cause ejection and a subsequent pulse following the preceding pulse to generate a bubble for ejecting the ink;

ejection amount mode setting means for setting an ejection amount mode by selecting heater to be applied the subsequent pulse among the plurality of heaters; and pre-pulse control means for controlling application of the preceding pulse through the head driving means in respective ejection amount modes set by the ejection amount mode setting means, on a basis of information relating to an ink temperature of the ink-jet head.

In an eighth aspect of the present invention, there is provided an ink-jet apparatus employing an ink-jet head arranged first and second heaters corresponding to one ejection opening and ejecting an ink droplet of a selected one of a plurality of ejection amounts by generating bubble by driving the first and second heaters in combination, comprising:

driving means for driving the first and second heaters with a pre-heat pulse in advance of driving with a main heating pulse.

In a ninth aspect of the present invention, there is provided an ink-jet apparatus employing an ink-jet head arranged a plurality of mutually different heaters corresponding to one ejection opening and ejecting ink droplet of a plurality of mutually different ejection amounts by driving the plurality of heaters in combination to generate a bubble, comprising:

a table used for driving the heaters in the combination corresponding to respective combinations of the plurality of heaters.

In a tenth aspect of the present invention, there is provided an ink-jet apparatus employing an ink-jet head arranged a plurality of heaters corresponding to one ejection opening and ejecting an ink from the ink-jet head to a printing medium, comprising:

setting means for setting presence or absence in heater driving irrespective of ejection data for respective of the plurality of heaters; and ejection data setting means for establishing correspondence between ejection data and the ejection openings to perform ink ejection on a basis of the ejection data, depending upon combination of presence or absence of driven heaters set by the setting means.

In an eleventh aspect of the present invention, there is provided an ink-jet apparatus for performing printing employing an ink-jet head having ejection openings which can sequentially differentiate a size of ink droplet among a plurality of sizes per in each scanning cycle or per every number of scanning cycles, comprising:

means for driving the ink-jet head with relatively shifting the ink-jet head relative to the printing medium so that a plurality of different sizes of ink droplets are ejected so as to form a plurality of different sizes of dots which are complementarily disposed relative to each other.

In a twelfth aspect of the present invention, there is provided an ink-jet apparatus for performing printing employing an ink-jet head having ejection openings which can sequentially differentiate a size of ink droplet among a plurality of sizes per in each scanning cycle or per every number of scanning cycles, wherein ejection timing is differentiated depending upon the size of the ink droplet.

In a thirteenth aspect of the present invention, there is provided an ink-jet apparatus having an ink-jet head capable of ejecting two mutually different sizes of ink droplets and capable of reciprocal printing, comprising:

first mode executing means for performing printing with a large ink droplet in one of forward and reverse printing directions;

second mode executing means for performing printing with a small ink droplet in the other of the forward and reverse printing directions; and switching means for switching the first and second modes.

In a fourteenth aspect of the present invention, there is provided an ink-jet apparatus having an ink-jet head capable of ejecting mutually different two sizes of ink droplets, comprising:

means for varying ejection timing of the ink droplet depending upon the size of the ink droplet or combination of heaters to be driven.

In a fifteenth aspect of the present invention, there is provided an ink-jet apparatus employing an ink-jet head, in which a plurality of ejection openings are arranged in a form of array, and performing printing of a density of 1/N with ejection opening group of 1/N ($N \geqq 2$) of ejection opening array, comprising:

printing executing means for executing ejection mode depending upon the density.

In a sixteenth aspect of the present invention, there is provided an ink-jet apparatus employing ink ejecting portion having a plurality of heaters corresponding to one ejection opening and ejecting ink from the ink ejecting portion to a printing medium, comprising:

driving means for driving the plurality of heaters; with varying combination of the heaters to be driven and/or varying driving energy to be applied to the heaters to be driven.

In a seventeenth aspect of the present invention, there is provided an ink-jet apparatus employing an ink-jet head capable of ejecting an ink in variable of an ejection amount in a plurality of steps and performing printing by ejecting an ink from the ink-jet head toward a printing medium, comprising:

preliminary ejection means for performing preliminary ejection operation with a large ejection amount and preliminary ejection operation with a small ejection amount; and preliminary ejection interval setting means for setting an interval between preliminary ejection operations with the small ejection amount shorter than an interval between preliminary ejection operations with the large ejection amount.

In an eighteenth aspect of the present invention, there is provided a method for performing a preliminary ejection not associated with printing from an ink-jet head capable of ejecting an ink in variable of an ejection amount in a plurality of steps, comprising the steps of:

performing preliminary ejection operation with a large ejection amount;

performing preliminary ejection operation with a small ejection amount; and setting an interval between preliminary ejection operations with the small ejection amount shorter than an interval between preliminary ejection operations with the large ejection amount.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings:

FIG. 12 is an illustration showing a shifting period table relating to the second embodiment of the invention;

FIG. 15 is an illustration showing a shifting period table relating to the first modification of the second embodiment;

FIG. 16 is an illustration showing a shifting period table relating to the second modification of the second embodiment;

FIG. 29 is an illustration showing a relationship between ejection amount mode and main pulse driven heater and pre-pulse driven heater in the third embodiment;

FIGS. 30A, 30B and 30C are diagrammatic illustrations showing tables of pre-pulses P1 in each ejection amount mode in the third embodiment;

FIGS. 32A, 32B and 32C are diagrammatic illustrations showing tables of pre-pulses P1 in each ejection amount mode in the first modification of the third embodiment;

FIGS. 34A and 34B are diagrammatic illustrations showing tables of pre-pulses P1 in each ejection amount mode in the second modification of the third embodiment;

FIGS. 35A and 35B are diagrammatic illustrations showing tables of pre-pulses P1 in each ejection amount mode in the second modification of the third embodiment;

FIGS. 37A, 37B and 37C are diagrammatic illustrations showing tables of off time Ps of each ejection amount mode in the third modification of the third embodiment;

FIGS. 39A, 39B and 39C are diagrammatic illustrations showing tables of off time Ps of each ejection amount mode in the fourth modification of the third embodiment;

DESCRIPTION OF THE PREFERRED EMBODIMENT

The preferred embodiments of an ink-jet printing apparatus according to the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessarily obscure the present invention.

Figure 1:
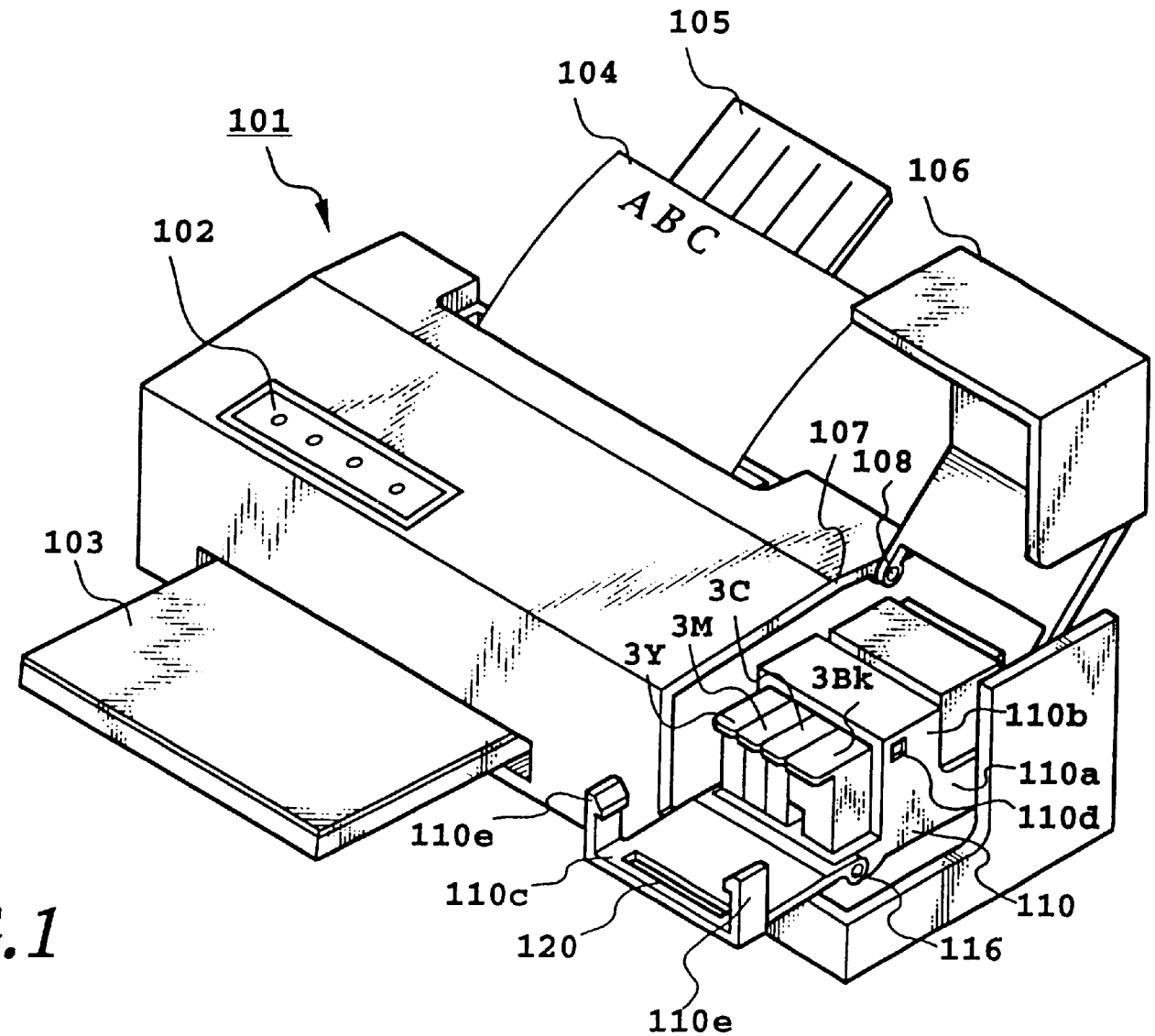
FIG. 1 is a perspective view showing one embodiment of an ink-jet printing apparatus according to the present invention.

FIG. 1 is a perspective view showing a printer as an ink-jet printing apparatus, for which various embodiments and their modifications according to the present invention discussed below are applicable.

In FIG. 1, a reference numeral 101 denotes a printer, a reference numeral 102 denotes an operation panel portion provided at the upper front portion of a housing of the printer 101, a reference numeral 103 denotes a feeder cassette to be set through an opening at the front face of the housing, a reference numeral 104 denotes a paper (printing medium) to be fed from the feeder cassette 103, and a reference numeral 105 denotes a discharged paper tray for maintaining papers discharged through a paper feeding path in the printer 101. A reference numeral 106 denotes a sectionally L-shaped main body cover. The main body cover 106 is designed for covering an opening portion 107 formed at the right front portion of the housing and is pivotally mounted on the inner side edge of the opening portion 107 by means of a hinge 108. In addition, within the housing, a carriage 110 supported by a guide or so forth (not shown) is arranged. The carriage 110 is movably provided for reciprocation along a width direction of the paper (hereinafter also referred to as "primary scanning direction") transverse to the paper feeding path.

The carriage 110 in the shown embodiment generally comprises a stage 110*a* to be held horizontally by the guide or so forth, an opening portion (not shown) for accommodating ink-jet head at the rear side on the stage 110*a*, a cartridge garage 110*b* for receiving ink-jet heads 3Y, 3M, 3C and 3Bk which are detachably loaded on the stage 110*a* front side of the opening portion, and a cartridge holder 110*c* opened and closed relative to the garage 110*b* for preventing the cartridge received within the garage 110*b* from loosening or falling off.

The stage 110*a* is slidably supported at the rear and thereby by means of a guide. The lower side of the front end of the stage 110*a* is slidably engaged with a not shown glide plate. It should be noted that the guide plate may be one which serves as a paper holding member preventing the paper fed through the paper feeding path from floating, and, in the alternative, the guide plate may be one which has a function to lift up the stage relative to the guide in cantilever fashion.

The opening portion of the stage 110*a* is adapted to be loaded the ink-jet head (not shown) in a position directing ink ejecting openings downwardly.

The cartridge garage 110*b* is formed with a through opening extending in back and forth direction for simultaneously receiving four ink cartridges 3Y, 3M, 3C and 3BK. On the both of outer sides, engaging recceses, to which engaging claws of the cartridge holder 110*c* are engaged, are formed.

At a front end portion of the stage 110*a*, the cartridge holder 110*c* is pivotally mounted by means of a hinge 116. A dimension from the front end portion of the garage 110*b* to the hinge 116 is determined with taking a dimension to project the cartridge 3Y, 3M, 3C and 3Bk from the front end portion of the garage 110*b*. The cartridge holder 110*c* is generally rectangular plate form. On the cartridge holder 110*c* is a pair of engaging claws 110*e* projecting in the direction perpendicular to a plate at both of side portions of the upper side away from the lower portion fixed by the hinge 116 and engaging with engaging recesses 110*d* of the garage 110*b*. On the other hand, in the holder 110*c*, engaging holes 120 for engaging with the handle portions of respective cartridge 3Y, 3M, 3C and 3Bk are formed in the plate portion thereof. These engaging holes 120 have position, shape and size corresponding to the handle portion.

Figure 2:
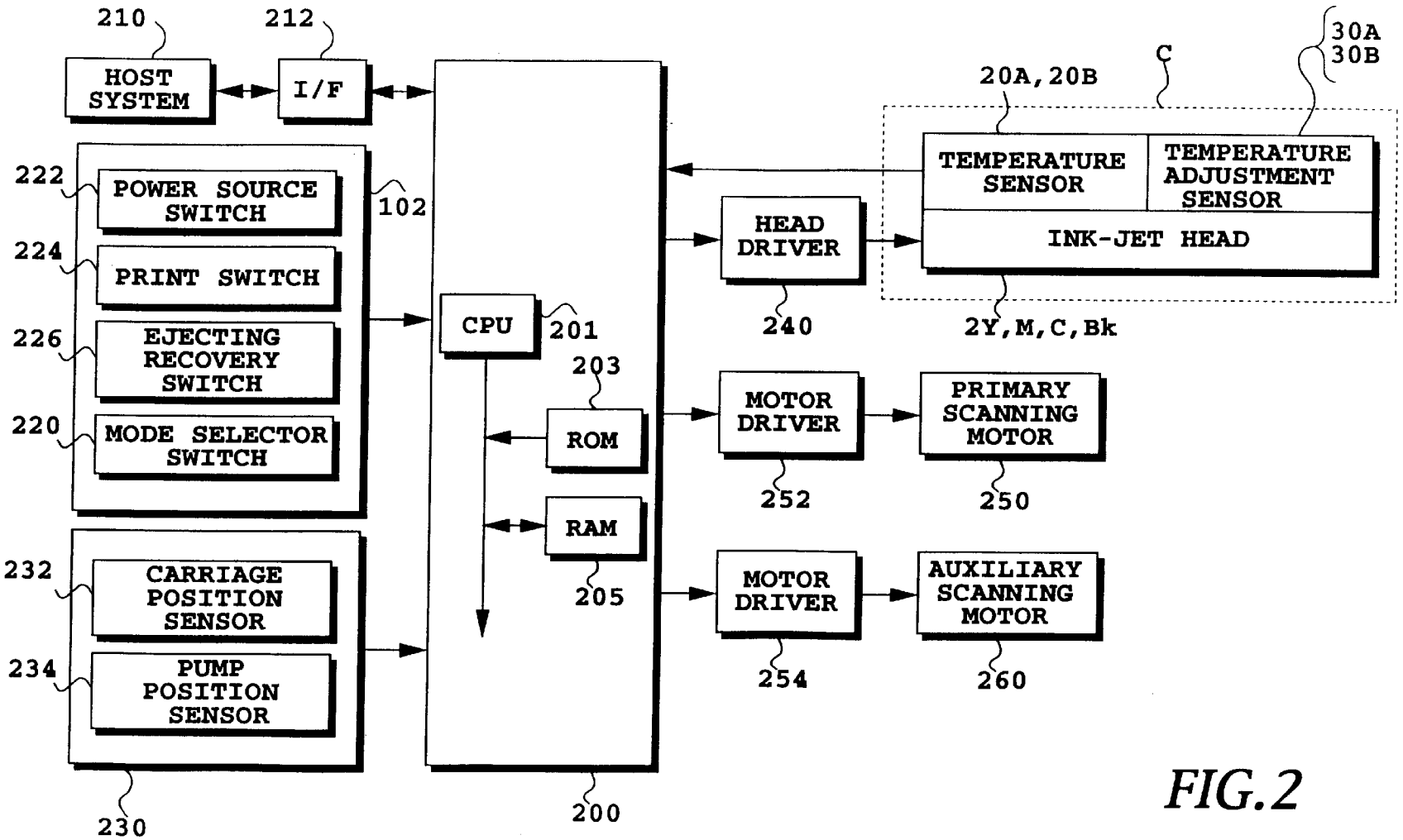
FIG. 2 is a block diagram mainly showing a control system of the printing apparatus.

FIG. 2 is a block diagram showing an example of construction of a control system in the ink-jet printing apparatus.

Here, a reference numeral 200 denotes a controller forming a main control portion, which includes a CPU 201 in a form of microcomputer, for example, for executing various modes discussed later, a ROM 203 storing fixed data, such as programs, tables, a voltage value of a heat pulse, pulse width and so forth, a RAM 205 provided with a region for developing the image data and a region for working. A reference numeral 210 denotes a host system (may be a reader portion of an image reader) forming a supply source of the image data. The image data and other commands, status signal and so forth are exchanged with the controller via an interface (I/F) 212.

The operation panel 102 is provided with a switch group including a mode selector switch 220 for selecting various modes discussed later, a power switch 222, a print switch 224 for designating starting of printing, ejecting recovery switch 226 for designating initiation of ejecting recovery process, and so forth, which switch group receives command inputs by the operator. 230 denotes a sensor group for detecting the condition of apparatus, which sensor group includes a sensor 232 for detecting the position of the carriage 110, such as a home position and/or start position, and a sensor 234 to be employed for detecting the pump position including a leaf switch.

A reference numeral 240 denotes a head driver for driving an electro-thermal transducing element of the ink-jet head depending upon the printing data and so forth. Furthermore, a part of the head drivers may also be used for driving temperature heater 30A and 30B. Also, temperature detected values from temperature sensors 20A and 20B are input to the controller 200. A reference numeral 250 denotes a primary scanning motor for shifting the carriage 110 in the primary scanning direction, and a reference numeral 252 denotes a driver. A reference numeral 260 denotes a auxiliary scanning motor which is used for feeding the paper 104 as the printing medium (see FIG. 1).

The above-mentioned ink-jet printing apparatus has ink-jet head cartridge 2C, 2M, 2Y and 2Bk for four colors of inks of cyan, magenta, yellow and black.

Figure 3:
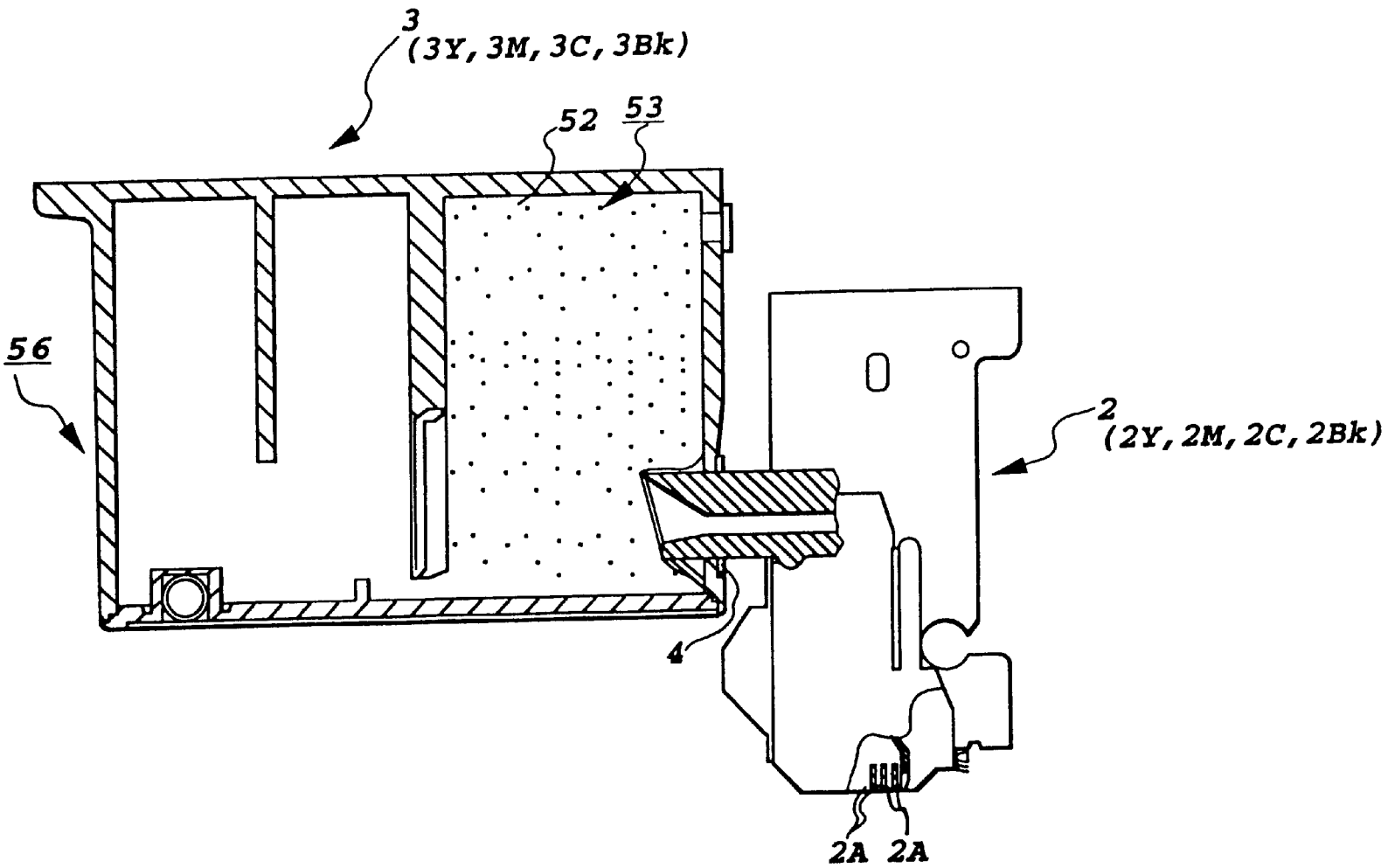
FIG. 3 is a section showing an ink-jet head and an ink tank cartridge to be employed in the shown embodiment of the ink-jet printing apparatus.

FIG. 3 is a section showing a connecting condition of an ink tank cartridge 3 and an ink-jet head 2 to be employed in the above-mentioned ink-jet printing apparatus.

The ink tank cartridge 3 employed in the shown embodiment includes two chambers of a vacuum generating member receptacle portion 53 filled with an ink absorbing body 52 and an ink receptacle portion 56, in which nothing is filled. In the initial condition, ink is filled in both of these chambers. Associating with ink ejection and so forth in the ink-jet head 2, the ink in the ink receptacle chamber 56 is consumed at first.

The ink-jet head 2 has a heater (not shown in FIG. 3) for generating thermal energy to be used for ejection, in the ink path 2A communicated with the ink ejection opening for ejecting the ink supplied from the ink tank cartridge 3 via a connection pipe 4.

First Embodiment

Figure 4:
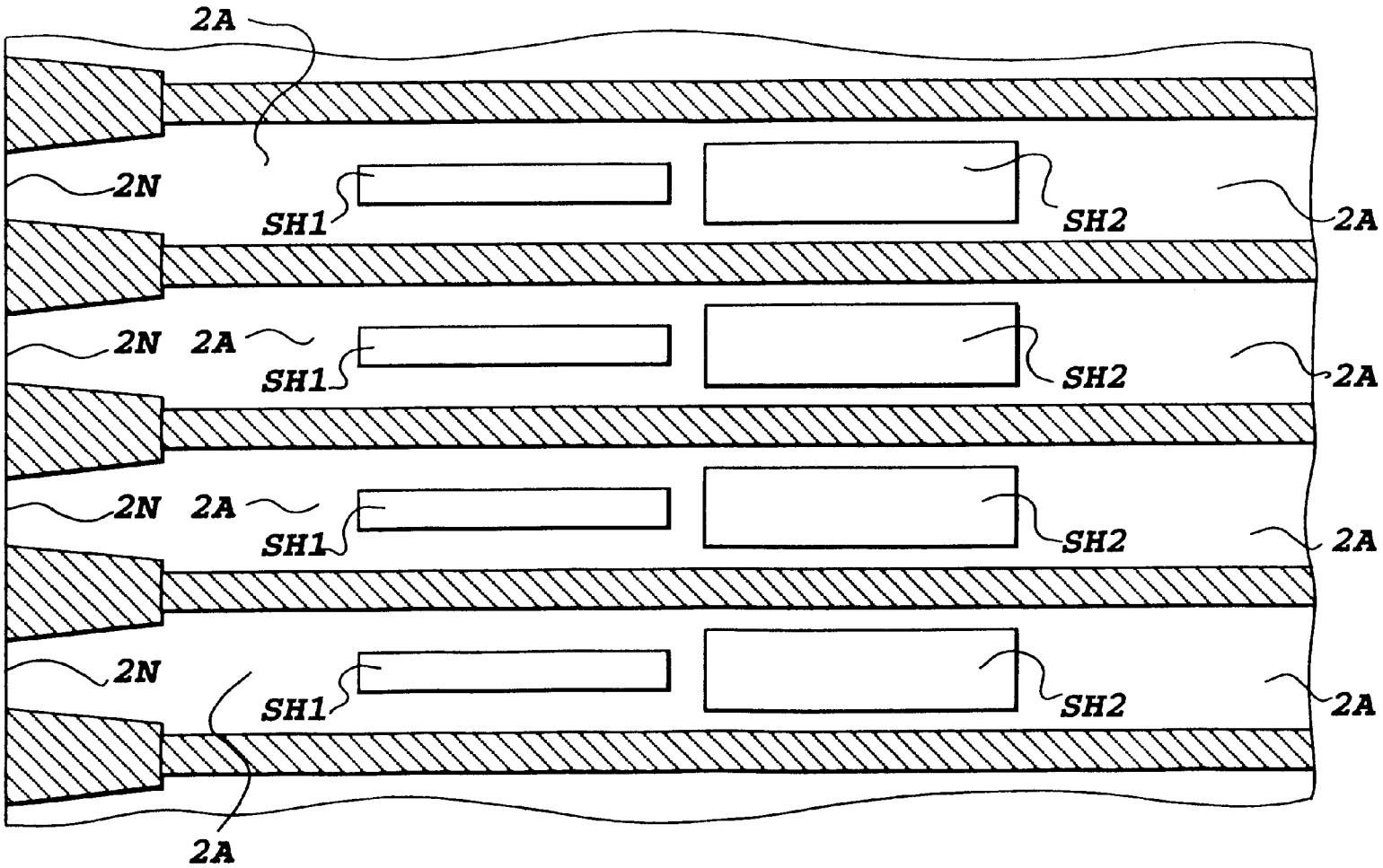
FIG. 4 is a section showing a construction of the first embodiment of an ink-jet head according to the present invention.

FIG. 4 is a diagrammatic section showing a construction of the first embodiment of the ink-jet head 2 according to the present invention.

As shown in FIG. 4, two heaters SH1 and SH2 are arranged in each ink path 2A in alignment along the longitudinal direction. These heaters are adapted to mutually differentiate the surface area. Electrode wiring and so forth (not shown) is provided so that each heater can be driven independently of the other, and also, both heaters can be driven simultaneously. It should be noted that the heaters SH1 and SH2 have the equal length in the longitudinal direction of the ink path 2A and are differentiated in the widths for differentiating the surface areas. At the tip end of the ink path 2A, an ejection opening 2N is opened.

Ink path units each consisted of the heater, the ejection opening, the ink path and so forth are provided in a given number so as to be arranged in the density of 360 DPI in the ink-jet head. Also, in the shown embodiment, the opening area and the heater area in each unit are the same in each ink path, respectively.

In the shown embodiment, in which two heaters are employed, three steps of setting of the ink ejection amount (hereinafter referred to as basic ejection amount modes) is basically possible per the ejection opening with the combination of the heaters to be driven. Hereinafter, discussion will be given with respect to the basic ejection amount mode in the shown embodiment.

By switching the heater to be driven, there can be basically achieved three ejection amount modes of small, medium and large. In the small ejection amount mode, only the heater SH1 is driven to eject 15 pl in volume of liquid droplets. Similarly, in the medium ejection amount mode, only the heater SH2 is driven to eject 25 pl of volume of ink droplets, and in the large ejection amount mode, both of the heaters SH1 and SH2 are driven simultaneously to perform ejection of 40 pl (=15+25 pl) of the liquid droplet.

Next, discussion will be given hereinafter with respect to printing modes employing the above-mentioned three basic ejection amount modes.

(360 DPI mode: normal printing mode)

This mode is to perform printing in the density of 360 DPI by the large ejection amount mode.

In this mode, the preliminary ejection is performed with the large ejection amount mode. More specifically, the preliminary ejection is performed by driving both of the larger heater SH2 and the smaller heater SH1.

(720 DPI mode)

Basically, by using small ejection amount mode, printing is performed at the density of 720 DPI×720 DPI by shifting the ink-jet head in the magnitude corresponding to half of a pixel relative to the printing medium. It should be appreciated that even in this mode, the ejection amount can be switched between small, medium and large. By this, the density can be adjusted to be appropriate.

When printing is performed in the small ejection amount mode, since the ink ejection amount is small and the ejection speed is low, a time interval to reach the state where the stable ejection becomes impossible due to increasing of viscosity and including of bubble can becomes shorter. Therefore, irrespective of the ejection amount mode, the preliminary ejection is performed in the large ejection amount mode.

Figures 5, 5A:
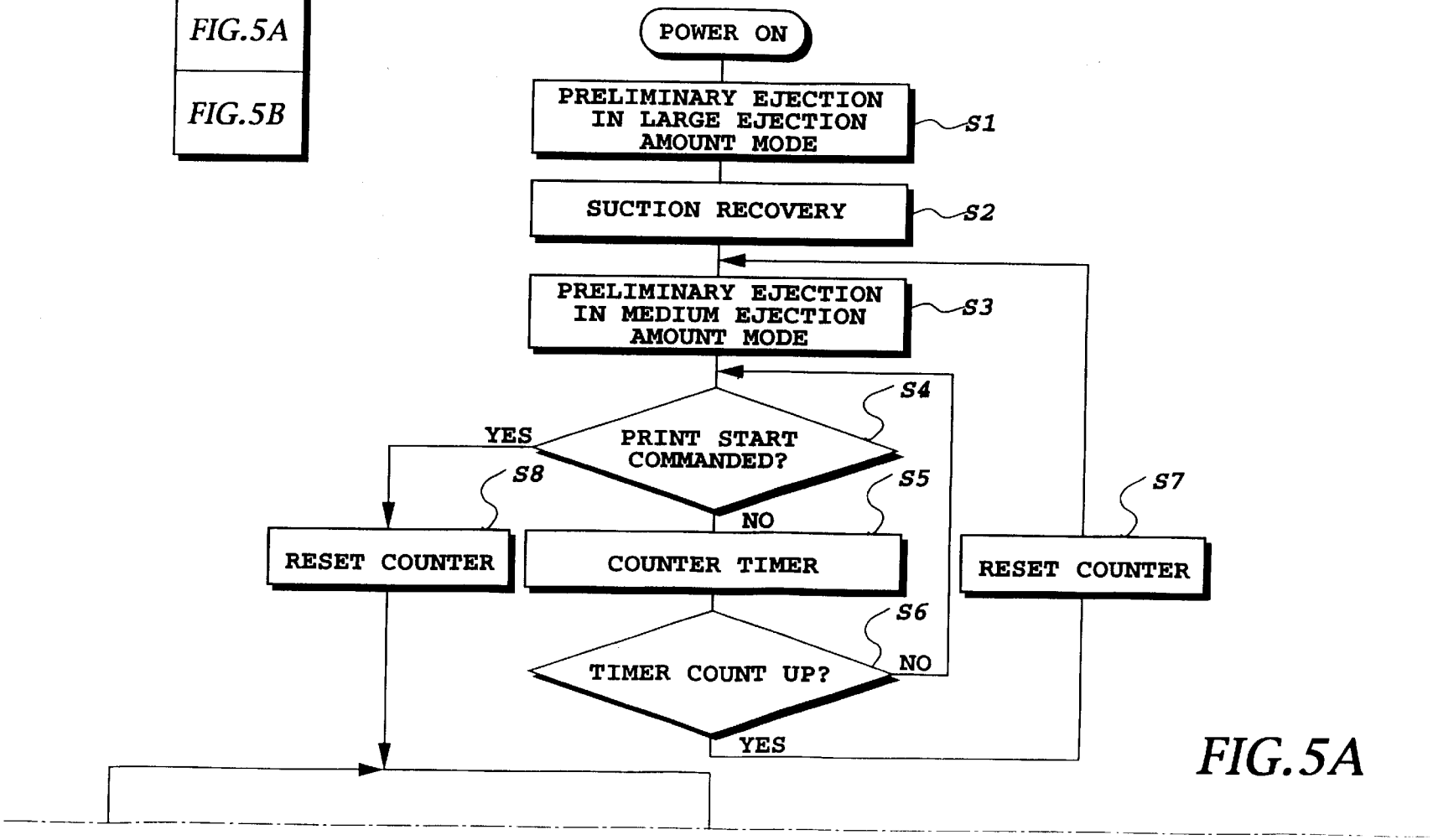
FIGS. 5A and 5B are flowcharts showing a first embodiment of a printing sequence.
Figure 5B:
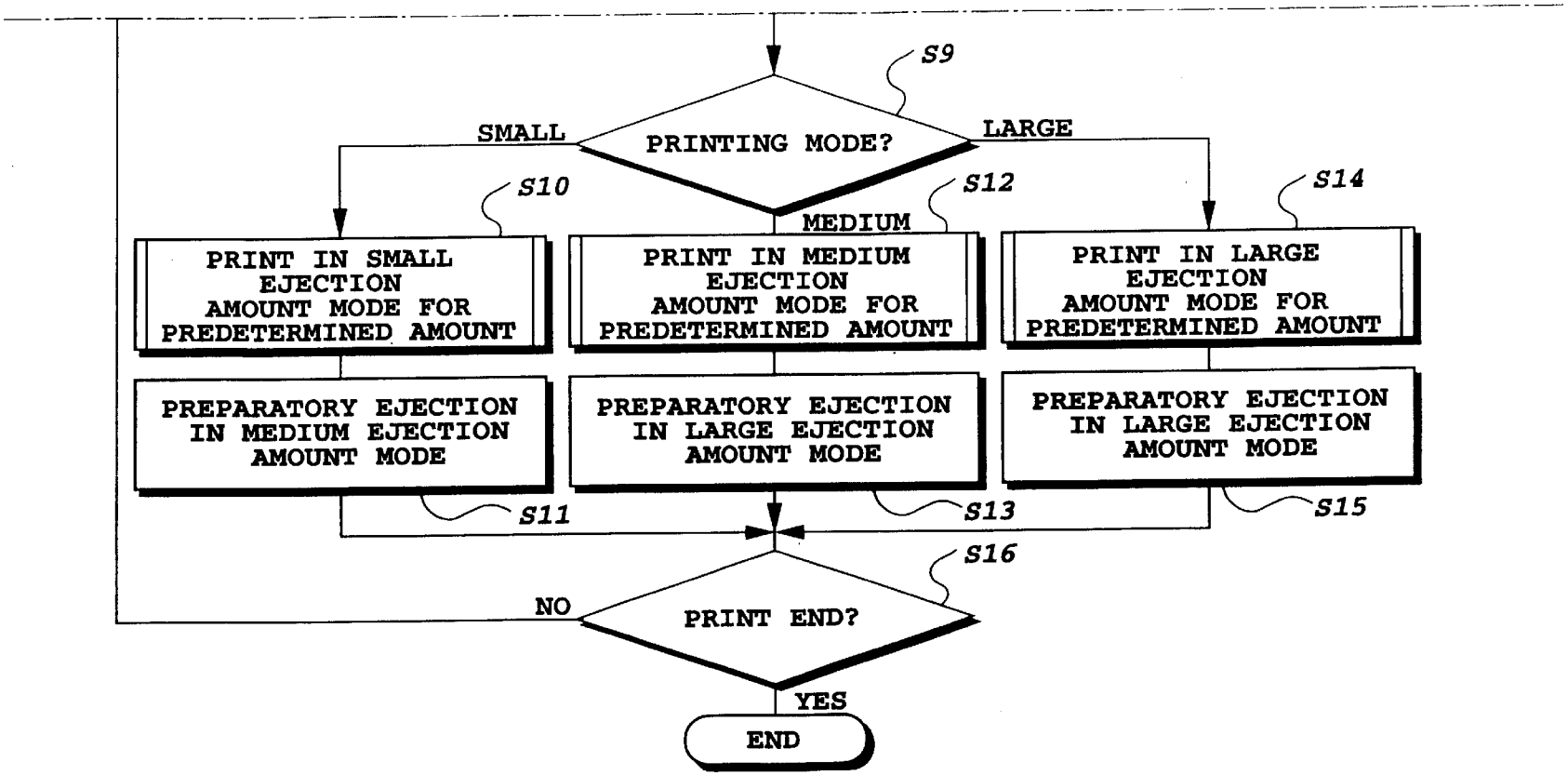

FIG. 5 is a flowchart showing a print sequence in the shown embodiment. In the shown embodiment, a printing operation is performed in the large, medium or small ejection mode depending upon respective print modes and so forth.

In FIG. 5, immediately after turning ON of a power supply for the apparatus, the preliminary ejection is performed in the large ejection amount node (step S1). Subsequently, a suction recovery process is performed (step S2). This is because that increasing of viscosity of the ink and degree of admixing of bubble during the period where the apparatus is held not in use, are considered to be relatively large.

Next, at step S3, the preliminary ejection is performed in the medium ejection amount mode. Thereafter, the apparatus is placed into a stand-by state for waiting a print initiation command. During stand-by state, a period to be held in the stand-by state is counted (step S5), and when a judgement is made that the stand-by period becomes longer than or equal to a predetermined period (step S6), the preliminary ejection in the medium ejection amount mode is performed.

When the print initiation command is input (step S4), a currently set printing mode is checked (step S9). For instance, when 360 DPI mode is set, judgement is made that the ejection amount mode is the large ejection amount mode. Based on the judgement, predetermined amount of printing, e.g. several lines of printing, is performed in the selected one of the small, medium and large ejection amount mode (steps S10, 12 or 14). After the predetermined amount of printing is performed, in the case that the small ejection amount mode is set, the preliminary ejection is performed in the medium ejection amount modes (step S11), in the case of the medium ejection amount mode is set, the preliminary ejection is performed in the large ejection amount mode (step S13), and in the case of the large ejection amount mode is set, the preliminary ejection is performed in the large ejection amount (step S15).

Thus, by performing the preliminary ejection during printing operation in the larger ejection amount mode than the ejection amount mode set in printing, an interval of the preliminary ejection during printing mode can be set longer.

First Modification of First Embodiment

Figure 6A:
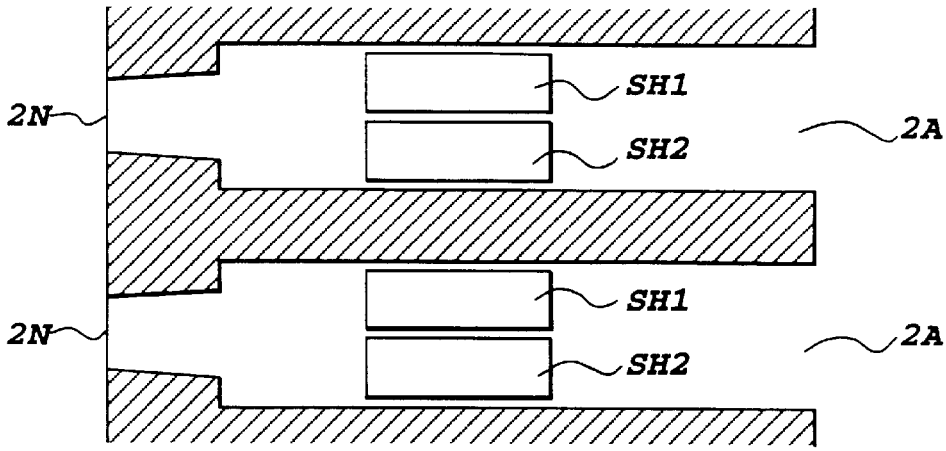
FIGS. 6A and 6B are sections showing two examples of the constructions of the ink-jet head to be employed in the first modification of the first embodiment.
Figure 6B:
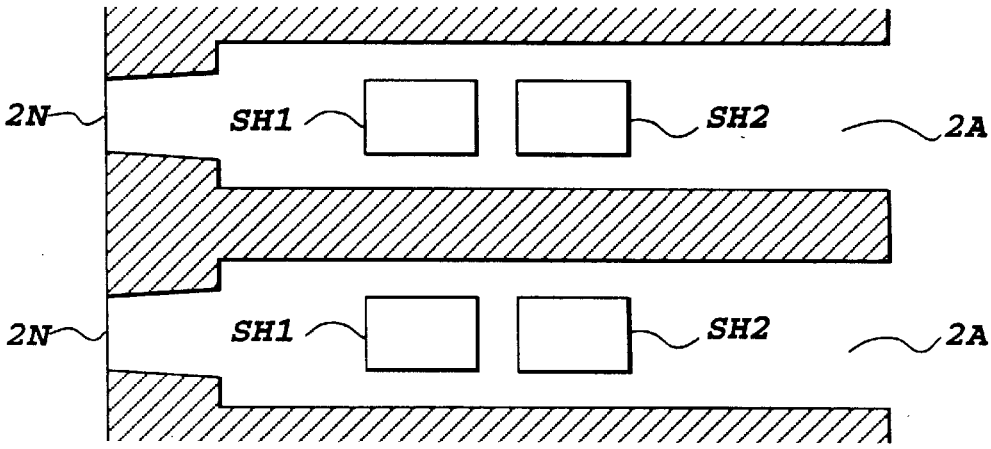

FIGS. 6A and 6B are sections showing two examples of the ink-jet head which can be employed in the first modification of the first embodiment set forth above.

The ink-jet head to be employed in the shown modification employs two heaters SH1 and SH2 in the same size. The heaters SH1 and SH2 are arranged along the ink path 2A or, in the alternative, in alignment in the direction perpendicular to the direction of the ink path 2A.

With this heater construction, the shown modification may set the following two ejection amount modes. Namely, the two ejection amount modes are the large ejection amount mode, in which large ejection amount is established by driving two heaters simultaneously, and the small ejection amount mode, in which small ejection amount is established by driving one of two heaters.

Also, with respect to the print mode, similar modes discussed with respect to the first embodiment can be set.

Figure 7:
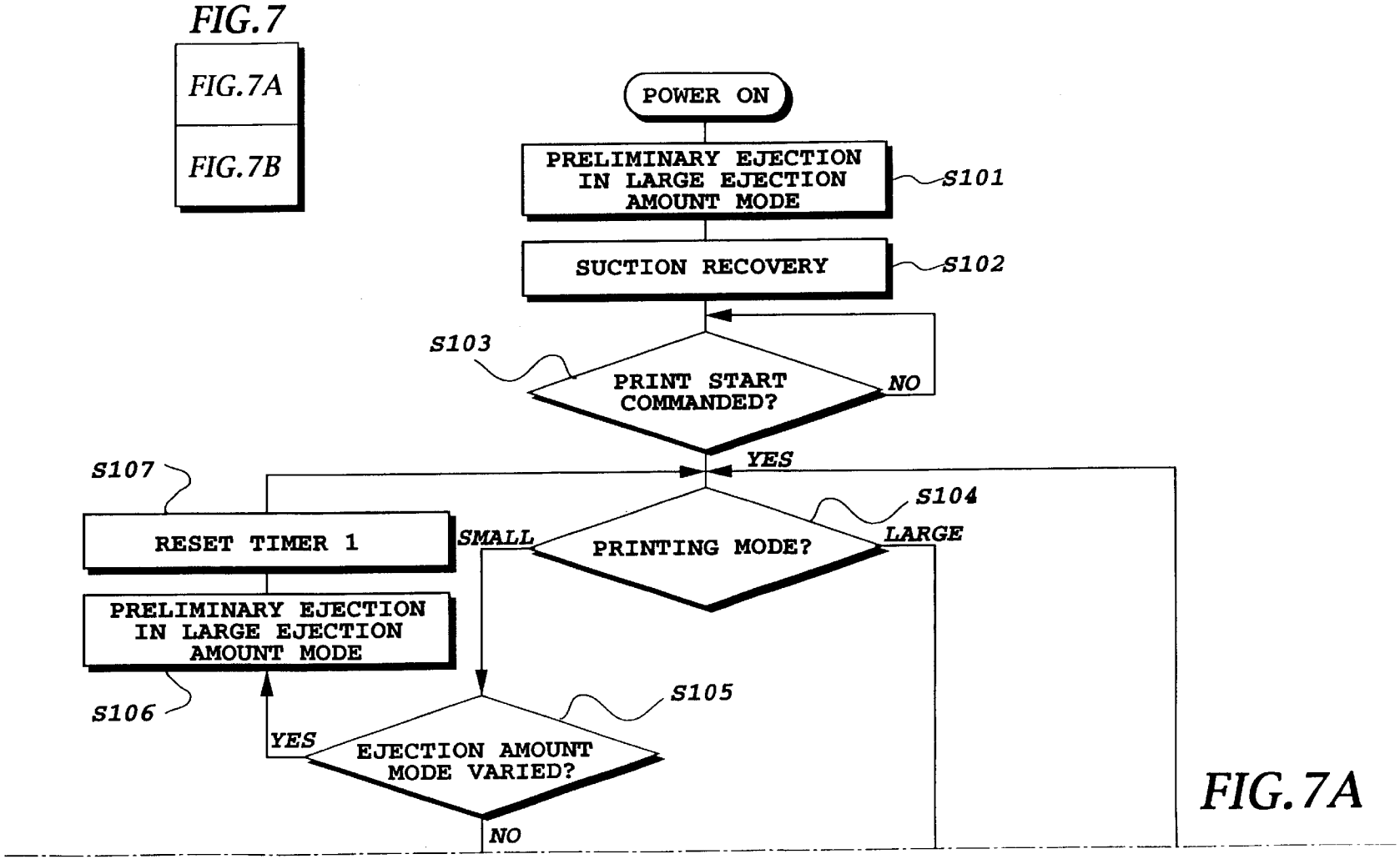
FIGS. 7A and 7B are flowcharts showing the second modification of the printing sequence of the first embodiment.
Figure 7B:
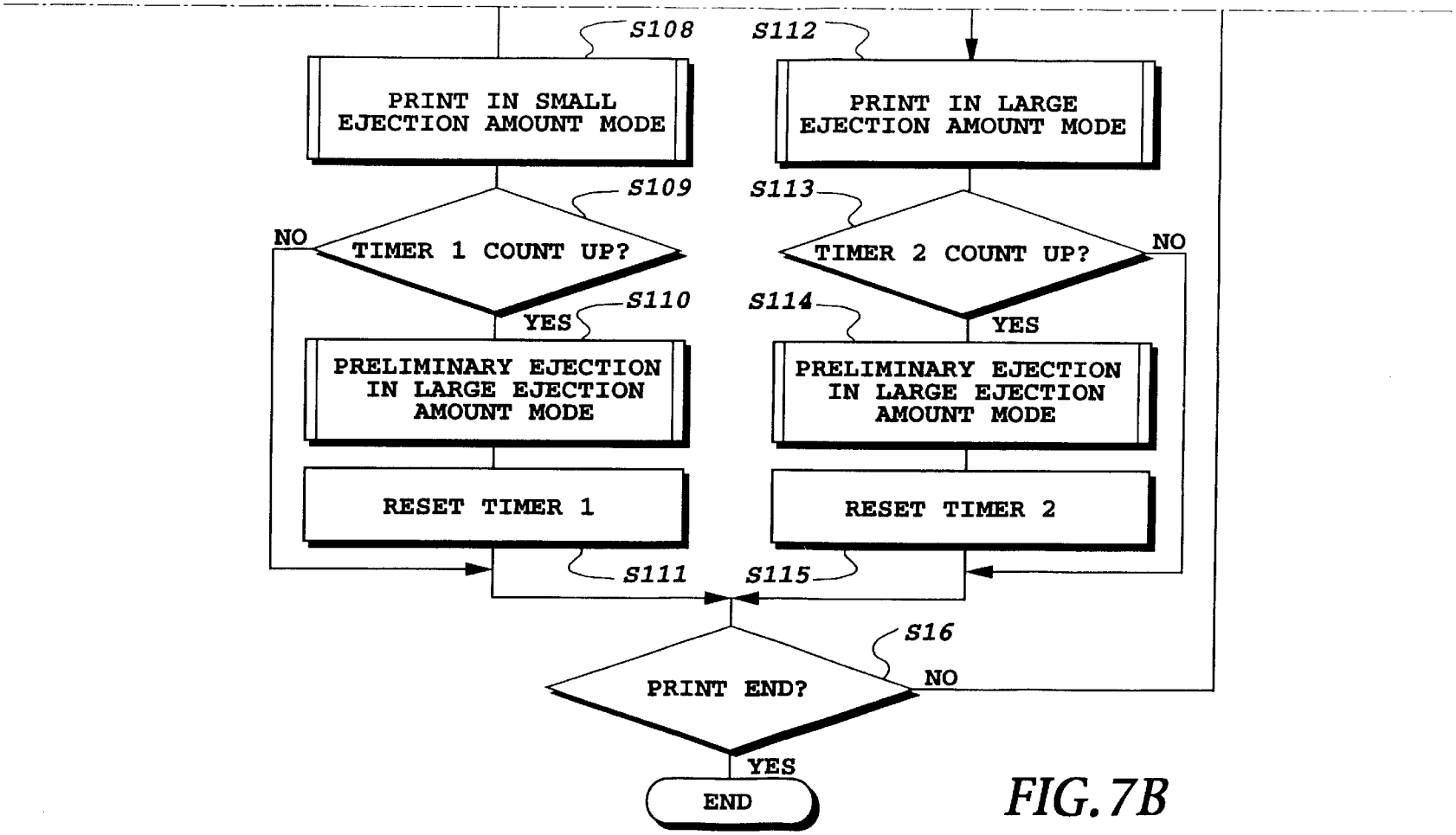

FIG. 7 is a flowchart showing a print sequence in the shown modification.

Also, in the shown modification, similarly to the foregoing first embodiment, the preliminary ejection in the large ejection amount mode is performed immediately after turning ON the power supply (step S101). Furthermore, when the ejection amount mode is switched from the large ejection amount mode to the small ejection amount mode during printing (step 105), the preliminary ejection in the large ejection amount mode is performed at the timing of switching (step 106). Then, a timer 1 for measuring a period where the small ejection amount mode printing is maintained is reset (step 107).

Furthermore, in the shown modification, without employing a construction to perform preliminary ejection per every predetermined amount of printing, the interval of the preliminary ejection is managed by timers for respective ejection amount modes. Here, the interval of preliminary ejection in the small ejection amount mode printing (timer 1) is set to be shorter than that in the large ejection amount mode printing (timer 2) by means for setting the interval between preliminary ejection operations. In the case that the ejection operation is kept being performed in the small ejection amount mode, a part of ink holding portion (an inside of the ink path) is heated and the ink is ejected at a small amount. As a result of this, heat storage easily occurs in the head and it is possible for increasing of viscosity of ink to occur.

According to the shown modification, a problem described above can be solved. Furthermore, since the preliminary ejection in the small ejection amount mode printing is performed in the large ejection amount mode, time for an operation of the preliminary ejection can be shortened. In addition, since the preliminary ejection in the small ejection amount mode printing is performed in the large ejection amount mode, the interval of the preliminary ejection in the small ejection amount mode printing can be set longer than that should be when preliminary ejection is performed in the small ejection amount mode.

It should be noted that in place of resetting process of the timer 1 at step S107, it may be possible to replace the remaining period (timer 2) of the large ejection amount mode printing with the remaining period (timer 1) in the small ejection amount mode printing.

Second Modification of First Embodiment

The shown modification is similar to the foregoing first modification of the first embodiment in the construction of the ink-jet head. However, in the shown modification, the size of the heaters SH1 and SH2 are greater than those of the first modification so that sufficient ejection amount for printing in the density of 360 DPI can be certainly achieved by driving one of the heaters.

More specifically, only one of two heaters is driven, and the heater to be driven is selected appropriately or arbitrarily so as to expand the life of the heater.

Even with the shown construction, the preliminary ejection is performed with driving two heaters simultaneously.

Third Modification of First Embodiment

Figure 8:
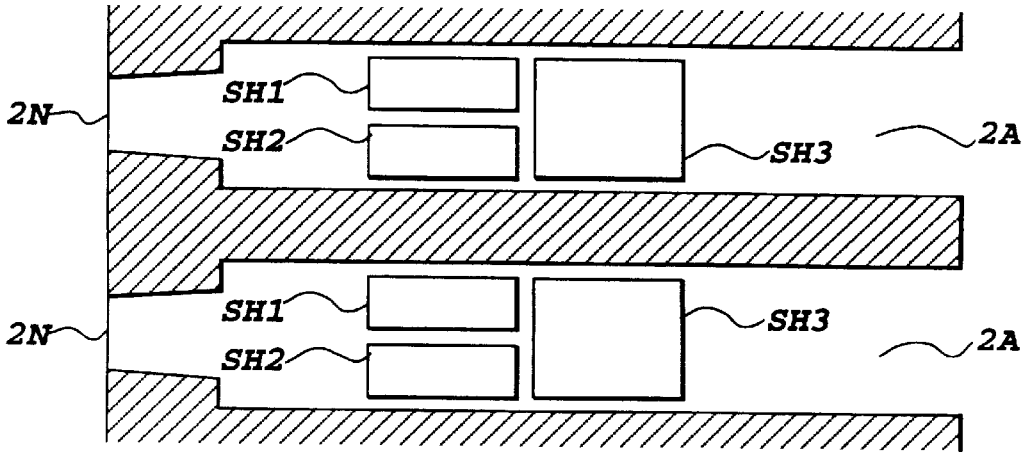
FIG. 8 is a section showing the construction of the third modification of the ink-jet head of the first embodiment.

FIG. 8 is a section showing a construction of the third modification of the ink-jet head.

The shown modification of the ink-jet head has three heaters SH1, SH2 and SH3 within the ink path 2A and permits three ejection amount modes depending upon number of heaters driven.

In the large ejection amount mode, three heaters are driven. However, in such case, since the ink ejection amount becomes significantly large, a driving frequency is controlled to be lower than that in another two ejection amount modes. Therefore, printing speed is slightly lowered.

On the other hand, in the small ejection amount mode, only one heater is driven. However, upon the preliminary ejection during printing, two heaters are driven. Here, the reason why all three heaters are not driven (i.e. only two heaters are driven for the preliminary ejection), is that while large power may be attained by ejection with driving three heaters, the driving frequency cannot be set higher to require relatively long period in the preliminary ejection to substantially lower the printing speed.

Second Embodiment

The shown embodiment relates to stabilization of an ejection amount of the ink-jet head. In the shown embodiment, constructions of the ink-jet heads are the same as those illustrated in FIGS. 6A and 6B.

Figure 9:
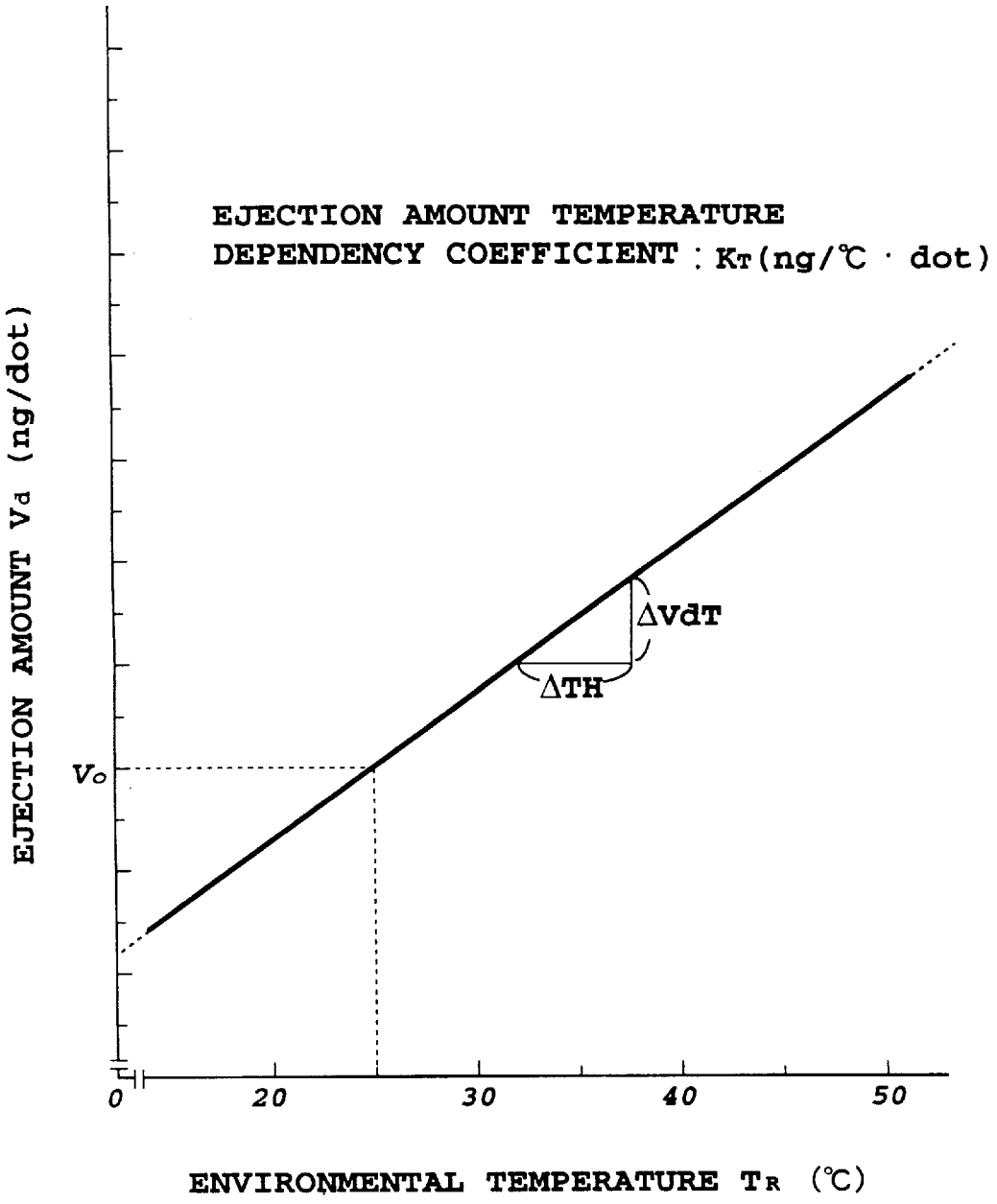
FIG. 9 is a diagrammatic illustration showing a environmental temperature dependency of an ejection amount of the ink-jet head.
Figure 10A:
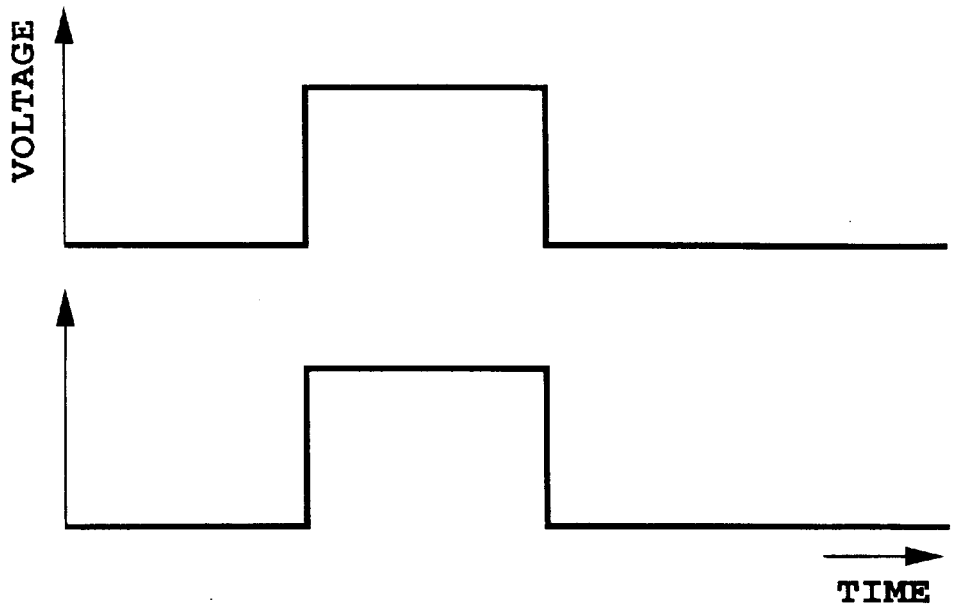
FIG. 10A is a diagrammatic illustration showing pulses to be simultaneously applied to two heaters.
Figure 10B:
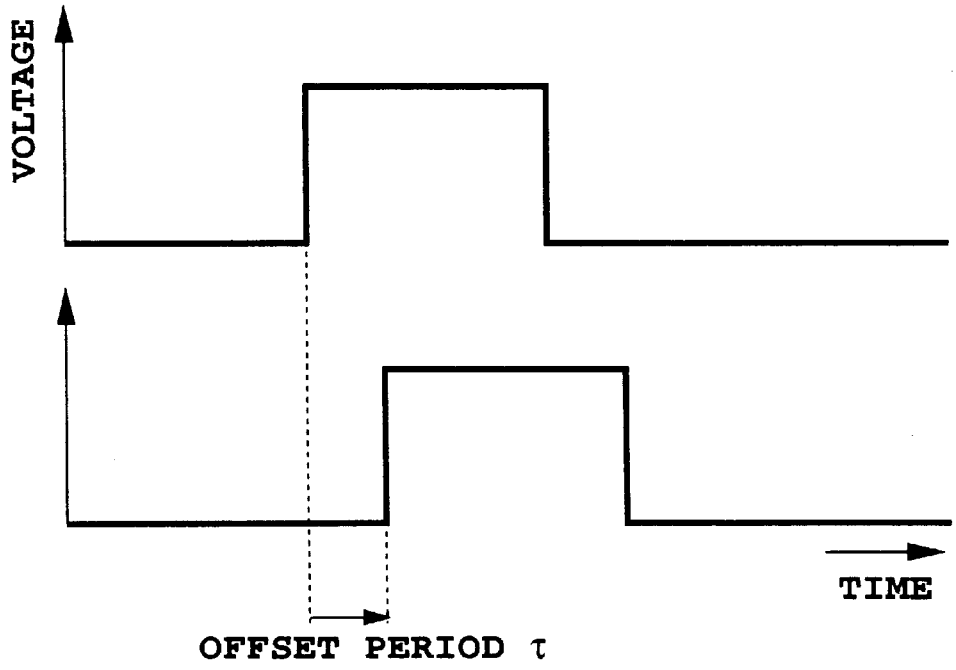
FIG. 10B is a diagrammatic illustration showing pulses to be applied with shifting timings.

FIG. 9 is a chart showing an environmental temperature dependency of the ejection amount Vd in the ink-jet head. As can be clear from FIG. 9, according to elevating of the environmental temperature TR, the ejection mount is increased. Incidentally, the environmental temperature dependency shown in FIG. 9 is shown in the case where the pulse shown in FIG. 10A is applied for the two heaters SH1 and SH2 shown in FIG. 6A or 6B. Namely, the shown example is directed to the case where the same pulse is simultaneously applied to two heaters SH1 and SH2.

Figure 11:
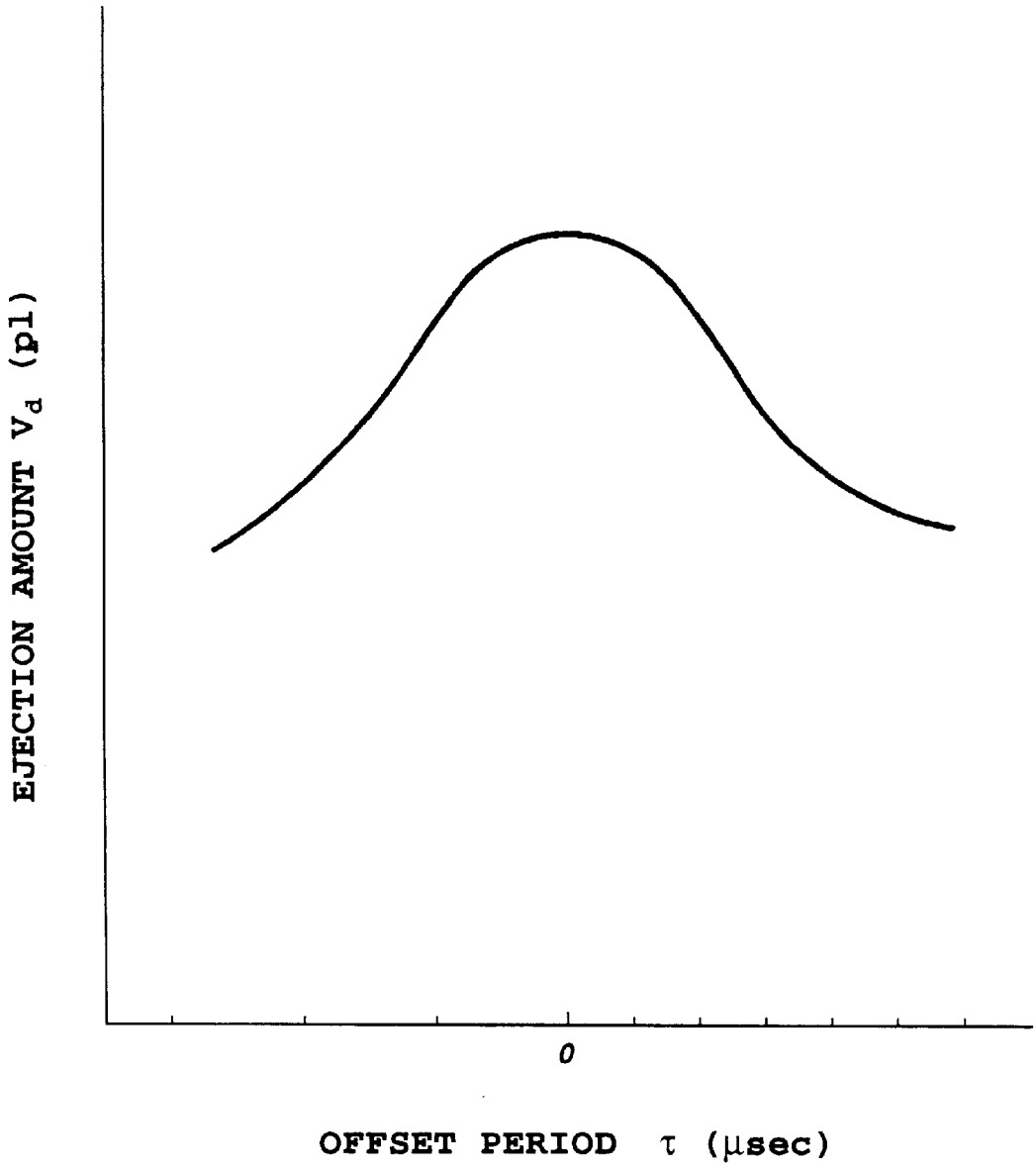
FIG. 11 is a diagrammatic illustration showing a relationship between an ink ejection amount and the shifting period.

On the other hand, the inventors have worked out the invention utilizing a fact that when two pulses are applied to respectively corresponding heaters SH1 and SH2 with a offset period, a relationship between the offset period and the ejection amount is established such that the ejection amount Vd becomes maximum when the offset period is zero, and the ejection amount Vd is decreased at greater value of the offset period either as positive value or as negative value, as shown in FIG. 11.

It is considered that this phenomenon is caused by the fact that a pressure upon bubbling of the ink on the heater and/or a maximum bubbling volume become smaller at greater offset period. In the shown embodiment, ejection amount control is performed by combination of the temperature dependency of the ejection amount set forth above and the offset period of the two pulses.

Concrete example will be discussed hereinafter.

Figure 13:
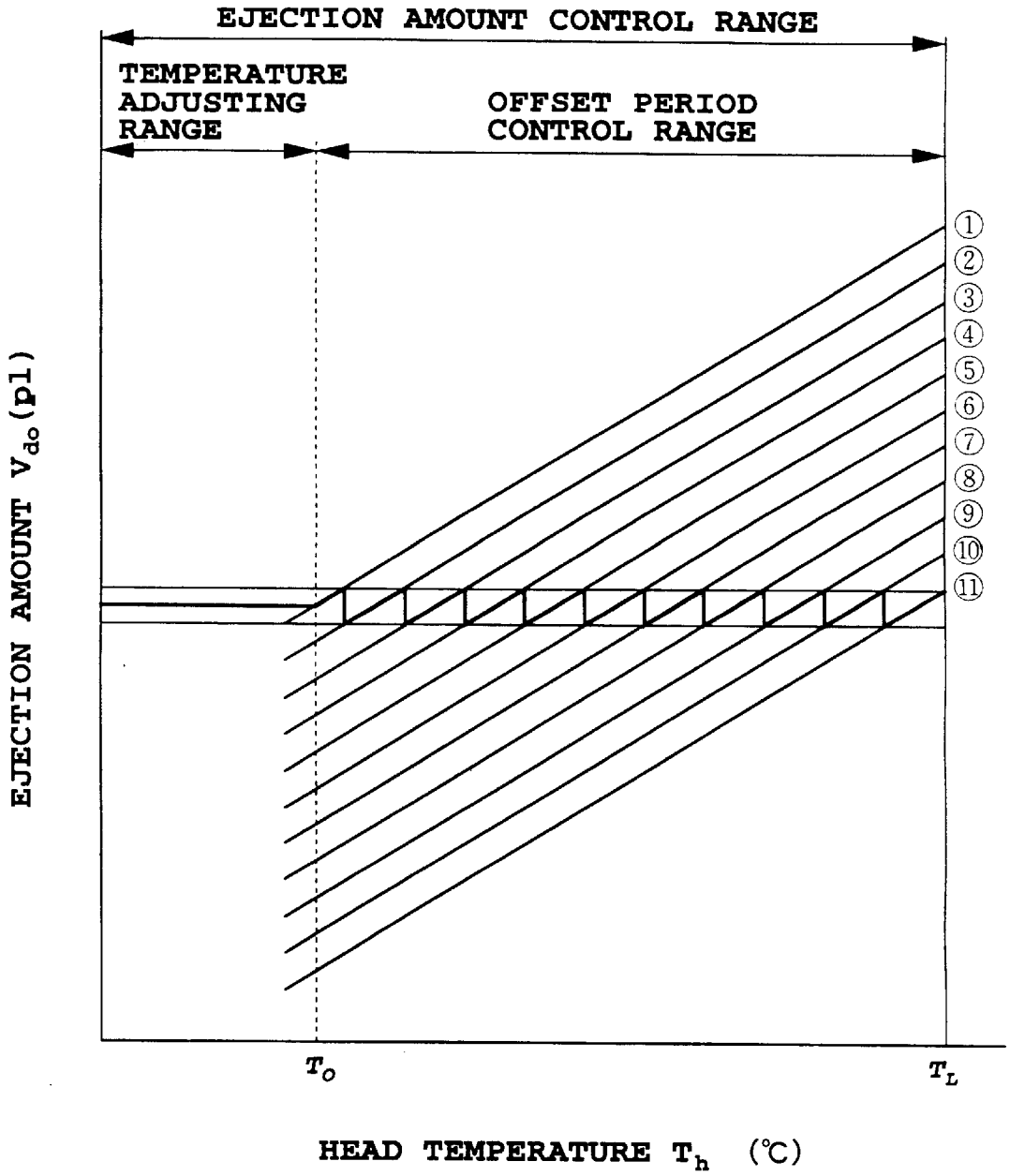
FIG. 13 is a diagrammatic illustration for explaining the manner of the second embodiment of an ejection amount control according to the invention.
Figure 14:
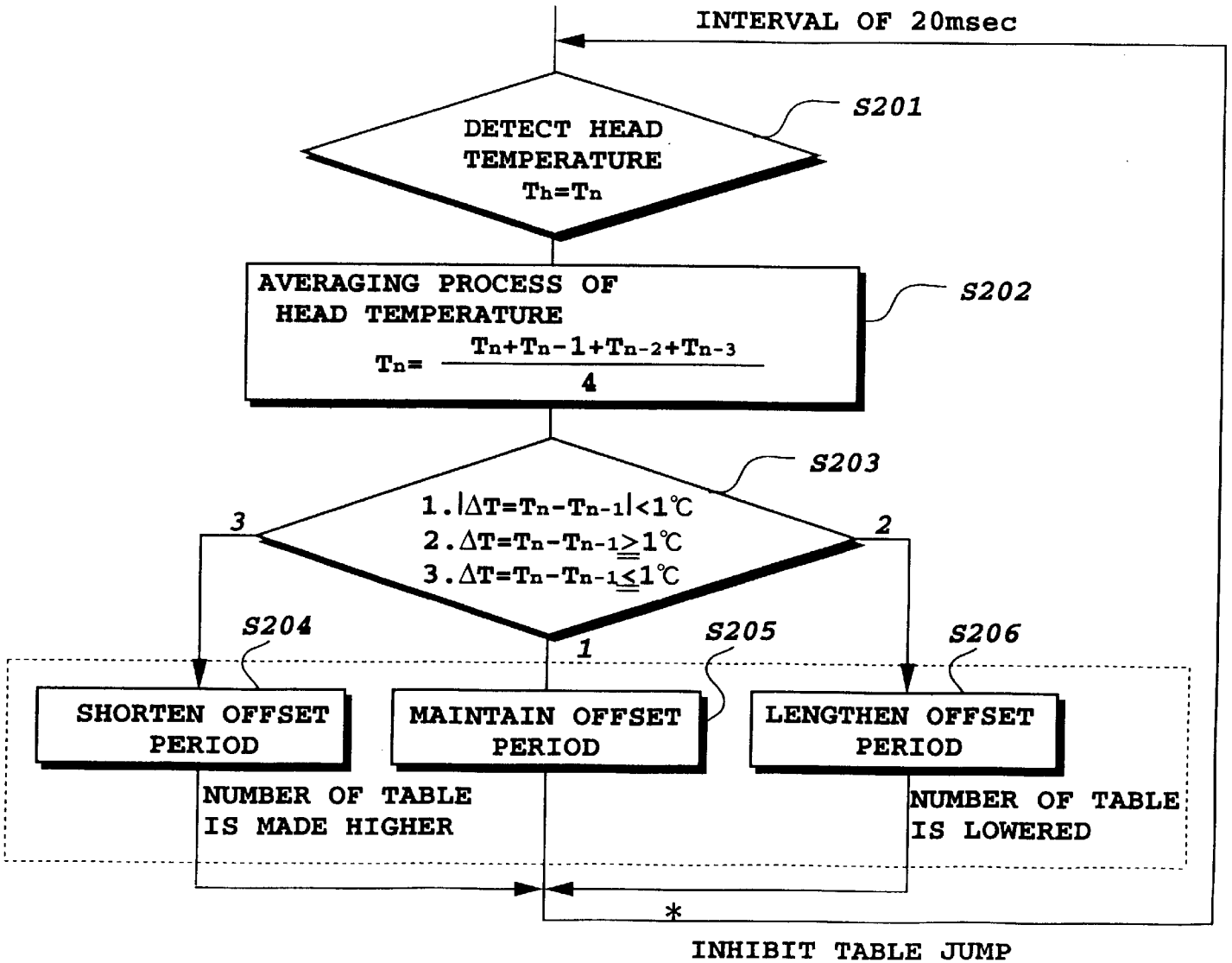
FIG. 14 is a flowchart showing a shifting control sequence in the ejection amount control.

FIG. 12 is an illustration showing a table for storing the offset period per head temperature, FIG. 13 is a chart showing a manner of ejection control employing the table, and FIG. 14 is a flowchart showing a sequence of ejection amount control of the shown embodiment.

As shown in FIG. 13, the shown embodiment or the ejection amount control is performed (1) to set the ejection amount constant without using the offset period in the ejection amount control when $Th \leqq T0$, namely, the head temperature is relative low to be lower than or equal to a predetermined temperature T0 which is set at relatively low temperature. It should be noted that by setting T0 at sufficiently small value, setting, in which temperature dependent adjustment of the ink-ejection amount is substantially not performed.

Next, (2) When $T0<Th \leqq TL$, namely, the head temperature is higher than T0 and lower than or equal to the predetermined temperature TL, ejection amount is stabilized by the ejection control by bubbling timing modulation method employing the offset period. Further, (3) when $TL<Th$, namely the head temperature is higher than TL, the offset period for the bubbling timing is fixed at the maximum value.

In the ejection amount control as shown in the condition (1), the head temperature T0 is set at 26° C., and the voltage waveform to be applied to two heaters is as shown in FIG. 10A for no offset period being used. Therefore, the size and timing become same. Accordingly, at this timing, the ejection amount becomes maximum.

In the control shown in the condition (2), the control is performed in a range of the head temperature of T0=26° C. to TL=53° C., in which the offset period is varied depending upon variation of the head temperature utilizing the table shown in FIG. 12. More specifically, here, the offset period $\tau$ is set to be greater at higher head temperature Th. That is, by increasing delay period from the charge timing of the heater to be a reference, the overall ejection amount is adjusted to be constant.

In FIG. 14 showing this sequence, for avoiding erroneous detection of the head temperature and to perform more accurate temperature detection, an average temperature is derived by averaging past three temperatures (T(n 3), T(n−2), T(n−1)) and a newly detected temperature Tn (step S201), as $Tn'=(T(n-3)+T(n-2)+T(n-1)+Tn)/4$ (step S202). In the next step, the value $Tn'=Tn-1$ and a currently measured head temperature $Th=Tn$ are compared (step 203) to derive $Tn-Tn-1=\Delta T$. At this time, 1) In the case of $|\Delta T|<1°$ C.

Since temperature variation is within 1° C. and is within the range of one table range, the offset period is not varied (step S205)

2) In the case of $\Delta T \geqq 1°$ C.

Since the temperature variation is shifted at a higher temperature side, in FIG. 12, the number of table to be used is lowered by one to make ejection period longer (step S206).

3) In the case of $\Delta T \leqq -1°$ C.

Since the temperature variation is shifted at a lower temperature side, the offset period is set to be shorter by selecting next one higher table (step S204).

As set forth above, the control is performed with varying the table in the manner set forth above. A timing to change one of the table during printing is every 20 msec so as to enable changing of table for a plurality of times during printing for one line. By this, it becomes possible to reduce or eliminate occurrence of density variation due to abrupt variation of the temperature.

By the ejection amount control in the shown embodiment, by setting the offset period directly on the basis of the head temperature, it becomes possible to maintain the ejection amount substantially constant with merely a little fluctuation with respect to a target ejection amount Vd0.

It should be noted that the ejection amount control within the temperature adjusting range shown in FIG. 13 is performed by applying a short pulse having a short pulse width not causing bubbling. However, it is also possible to perform ejection amount control by means of a sub-heater.

First Modification of Second Embodiment

FIG. 15 is an illustration showing a offset period table in the first modification of the second embodiment.

FIG. 15 While control for increasing the offset period is performed by providing delay with respect to a given timing in the second embodiment set forth above, the shown modification performs ejection amount control by advancing the offset period relative to the given timing as shown in FIG. 15. The pulse waveforms of the second embodiment and the shown modification are the same in terms of the offset period relative to the head temperature and thus to control the ejection amount at the same amount. However, the absolute charge timing in the shown modification becomes earlier than that in the second embodiment.

Second Modification of Second Embodiment

In the foregoing two embodiments, offset period $\tau=0$ is taken as the reference timing of the offset period in the table. However, as shown in FIG. 11, since the ejection amount is not significantly varied in the vicinity of the reference timing where the offset period is 0, it is not possible to stabilize the ejection amount unless the offset period is varied in greater magnitude than the given head temperature variation within this range. Therefore, by providing a predetermined value which is not zero as the initial offset period as shown in FIG. 16, it becomes possible to make variation width of the offser period constant at all of the stages in the overall range of the control. It should be noted that while a control range of the ejection amount becomes slightly narrower in this case, no significant problem will arise.

Third Embodiment of Second Embodiment

The shown modification is an example of the control for the ink-jet head having two heaters of different sizes disposed in one ink path.

Figure 17:
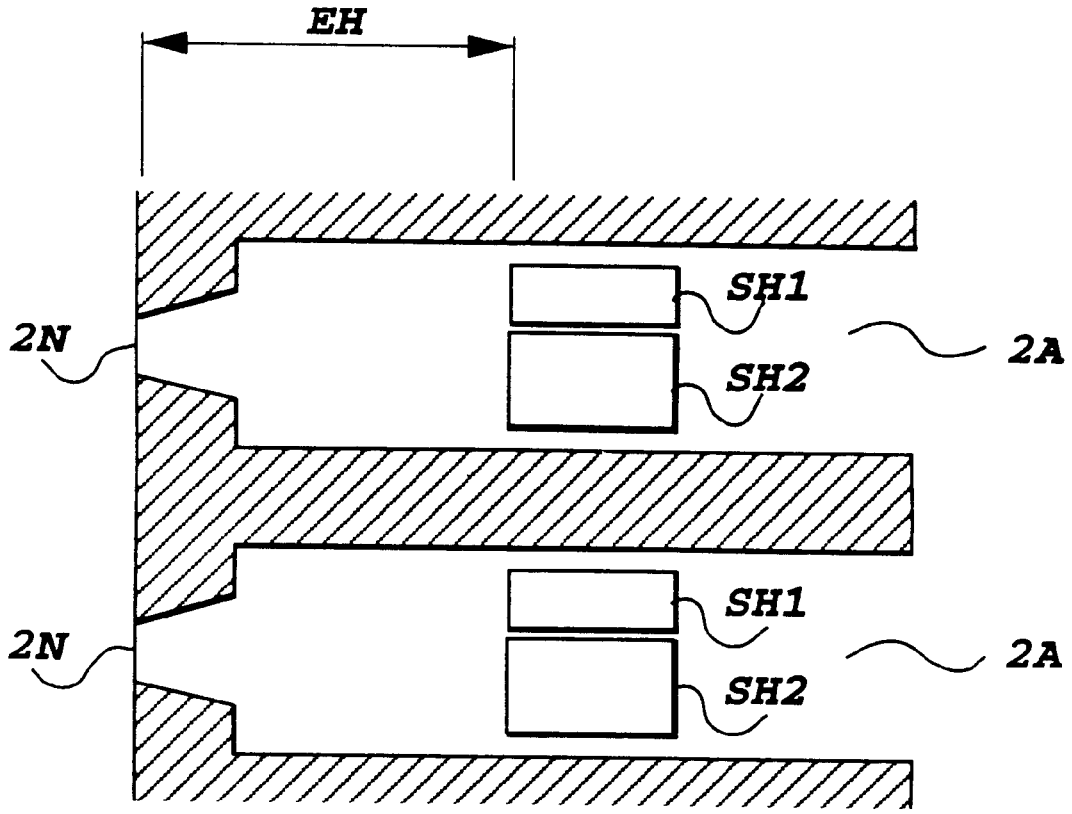
FIG. 17 is a section showing a construction of the third modification of an ink-jet head in the second embodiment.

FIG. 17 shows the ink-jet head of the shown modification. Corresponding to one ejection opening, two heaters SH1 and SH2 respectively having large and small sizes are provided. The longitudinal length of respective heaters are equal to each other. When an electric pulse of 18V in the voltage and 5 μsec. in the pulse width is applied in the longitudinal direction of the respective heaters, 15 pl/dot of ejection amount of ink droplet is ejected by the small heater and 25 pl/dot of ejection amount of ink droplet is ejected by the large heater. Also, when both of the small and large heaters are driven simultaneously, the ejection amount becomes 40 pl. Hereinafter, modes of these ejection amounts are respectively referred to as a small ejection amount mode, a medium ejection amount mode and a large ejection amount mode.

Figure 18:
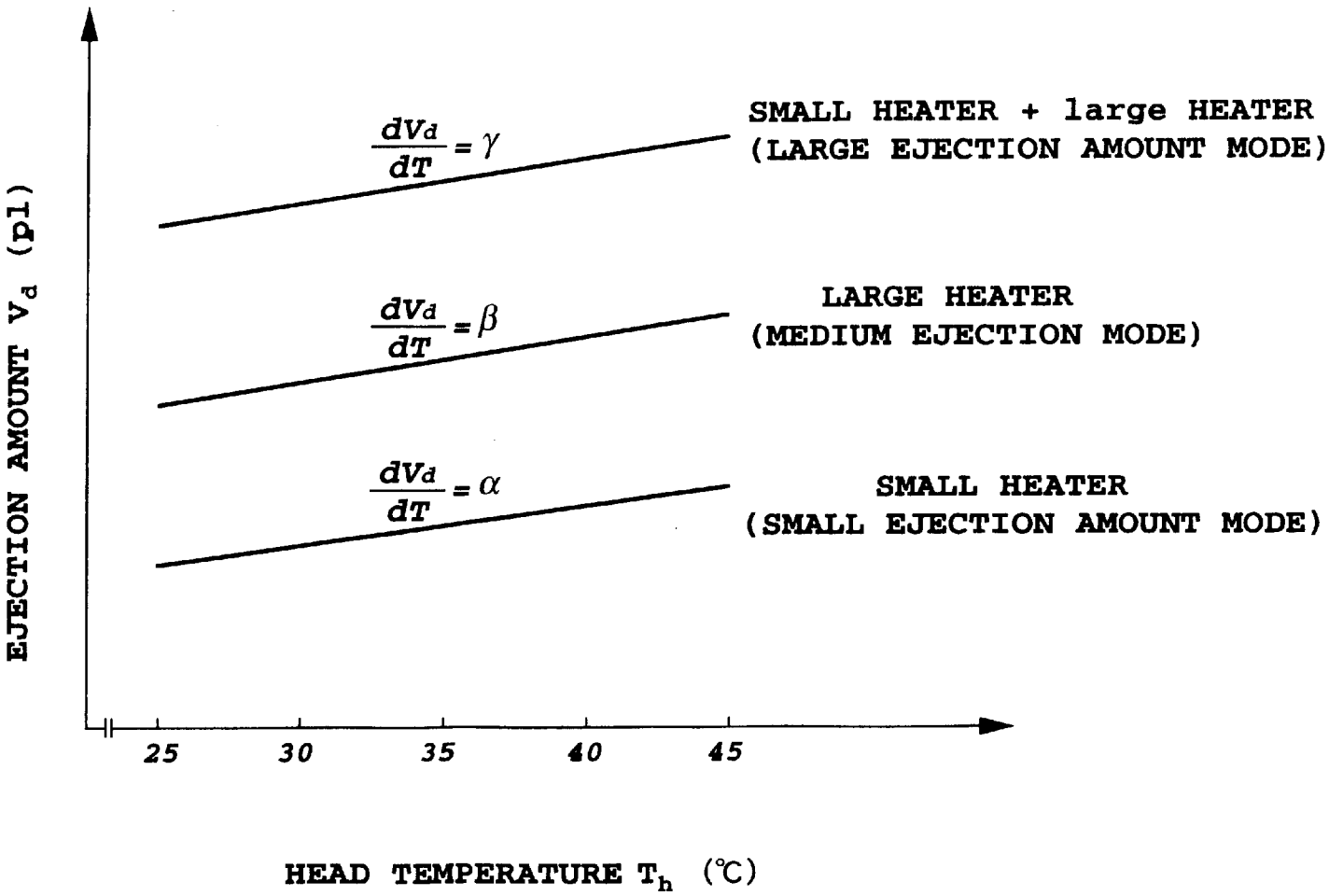
FIG. 18 is a diagrammatic illustration showing a head temperature dependency of the ink ejection amount for each ejection mode in the third modification.

When ink droplet is ejected in respective ejection amount modes, the ejection amount is increased depending upon elevating of the temperature of the ink-jet head as shown in FIG. 18, respectively. Accordingly, even in this case, in each ejection amount mode, the ink-jet head temperature is varied depending upon variation of the environmental temperature, self-heating and so forth to cause variation of the ejection amount. When variation of the ejection amount is caused, density and color taste of a printed image may be varied or fluctuation of density may be caused to cause degradation of the printed image quality.

Figure 19:
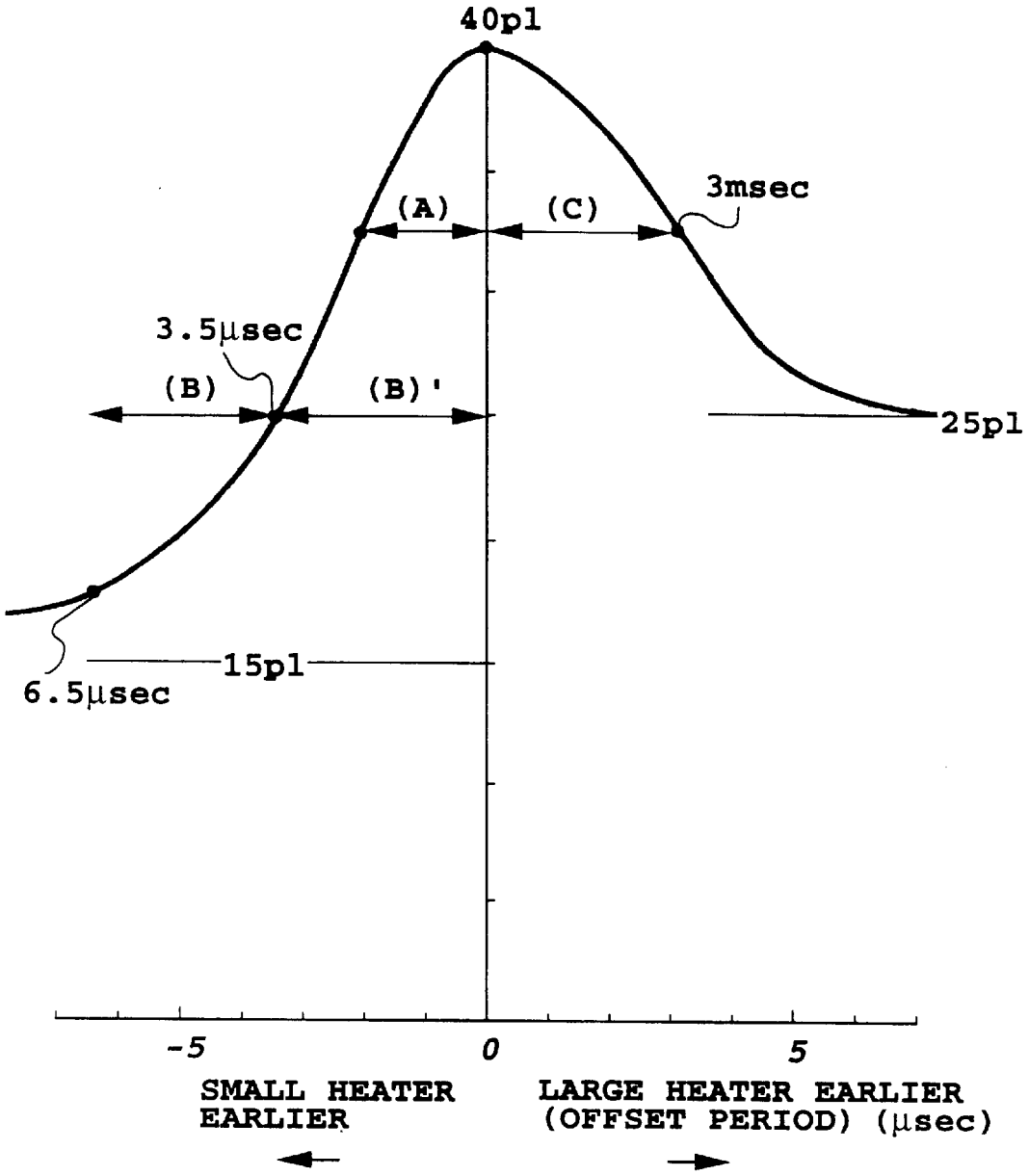
FIG. 19 is a diagrammatic illustration showing the relationship between the shifting period and the ejection amount in the third modification.

On the other hand, by shifting the bubbling timing by offsetting charge timing of the pulse between the large heater and the small heater, the ejection amount becomes maximum at the same charge timing, as shown in FIG. 19. This is basically the same as the foregoing embodiments. However, observing the range of ±10 μsec. relative to the simultaneous charge timing, if the bubbling timing of the small heater is made relatively earlier, the ejection amount becomes comparable with that when only small heater is driven. Conversely, when the bubbling timing of the large heater is made relatively earlier, the ejection amount becomes comparable with that when only large heater is driven.

Using these results, an example of the control for stabilizing the ejection amount in the case where the head temperature is varied in the large ejection amount mode and the medium ejection amount mode of respective ejection amount of 40 pl/dot and 25 pl/dot, will be discussed hereinafter.

It should be noted that in the foregoing discussion, when the pulse charge timings are the same, the timing of the bubbling is discussed as the same timing. However, when the sizes of the heaters are differentiated, it is not always possible to make the bubbling timing the same by making the pulse charge timings the same, in the strict sense.

(Large Ejection Amount Mode)

At first, in case of the large ejection amount mode, i.e. when the ejection amount is 40 pl/dot, similarly to the foregoing second embodiment, up to 26° C. of the ink-jet head temperature, temperature control is performed by a sub-heater, and the large heater and the small heater are driven at the same timing.

Figure 20A:
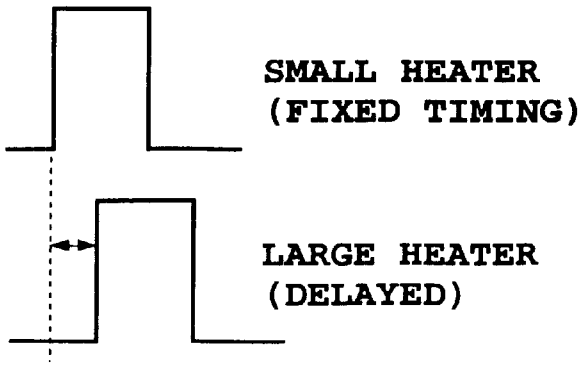
FIGS. 20A and 20B are illustrations showing shifting period tables in the third modification.

At the ink-jet head temperature higher than or equal to 26° C., delay of charge timing for the large heater is progressively increased according to elevation of the ink-jet heat temperature. By this, the ejection amount can be stabilized at 40 pl. It should be noted that range (A) of the offset period shown in FIG. 20A is the range shown in FIG. 19.

(Medium Ejection Amount Mode)

Next, discussion will be given for the medium ejection amount mode of 25 pl/dot.

Similarly to the large ejection amount mode, while the ink-jet head temperature is lower than 26° C., temperature adjustment is performed for the ink-jet heater, and the pulse charge timing of the large heater is delayed for 3.5 sec. relative to the pulse charge timing for the small heater.

Figure 20B:
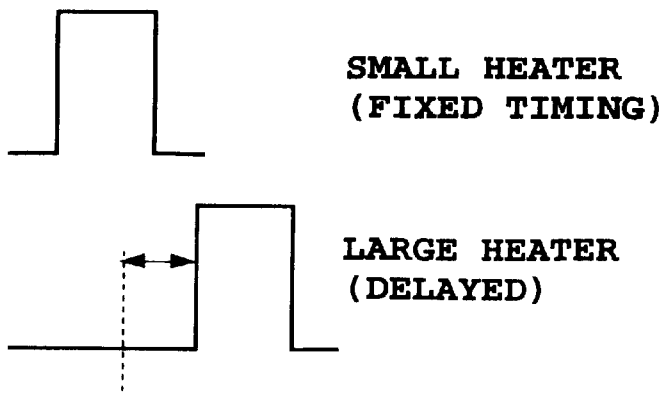

On the other hand, while the ink-jet head temperature is higher than or equal to 26° C., the charge timing of the large heater is further delayed according to elevation of the head temperature as shown in FIG. 20B. By this, the ejection amount can be stabilized at 25 pl. It should be noted that the range of offset period is the range (B) shown in FIG. 19.

While the ejection amount is maintained at 25 pl by the head temperature adjustment in the range where the head temperature is lower than 26° C. in the above mentioned medium ejection mode, it may be possible to control the charge timing of the large heater to reduce the delay time according to lowering of the temperature, namely to reduce the charge timing offset between the small heater and the large heater according to lowering of the head temperature. In this case, when the charge timing offset becomes zero, further ejection amount control becomes impossible. In such case, temperature adjustment for the ink-jet head becomes necessary. However, in practice, since the temperature at such timing will become lower than or equal to 0° C., no substantial affect may be expected. The range of the offset timing is in the range (B) shown in FIG. 19.

It should be noted that while the shown modification controls the ejection amount by delaying the pulse charging timing for the large heater relative to the pulse charge timing for the small heater, what is only important is the relative offset of the pulse charge timings between the large heater and the small heater. Therefore, equivalent control or the ejection amount can be done by delaying the pulse charge timing for the small heater relative to the pulse charge timing of the large heater.

Fourth Modification of Second Embodiment

Figure 21A:
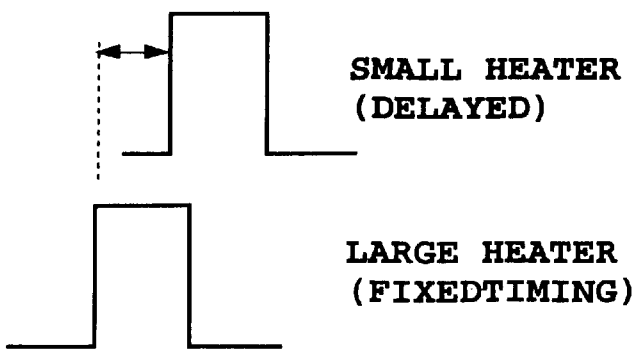
FIGS. 21A and 21B are illustrations showing shifting period tables in the fourth modification of the second embodiment.
Figure 21B:
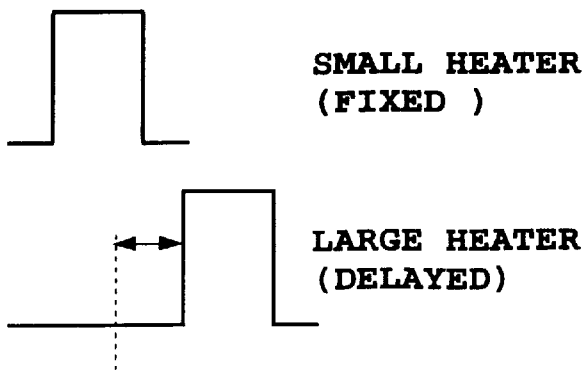

The shown modification basically has the large ejection amount mode and the medium ejection amount mode respective of 40 pl and 25 pl similarly to the foregoing third modification. In the medium ejection amount mode, similar control to the third modification, namely, to delay the driving timing of the large heater with fixing the driving timing of the small heater, is performed. On the other hand, in case of the large ejection amount mode, the driving timing of the large heater is fixed and the driving timing of the small heater is delayed. Control tables for this are shown in FIGS. 21A and 21B.

The range of shifting of the timing in the large ejection amount mode is the range (C) shown in FIG. 19.

Figure 22:
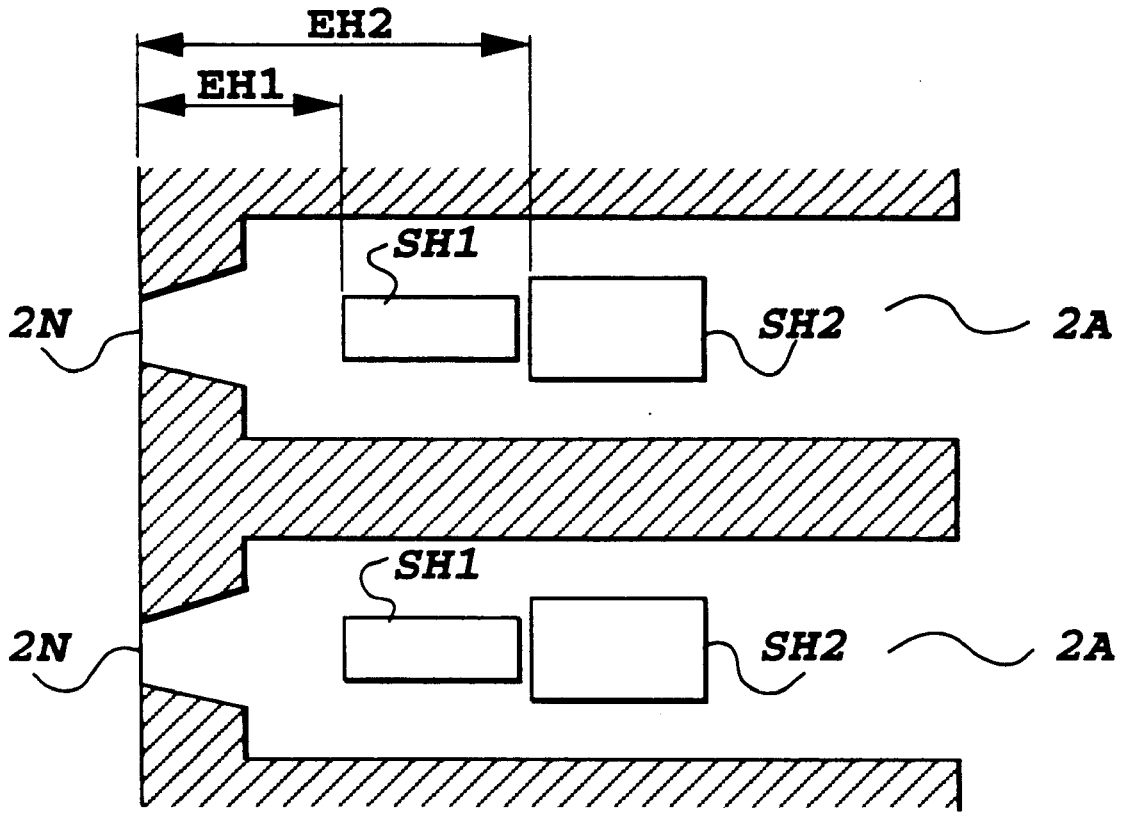
FIG. 22 is a section showing a construction of another modification of the ink-jet head in the second embodiment.
Figure 23:
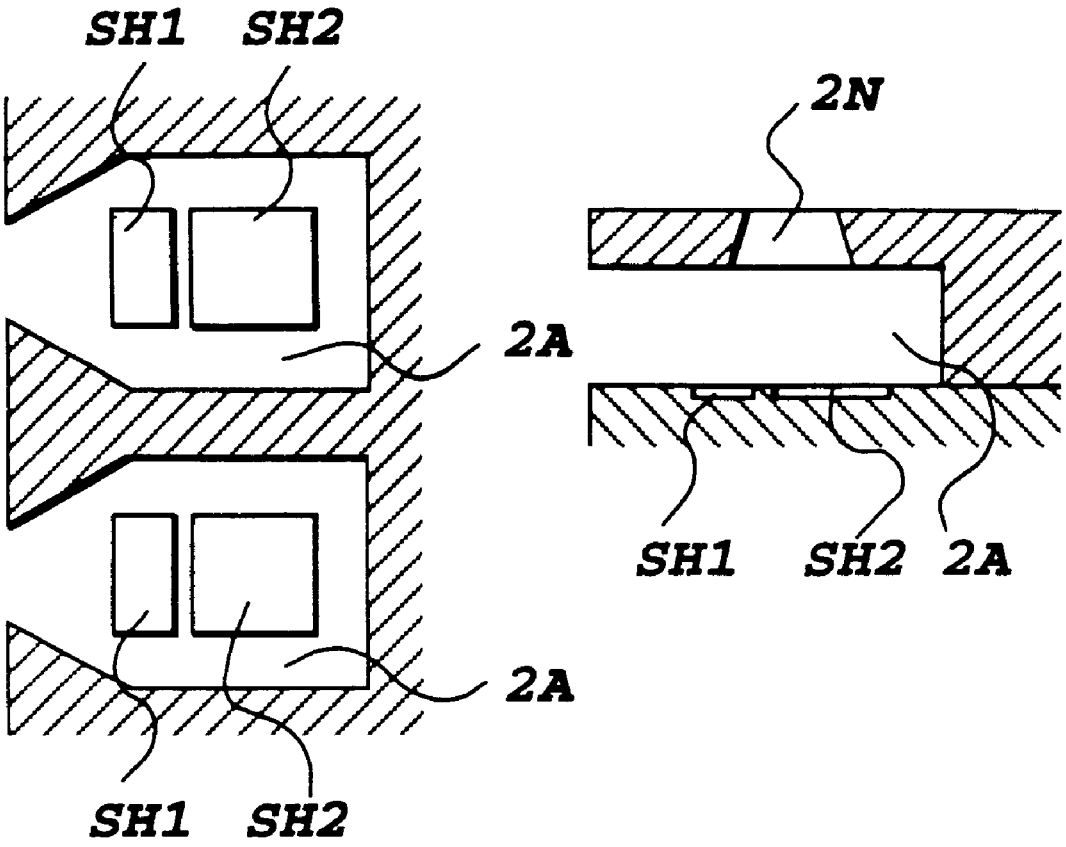
FIG. 23 is a section showing a construction of a further modification of the ink-jet head in the second embodiment.

While an example of the head in a form where a plurality of heaters of mutually different sizes are arranged in parallel relative to the ejection opening in the third and fourth modifications, similar control can be performed even in the case where the heaters are aligned along the ink path as shown in FIG. 22. In the further alternative, similar ejection amount control is applicable for the head of the type where the ink is ejected in the direction perpendicular to the heater surface, as shown in FIG. 23.

It should be noted that while the respective embodiments set forth above perform the stabilizing control of the ejection amount on the basis of the head temperature and environmental temperature by detecting such temperature, the information relating to the ink temperature is not limited to those in the former embodiment. For instance, the ink temperature indicative information may be a predicted temperature arithmetically obtained on the basis of driving amount, such as number of times of ejection and so forth.

Further, while discussion has been given for the same where two heaters are provided in one ink path, the application of the present invention should not be limited to the shown construction. For instance, the present invention is applicable for the case where three or more heaters are provided in the ink path.

Third Embodiment

In the shown embodiment, three basic ejection amount modes are established for each ejection opening basically by combining two heaters employed in the ink-jet head construction illustrated in FIG. 17, in similar manner of combination as discussed in the first embodiment.

The basic ejection amount modes in the shown embodiment are set to be three ejection amount modes of small, medium and large by switching the heaters to be driven, basically. In the small ejection amount mode, only heater SH1 is driven to eject the ink droplet in the volume of 15 pl, in the medium ejection amount mode, only heater SH2 is driven for ejecting ink droplet in the volume of 25 pl, and in the large ejection amount mode, both of the heaters SH1 and SH2 are driven simultaneously to eject the ink droplet in the volume of 40 pl (=15+25 pl).

Next, discussion will be given for ejection amount stabilizing control in the shown embodiment in the construction set forth above.

The shown embodiment has been worked out in view of the temperature dependency of the ejection amount set out with reference to FIG. 18. Namely, the driving condition representative of the temperature dependency of the ejection amount in respective ejection amount modes is the case where a rectangular pulse having voltage of 18V and pulse width of 5 $\mu$sec are applied to respective heaters SH1 and SH2. As shown in FIG. 18, the ejection amount is increased according to elevating of the head temperature. In the shown range, head temperature dependent variation of the ejection amount is substantially linear. The variation ratios of the ejection amount Vd relative to the temperature T of the ink-jet head are assumed as $\alpha$ in the small ejection amount mode, $\beta$ in the medium ejection amount mode and $\gamma$ in the large ejection amount mode.

Figure 24A:
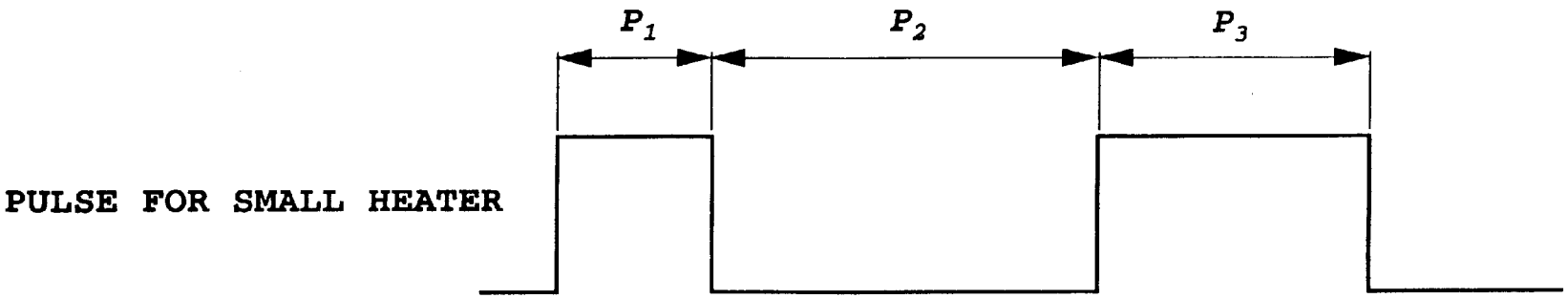
FIGS. 24A and 24B are diagrammatic illustrations showing waveforms of pre-pulses to be employed in the third embodiment of the invention.
Figure 24B:
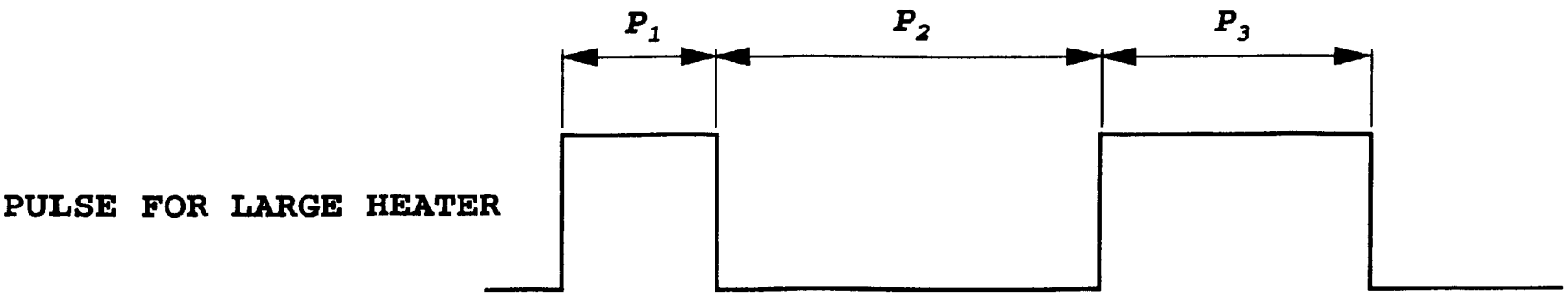

On the other hand, under constant environmental temperature, the drive pulse consisted of two pulses (hereinafter also referred to as "double pulse" shown in FIGS. 24A and 24B are applied. Variation of the ejection amount when the pulse width P1 of the pre-pulse varies is shown in FIG. 25.

In the double pulse shown in FIGS. 24A and 24B, P1 shows the pulse width of the pre-heat pulse. By the pre-heat pulse, heating is performed such that the ink in the vicinity of the heater is heated but bubbling is not caused. Subsequently, through resting interval P2, the main-heat pulse having the pulse width P3 is applied to cause bubbling in the ink to cause ejection of the ink.

Figure 25:
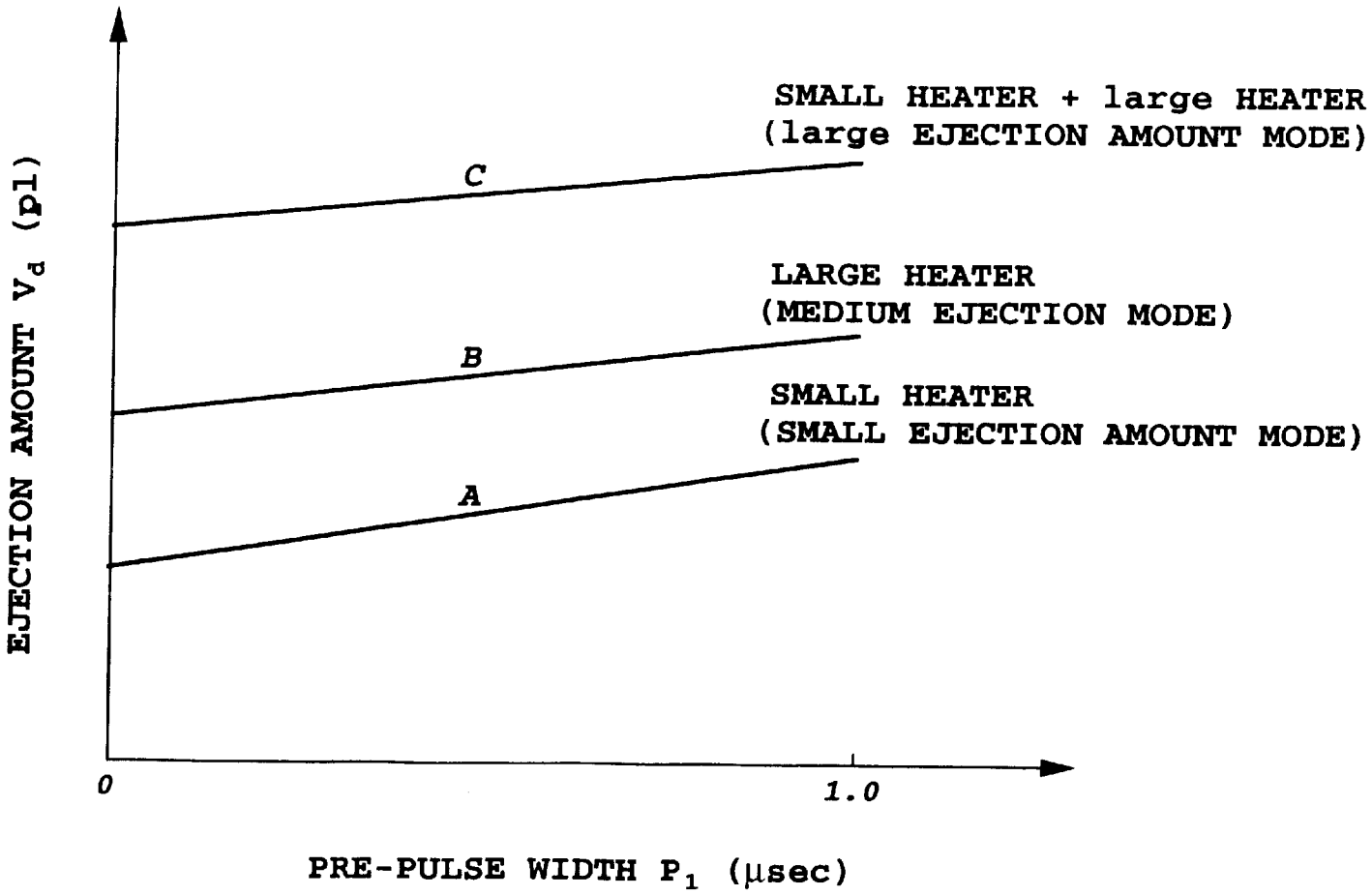
FIG. 25 is a diagrammatic illustration showing a relationship between pre-pulse widths and the ejection amount for each ink ejection mode in the third embodiment.

In the case of such double pulse driving, when the pre-heating pulse shown in FIG. 25 is made larger, the ejection amount is increased in the constant ratio at any ejection amount mode, substantially.

Figure 26:
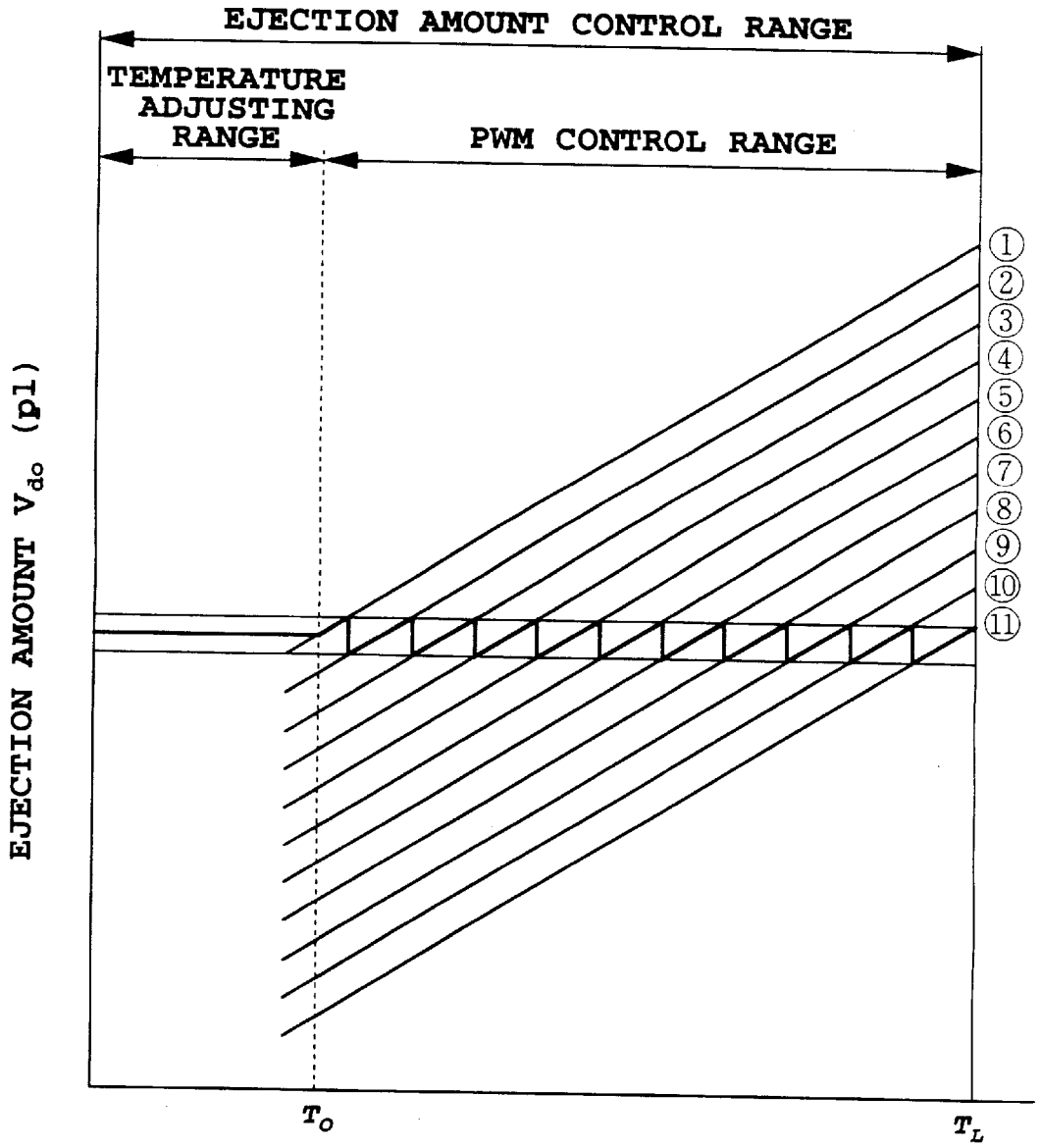
FIG. 26 is a diagrammatic illustration showing a manner of ejection amount control in the third embodiment.

Accordingly, utilizing the relationship shown in FIG. 25 and the relationship shown in FIG. 18, the ejection amount can be controlled at the given value irrespective of variation of the head temperature, as shown in FIG. 26 by varying the pre-heat pulse width P1 depending upon the head temperature. Namely, when the head temperature becomes higher, the pulse width P1 of the pre-heating pulse is controlled to be smaller.

Figure 27:
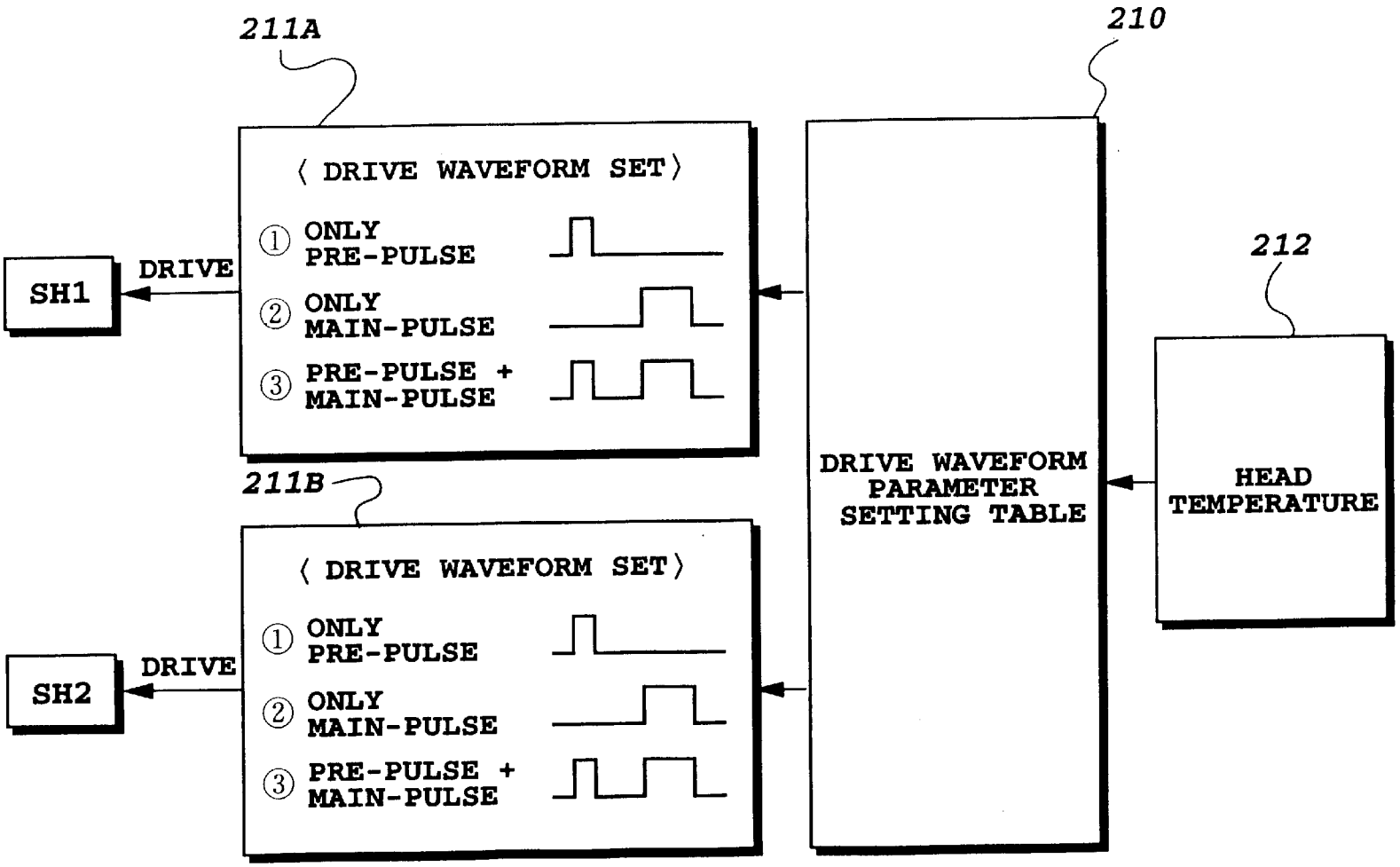
FIG. 27 is a block diagram showing another construction of heater driving in the third embodiment.

FIG. 27 is a block diagram showing one example of the basic construction of the ejection amount control.

In FIG. 27, with reference to a drive waveform parameter setting table 210 on the basis of the head temperature from a head temperature detecting portion 212 including temperature sensors 20A and 20B (see FIG. 2), the parameters, such as the pre-heat pulse, the pulse waveform, the resting interval and pulse width of the main-pulse waveform, are output to driving waveform setting portions 211A and 211B.

In the driving waveform setting portions 211A and 211B, one of three waveforms identified by ① to ① respectively corresponding to the heaters SH1 and SH2 is selected depending upon the input ejection amount mode. In conjunction therewith, the parameters, such as input pulse width and so forth is set. In the waveform selection from waveforms ① to ③ for the heaters SH1 and SH2 depending upon the ejection amount mode, since the main drive pulses are applied to both of the heaters SH1 and SH2 in the large ejection amount mode, ② or ③ may be selected. However, the waveform ③ including at least the pre-heat pulse has to be selected corresponding to eighter heaters.

However, since the temperature dependency of the ejection amount is differentiated for each ejection amount mode as discussed with respect to FIG. 25, it is more desirable to provide the parameter setting table for each ejection mode.

Figure 28:
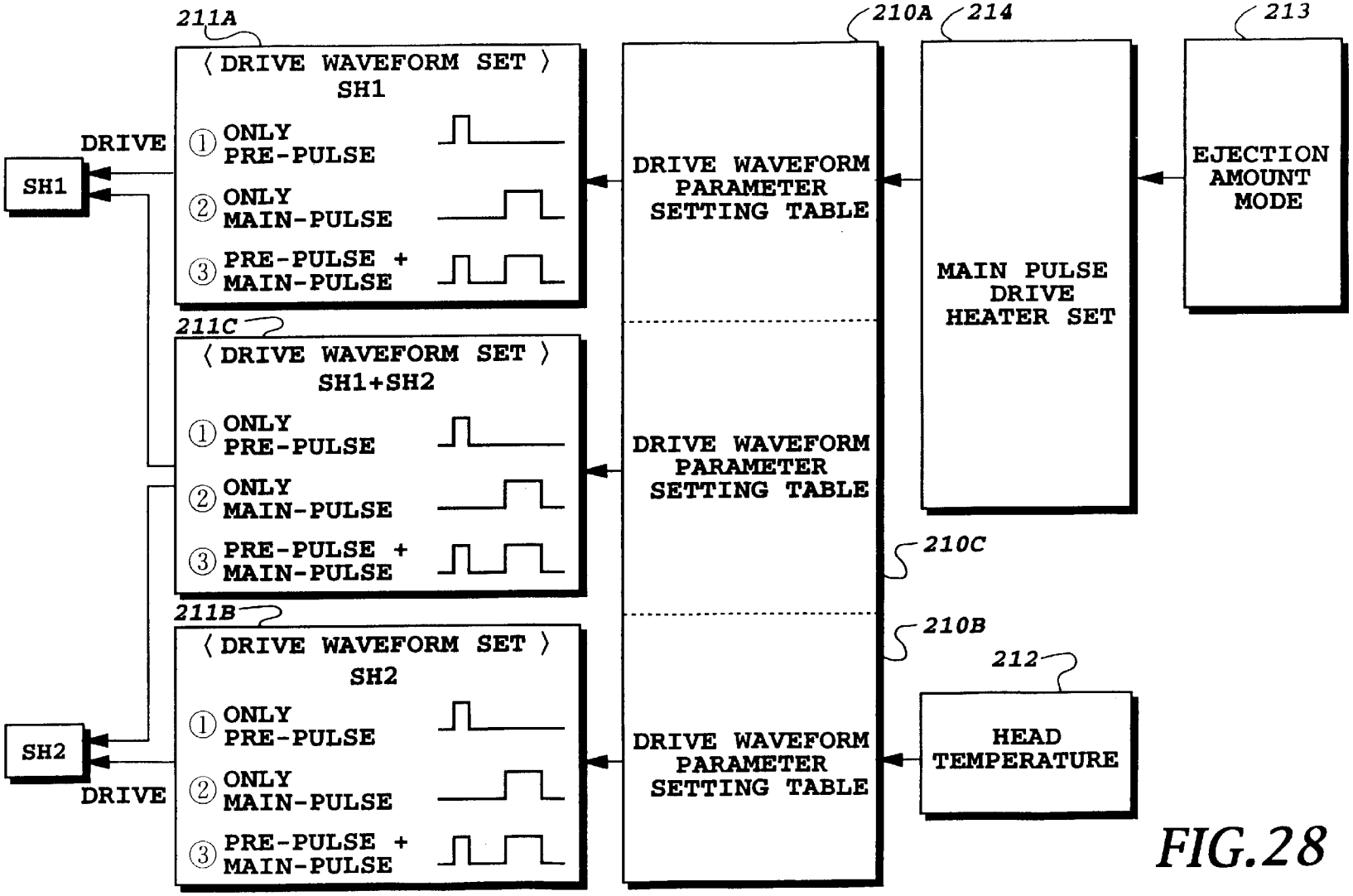
FIG. 28 is a block diagram showing a further construction of heater driving in the third embodiment.

FIG. 28 is a block diagram showing a construction enabling setting of the parameter for each ejection amount mode. FIG. 29 is a conceptual illustration showing a table for setting respective driven heater depending upon the ejection mode in the construction shown in FIG. 28.

In FIGS. 28 and 29, depending upon ejection mode from an ejection amount mode information holding portion 213, a main-pulse driven heater setting portion 214 sets the heater or combination of the heaters to be driven, e.g. heater SH1, heater SH2, or heaters SH1 and SH2. In the drive waveform parameter setting table, one of the tables 210A, 210B or 210C corresponding to the main-pulse driven heaters set by the main-pulse driven heater setting portion 214, is selected. In conjunction therewith, on the basis of head temperature information, the drive waveform parameter is output from the selected table.

The combination of the pre-heat pulse driven heater shown for each ejection amount mode in FIG. 29, shows an example of that selected corresponding to the selected main-pulse driven heater, and will be discussed with respect to respective embodiment discussed later.

Figure 31A:
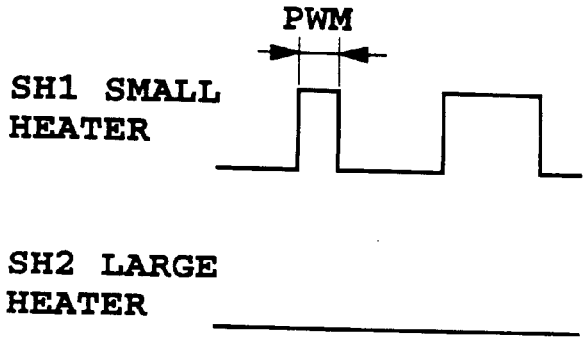
FIGS. 31A, 31B and 31C are illustrations of waveforms of drive pulses in the third embodiment.
Figure 31B:
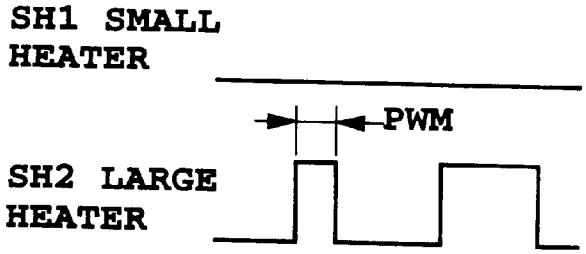
Figure 31C:
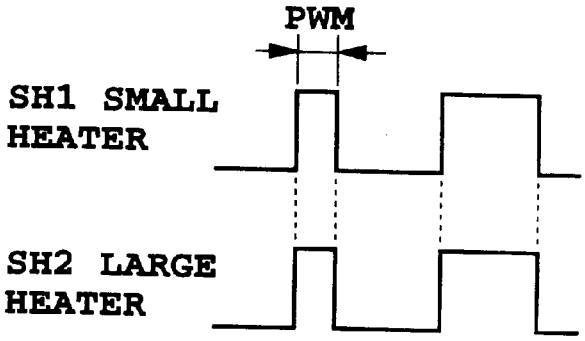

FIGS. 30A, 30B and 30C are illustrations showing a pre-pulse width setting table in the drive waveform parameter setting tables 210A, 210B and 210C (see FIG. 28). Also, FIGS. 31A, 31B and 31C are illustrations showing waveforms of the heater driving pulse set by the main-pulse driven heater setting portion 214 and the setting tables 210A, 210B and 210C set forth above.

As can be clear from these drawings, in the shown embodiment, the heater SH1 as a smaller heater is employed in the small ejection amount mode, the heater SH2 as a larger heater is employed in the medium ejection amount mode, and both of the heaters SH1 and SH2 are employed in the large ejection amount mode. Control for the pre-pulse width P1 depending upon the head temperature is also performed with respect to the heaters which performs main heating (heater driving for generating bubble).

Furthermore, as shown in FIGS. 30A to 30C, control of the pre-pulse width P1 depending upon the head is to shorten the pulse width P1 according to elevating of the head temperature. Here, in the medium ejection amount mode, pre-heating is not performed when the head temperature is higher than or equal to 44° C.

Through the control of the pre-pulse width set forth above, the ejection amount VdO for each ejection amount mode in the range of PWM control shown in FIG. 26 (15 pl in the small ejection amount mode, 25 pl in the medium ejection amount mode and 40 pl in the large ejection amount mode) can be maintained at substantially constant amount. It should be noted that, at the head temperature lower than or equal to 26° C. (T0 shown in FIG. 26) in the shown embodiment, the head temperature is controlled by means of the temperature adjusting heater provided in the ink-jet head for stability of the ejection amount Vd.

First Modification of Third Embodiment

Figure 33A:
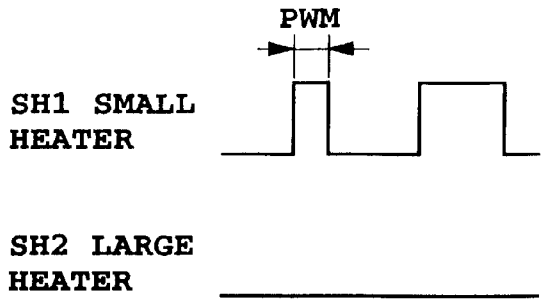
FIGS. 33A, 33B and 33C are illustrations of waveforms of the drive pulses in the modification of the third embodiment.
Figure 33B:
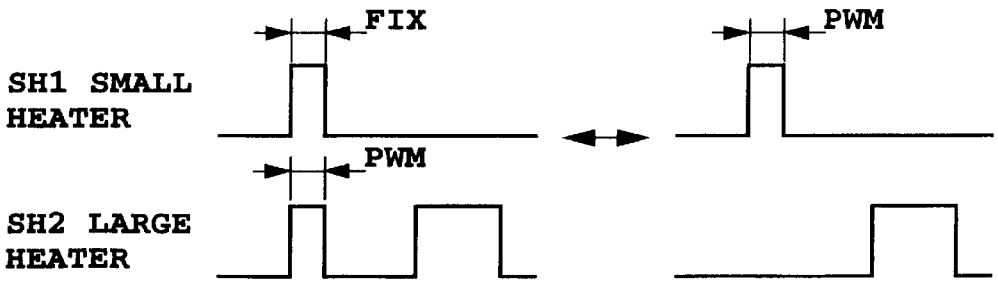
Figure 33C:
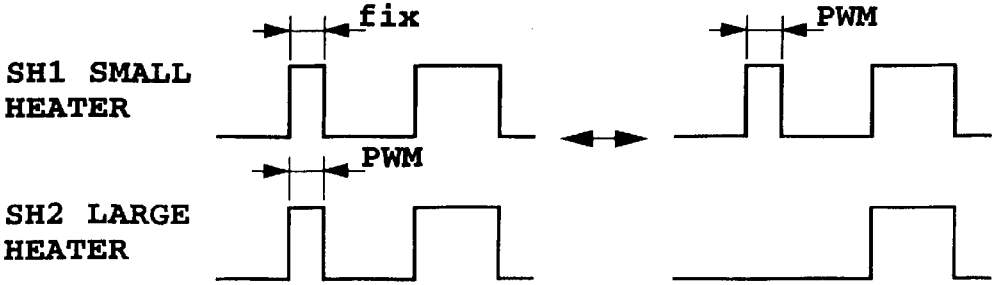

FIGS. 32A, 32B and 32C show tables of pre-pulse width P1 in the first modification of the third embodiment. FIG. 33A to 33C are illustrations showing drive pulse waveforms. As shown in these figures, the point differentiated from the above-mentioned third embodiment is the pre-pulse width control in the medium ejection amount mode and the large ejection amount mode.

More specifically, in the medium ejection amount mode in the shown modification, the pre-pulse is applied not only to the large heater SH2 but also to the small hater SH1. Here, with a temperature range of 26° C. to 46° C., the pre-pulse width P1 of the small heater SH1 is fixed (1 $\mu$sec), and the pre-pulse width P1 of the large heater is controlled to be shorter according to elevating of the head temperature. Also, in the temperature range higher than or equal to 46° C., the pre-pulse width P1 is set to be zero, and the pre-pulse width P1 of the small heater is controlled to be shortened according to further rising of the head temperature.

In the medium ejection amount mode, despite the fact that the main (heating) pulse is applied only to the large heater SH2, pre-pulse is applied to both of the small and large heaters for driving. Thus, the temperature range for ejection amount stabilizing control can be widened. By this, the ejection amount in the medium ejection amount mode becomes 28 pl and thus can be slightly greater than the 25 pl in the former embodiment.

In addition, in the large ejection amount mode, both of the small heater SH1 and the large heater SH2 are employed. However, control of the pre-pulse width is performed in the similar manner to the medium ejection amount mode as set forth above.

Second Modification of Third Embodiment

Figures 36A, 36B, 36C:
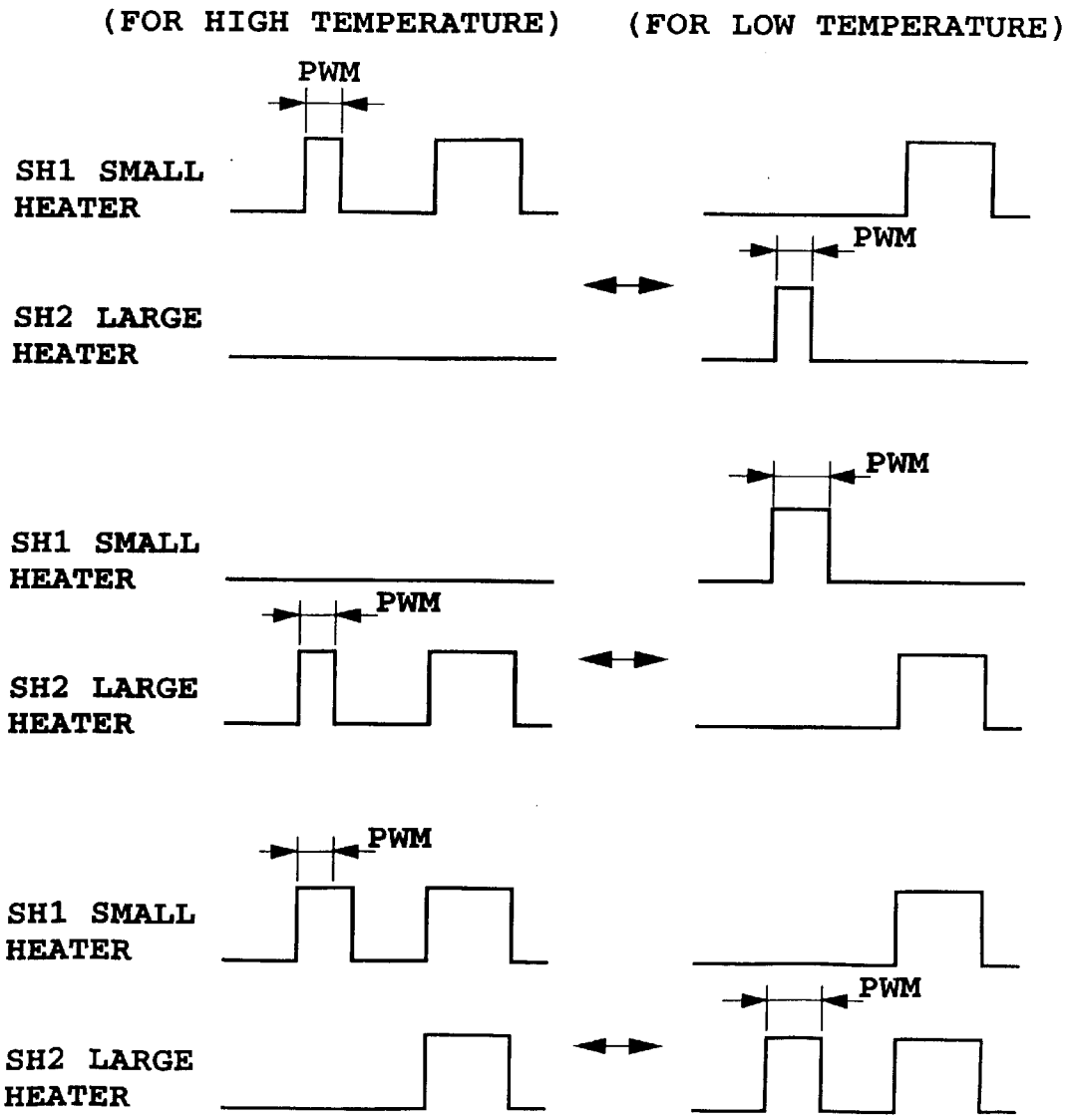
FIGS. 36A, 36B and 36C are illustrations of waveforms of the drive pulses in the second modification of the third embodiment.

FIGS. 34A, 34B and 35A, 35B are illustrations showing tables of pre-pulse widths P1 in the second modification of the third embodiment, and FIGS. 36A to 36C are waveforms showing drive pulses in the shown modification.

The shown modification is adapted to switch the table of the pre-pulse to the table for low temperature or the table for high temperature depending upon the head temperature upon initiation of printing. For this purpose, the shown modification includes tables for low temperature and high temperature for respective ejection amount modes. FIGS. 34A and 34B show tables for low temperature in the small ejection amount mode and the medium ejection amount mode, respectively. On the other hand, the tables for high temperature in these modes are similar to those illustrated in FIGS. 30A to 30B. Further, FIGS. 35A and 35B respectively show the table for low temperature and the table for high temperature in the large ejection amount mode.

As can be appreciated from these drawings and from FIGS. 36A to 36C, the pre-heat pulse is applied to the large heater in the low temperature mode, and to the small heater in the high temperature mode.

In the shown modification, pre-heating is performed to the heater different from the heater to which the main-heating pulse is applied, in the low temperature mode, even when bubbling is caused by driving the heater with slightly greater width of the pulse in pre-heating, and if the amount of bubbling is quite small, substantially no affect will be given for bubbling in response to application of the main pulse.

In addition, by performing pre-heating by different heater, it becomes not significant to consider influence of bubbling during pre-heating as set forth above. Therefore, the resting interval between the pre-pulse and the main-pulse can be shortened. Furthermore, by providing the low temperature mode, the temperature adjusting means for the head becomes substantially unnecessary.

In addition, in the shown modification, by providing two tables in overlapping manner with respect to the head temperature, it becomes unnecessary to switch the heater to apply the pre-pulse at least in the currently printed page. Therefore, occurrence of joining banding in the image caused by difference of density which can be caused by switching of the heater can be successfully avoided.

Third Modification of Third Embodiment

Figure 38A:
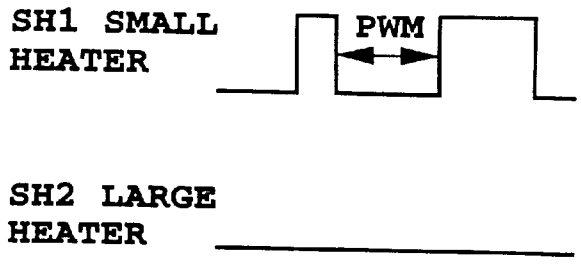
FIGS. 38A, 38B and 38C are illustrations of waveforms of the drive pulses in the third modification of the third embodiment.
Figure 38B:
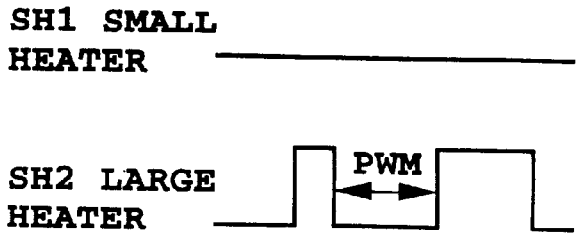
Figure 38C:
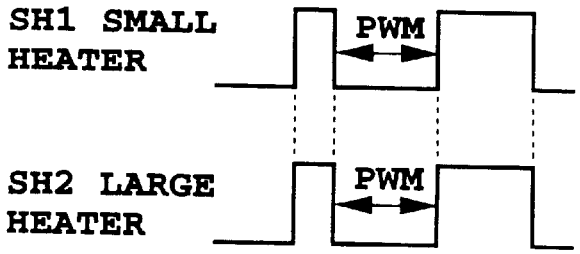

FIGS. 37A to 37C are illustrations showing an off time (resting interval) table of respective ejection amount modes in the third modification of the third embodiment, and FIGS. 38A to 38C are illustrations showing waveforms of drive pulse.

In the shown modification, as can be clear from FIGS. 37A to 37C and 38A to 38C, similarly to the foregoing third embodiment, the small heater SH1 is employed in the small ejection amount mode, the large heater SH2 is employed in the medium ejection amount mode, and the small and large heaters SH1 and SH2 are employed in the large ejection amount mode.

However, different from the third embodiment, in the shown modification, stabilization of the ejection amount is performed by controlling the off time P2. More specifically, the off time P2 is varied with fixing the pre-pulse width P1 utilizing the fact that the longer P2 results in greater ejection amount. In concrete, according to elevating of the head temperature, P2 is decreased to be shorter and the P2 is increased to be longer according to lowering of the head temperature.

Similarly to controlling the pulse width, since the ejection amount depends on the off time P2 and on the head temperature in different manner in respective ejection amount modes, the ejection amount can be stabilized in each ejection amount mode by setting the off time P2 corresponding to respective ejection amount modes.

Fourth Modification of Third Embodiment

Figure 40A:
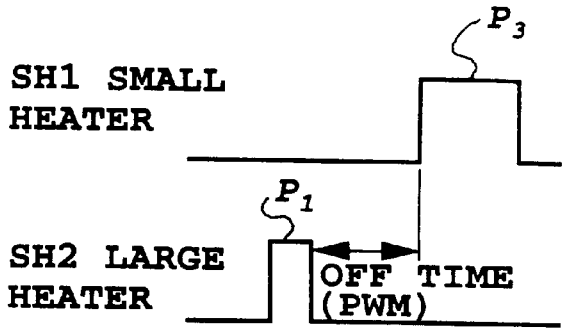
FIGS. 40A, 40B and 40C are illustrations of waveforms of the drive pulses in the modification of the third embodiment.
Figure 40B:
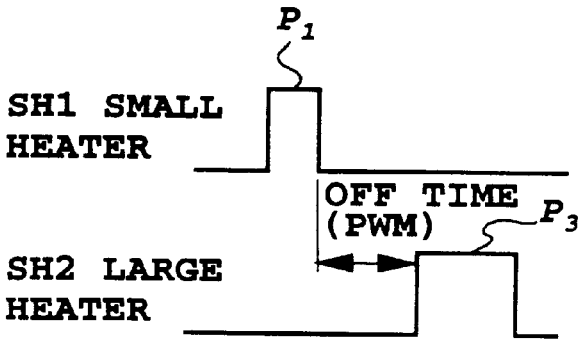
Figure 40C:
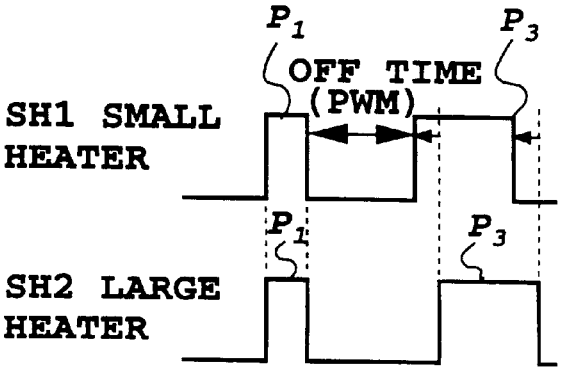

FIGS. 39A to 39C are illustrations showing tables of the off time P2 similar to the third modification, and FIGS. 40A to 40C are illustrations showing waveforms of the drive pulses.

In the shown modification, similarly to the third modification, the off time P2 is controlled to stabilize the ejection amount. The manner of off time control is somewhat differentiated depending upon the ejection amount modes.

More specifically, in the small ejection amount mode and the medium ejection amount mode, pre-heating is performed employing the heaters different from the heater to perform the main heating. In this case, longer off time P2 results in larger ejection amount. Therefore, the off time P2 is shortened according to rising of the head temperature. In case of such control, the pre-pulse P1 and the main pulse P3 for the same heater are not formed as the double pulse, and it is possible to set the pre-pulse P1 and the main pulse P3 to overlap in the time axis.

Further, when the off time P2 of the double pulse for the same heater is shortened, the double pulse can become single pulse. Even before establishing the single pulse, due to slight delay in falling down of the rectangular wave, it can be caused that the pre-pulse P1 and the main-pulse P3 are connected despite of presence of the off time to form greater pulse width as single pulse. The shown embodiment can avoid such problem.

Next, in the large ejection amount mode, the large heater and the small heater are applied the double pulse waveform. On the other hand, off time of the heater is made variable to control the timing of the main pulse to shift the bubbling timing to control ejection amount.

This utilizes the fact that the ejection amount becomes smaller by offsetting the bubbling timing of a plurality of heaters. Then, only controlling of the off time P2 makes it possible to shift the bubbling timing to control the ejection amount.

The foregoing third embodiment and the modifications thereof have been discussed in the construction provided with a plurality of heaters in lateral alignment corresponding to one ejection opening, but a similar effect may be achieved even when the heaters are arranged in longitudinal alignment as shown in FIG. 22. Further, as shown in FIG. 23, similar effect is also attained even in the head construction ejecting the ink droplet directed upwardly with respect to the heater surface.

In addition, while discussion has been given for difference in the heater sizes, the similar effect can be attained in the case where the heaters having the same size are employed. However, in the case of the heaters having the same size, the ejection amount mode basically becomes two modes, i.e. large ejection amount mode and small ejection amount mode.

Also, while not particularly disclosed in the foregoing third embodiment and the modifications thereof, it is preferred that the distance between the heaters are as short as possible. In the first, the second and the fourth modifications thereof, the effect will become more remarkable by possible closer arrangement of the heaters.

Furthermore, while discussion has been given for the example to vary the parameter, such as the pre-pulse width P1 and so forth depending upon the head temperature, further stable ejection amount can be obtained by setting the target temperature depending upon the environmental temperature and varying parameter depending upon the difference of the head temperature and target temperature. Namely, even when the environmental temperature is different even at the same head temperature, the ink temperature is basically close to the environmental temperature, including a supply system.

Fourth Embodiment

The shown embodiment relates to an ink-jet apparatus for performing printing in various modes employing ink-jet head construction of the first embodiment shown in FIG. 4.

In the shown embodiment of the ink-jet head, the ink path units constituted of the heater, the ejection opening, the ink path and so forth, are arranged in given number in the density of 720 DPI. Also, in the shown embodiment, the open area of the ejection opening and the heater area in each unit are equal in respective ink path units.

In the shown embodiment, in which two heaters are employed, three stages of setting of the ink ejection amount (hereinafter referred to as basic ejection amount mode) is basically possible per the ejection opening with the combination of the heaters to be driven. Utilizing the fact set forth above, the shown embodiment sets various printing modes. Hereinafter, discussion will be given for various printing modes.

Before discussion of various printing modes which can be set in the shown embodiment, discussion will be given for basic ejection amount modes in the shown embodiment.

Namely, by switching the heater to be driven, there can be basically achieved three ejection amount modes of small, medium and large. In the small ejection amount mode, only the heater SH1 is driven to eject 15 pl in volume of liquid droplets. Similarly, in the medium ejection amount mode, only the heater SH2 is driven to eject 25 pl of volume of ink droplets, and in the large ejection amount mode, both of the heaters SH1 and SH2 are driven simultaneously to perform ejection of 40pl (=15+25 pl) of the liquid droplet.

<Printing Mode>

(360 DPI mode: normal printing mode)

This mode is to perform printing in 360 DPI in the large ejection amount mode by setting to drive the heaters of the odd numbers of or even numbers of ejection openings in the ejection array in the density of 720 DPI in the ink-jet head 2 (see FIGS. 2 and 3).

In this mode, it becomes possible to expand the life of respective heaters by switching setting of the odd numbers of ejection openings and the even numbers of ejecting opening alternatively per each one page of printing, for example. It should be noted that switching of the ejection opening groups is prohibited to perform in one unit for printing range, such as one page.

(Vertical Registration Adjusting Mode)

This mode is a modification of the 360 DPI mode. Namely, as discussed with respect to FIG. 1, in the apparatus where respective colors of ink-jet heads are arranged in the primary scanning direction as a printing of the shown embodiment, it may happen that the installation positions of respective ink-jet heads are shifted due to tolerance in the direction of sub-scan. In this case, with respect to the ejection opening group of the odd number of ejection opening group and the even number of ejection opening group, set in the ink-jet head to be a reference, by setting switching of the odd number and even number of ejection opening groups, offsetting of the ejection opening can be adjusted in the width of 720 DPI.

(240 DPI Mode)

This mode is to perform printing in the medium ejection amount mode employing one of three ejection opening groups established by remainder of division of the ejection opening array by three. Switching of the ejection opening group and the vertical registration adjusting mode as modified mode are similar to the 360 DPI mode set for above.

It should be noted that, in the 360 DPI mode or 240 DPI mode, the dot data to be finally supplied to the head driver 240 (see FIG. 2) are the dot data for 360 DPI mode or 240 DPI mode, as a matter of course. Also, the ejection timing is set to form the dot at the density corresponding to respective DPI modes in the primary scanning direction.

(High Density Mode)

Figure 41:
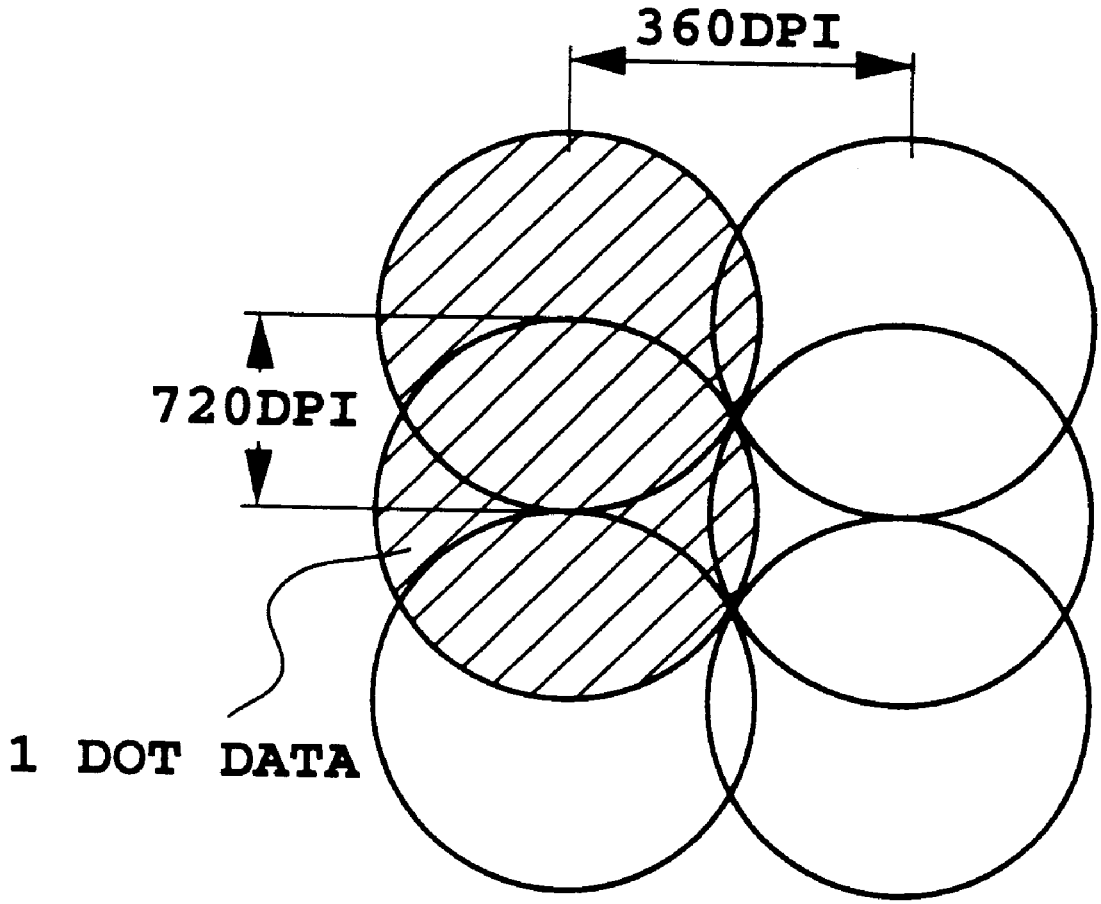
FIG. 41 is a diagrammatic illustration for explaining dot arrangement of a high density mode in the fourth embodiment of the present invention.

This mode is a mode to make adjacent two ejection openings to correspond to the data corresponding to one dot of data of 360 DPI. In concrete, in the ejection opening array, the heaters of the first and second ejection openings are adapted to be driven to form a dot corresponding to one dot data with the ink ejected through respective ejection openings. Similarly, with the third and fourth ejection openings, . . . , (2m−1)th and (2m)th (m: is natural number ejection openings respectively eject ink for forming respective of individual dot (see FIG. 41).

Also, even in the 240 DPI mode, adjacent openings may be corresponded to one dot data. In this case, in concrete, the first and second ejection openings, fourth and fifth ejection openings, . . . , (3m−2)th and (3m−1)th ejection openings are corresponded to each dot corresponding to one dot data so as to form the dot of ink. Alternatively, the second and third, fifth and sixth and ejection openings, fourth and fifth ejection openings, . . . , (3m−1)th and (3m)th ejection openings are corresponded to each dot corresponding to one dot data so as to form the dot of ink.

Such high density mode is desired to be selected depending upon kind of the printing medium. In particular, when the printing medium having low bleeding rate of the ink is performed, blurring can be caused in the solid portion or lack of density can be caused in the printed image when printing is performed in the normal printing mode. In such case, this mode is effective. On the other hand, this mode is also effective in the case of printing medium to cause lack of density due to excessively high penetration of the ink dye into the deep portion thereof, such as cloth or so forth.

(720 DPI Mode)

This mode is basically a mode to perform 720 DPI×720 DPI of printing using all of the ejection openings in the small ejection amount mode.

Also, in this mode, for certain printing medium, by switching the ejection amount mode into the large ejection amount mode or medium ejection amount mode, similar effect to the high density mode can be attained.

It should be noted that since dot density is high in this mode, when ink is ejected through adjacent ejection openings in the large ejection amount mode printing, the ink droplet deposited on the printing medium can be adjoined to cause a beading. Therefore, it is desirable to perform distributed driving, such as thinning print and so forth.

(Smoothing Mode)

The shown mode is a mode to perform smoothing by employing the ejection openings other than the ejection openings used for printing in 360 DPI or 240 DPI, with respect to the dot data of 360 DPI and 240 DPI. It should be noted that, upon performing smoothing, it is desirable to make the dots to be formed in the smoothing mode by reducing the ejection amount to be ejected through the additional ejection openings than that set for the ejection openings to perform printing.

Figure 42:
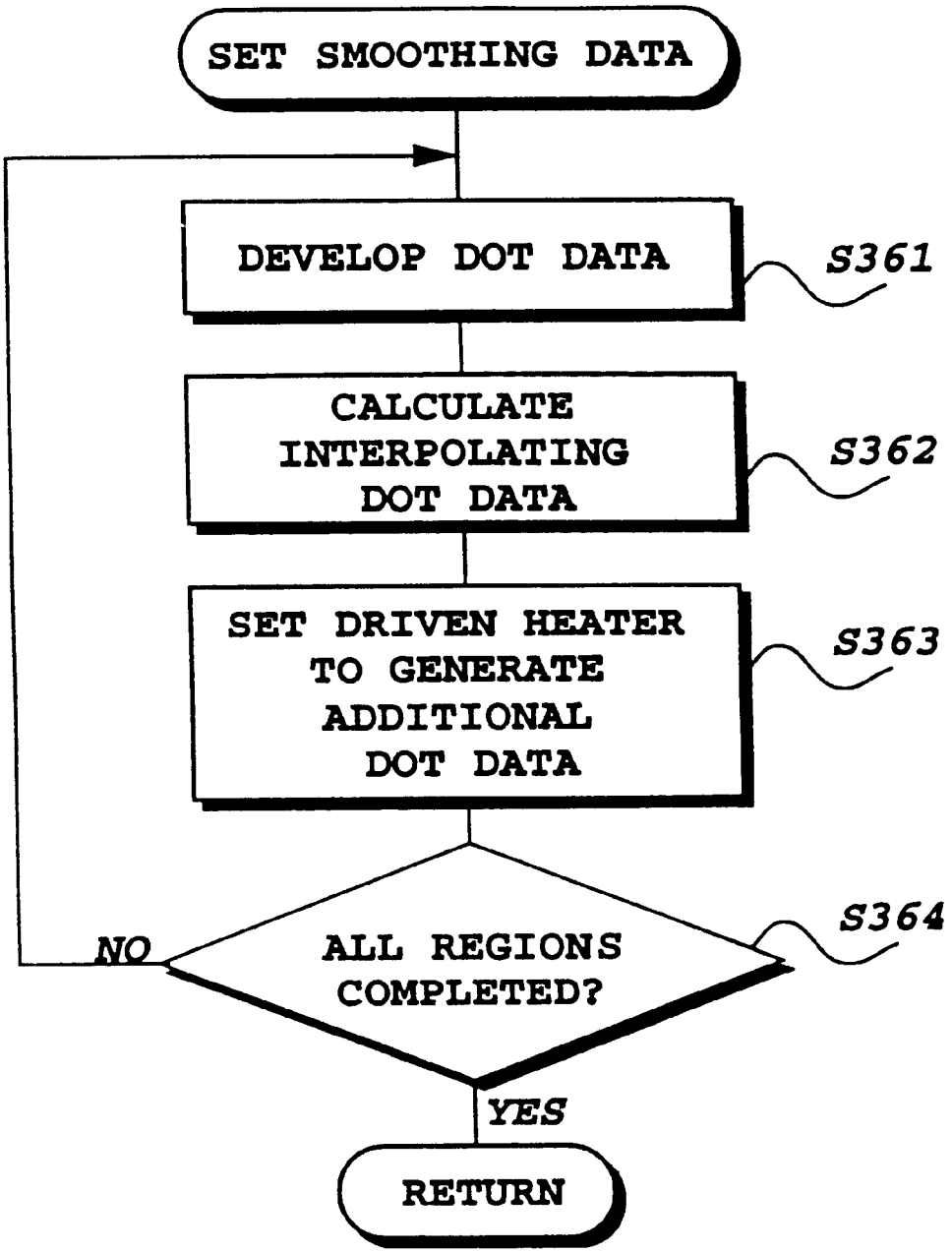
FIG. 42 is a flowchart showing processing procedure in a smoothing mode in the fourth embodiment.
Figure 43:
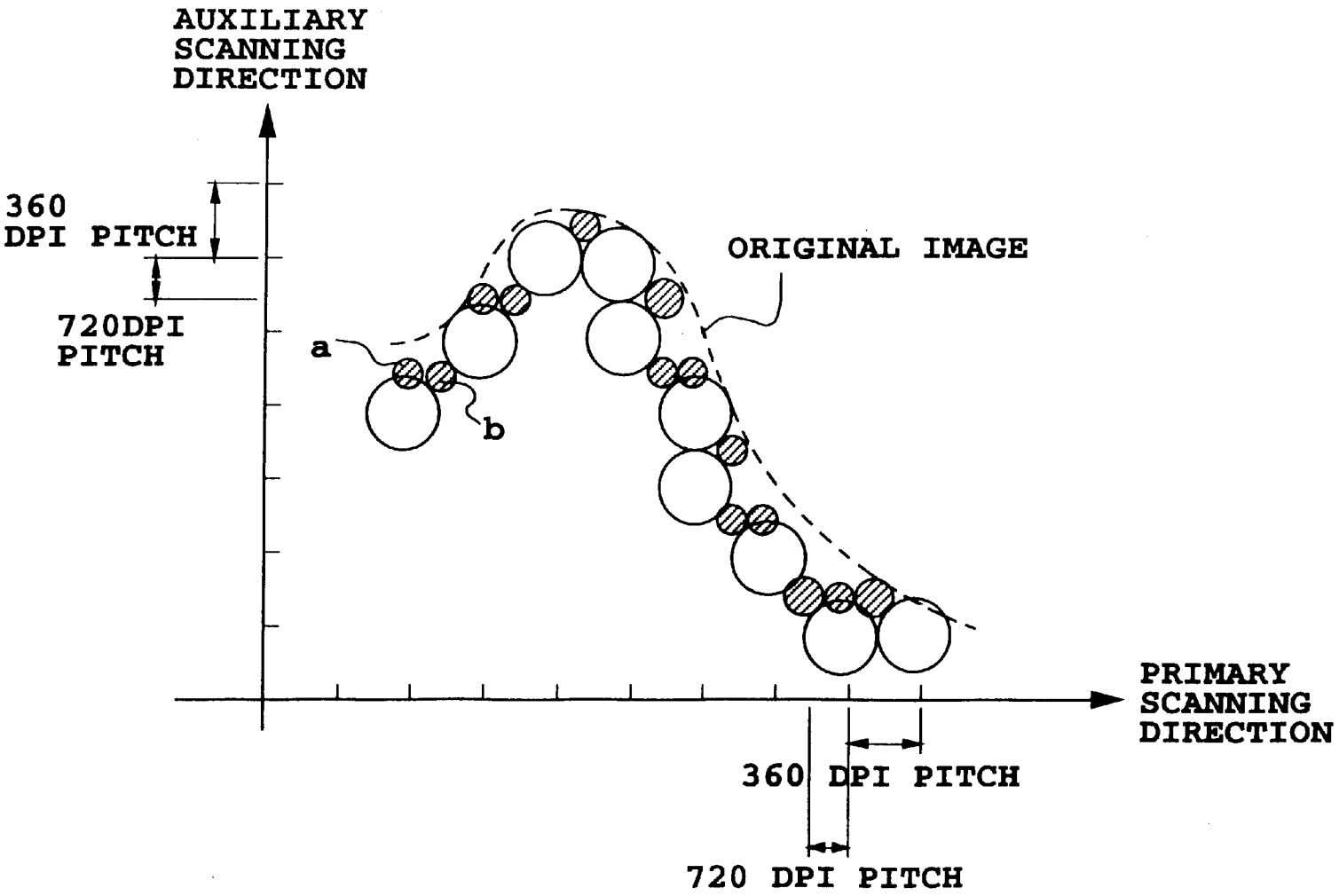
FIG. 43 is a diagrammatic illustration for explaining the smoothing mode.

FIG. 42 is a flowchart showing a process for setting of a smoothing data, and FIG. 43 is a diagrammatic illustration showing a dot pattern as a result of calculation of interpolating dot data in the smoothing process.

When the smoothing mode is set by the operation of the user or command from the host system, the process shown in FIG. 42 is initiated. At step S361, dot data for one scanning line is developed, then, at step S362, interpolating dot data is calculated by the predetermined algorithm.

As the algorithm, one illustrated in FIG. 43 may be employed. FIG. 43 illustrates a manner of smoothing process based on 360 DPI mode. Here, the interpolating dot data is indicated by hatched circle and a white circle represents the original dot data. As shown in FIG. 43, the interpolating dot is formed by employing the ejection openings located between two adjacent ejection openings to be used for 360 DPI mode printing, and by printing in the small ejection amount mode. In this case, the interpolating dot data is generated by the following algorithm. With respect to one dot data as original dot data (white circle) in question, generation of the interpolating dot data is determined depending upon presence and absence of the original dot data in the vertical and lateral directions and diagonal directions. For example, when other dot data is present in the diagonally upper position relative to the dot data in question, the interpolating dot data is generated at the intermediate points (points a and b shown in FIG. 43) of the upward position and the obliquely upward position relative to the dot data in question.

When generation of the interpolating dot data is completed as set forth above, at step S363 in FIG. 42, this interpolating dot data is stored in the predetermined memory as drive data of the corresponding ejection openings. The process of the steps S361 to S363 are performed with respect to the, ejection data for one page, for example (step S364), and shown process is terminated.

(Multi-Value Printing Mode)

The shown mode is a mode to switch the ejection amount mode between large, medium and small ejection amount modes depending upon density data of each pixel (hereinafter also referred to as "multi-value data") based on the above-mentioned 720 DPI mode.

Figure 44:
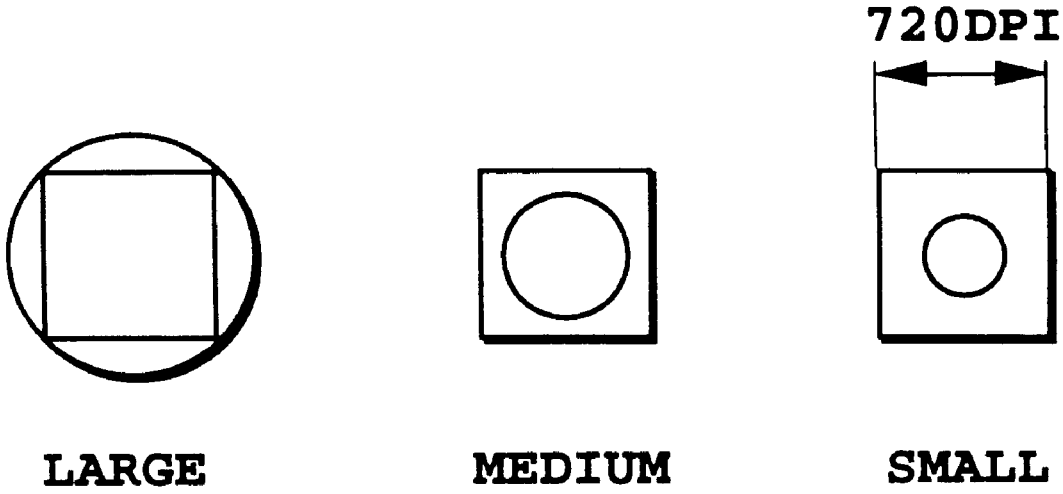
FIG. 44 is a diagrammatic illustration showing dot arrangement of a multi-value mode in the fourth embodiment.

FIG. 44 is a diagrammatic illustration showing one example of this mode. In the shown example, the ejection amount mode is switched between the large, medium and small ejection amount modes depending upon the multi-value data for each ejection openings to be employed for 720 DPI printing. By this, for pixels of 720 DPI, printing of four values can be performed. It should be noted that, in this case, by employing the printing medium having small bleeding ratio in consideration of dispersion of the ink dot, more linear four value expression of gradation becomes possible.

Figure 45:
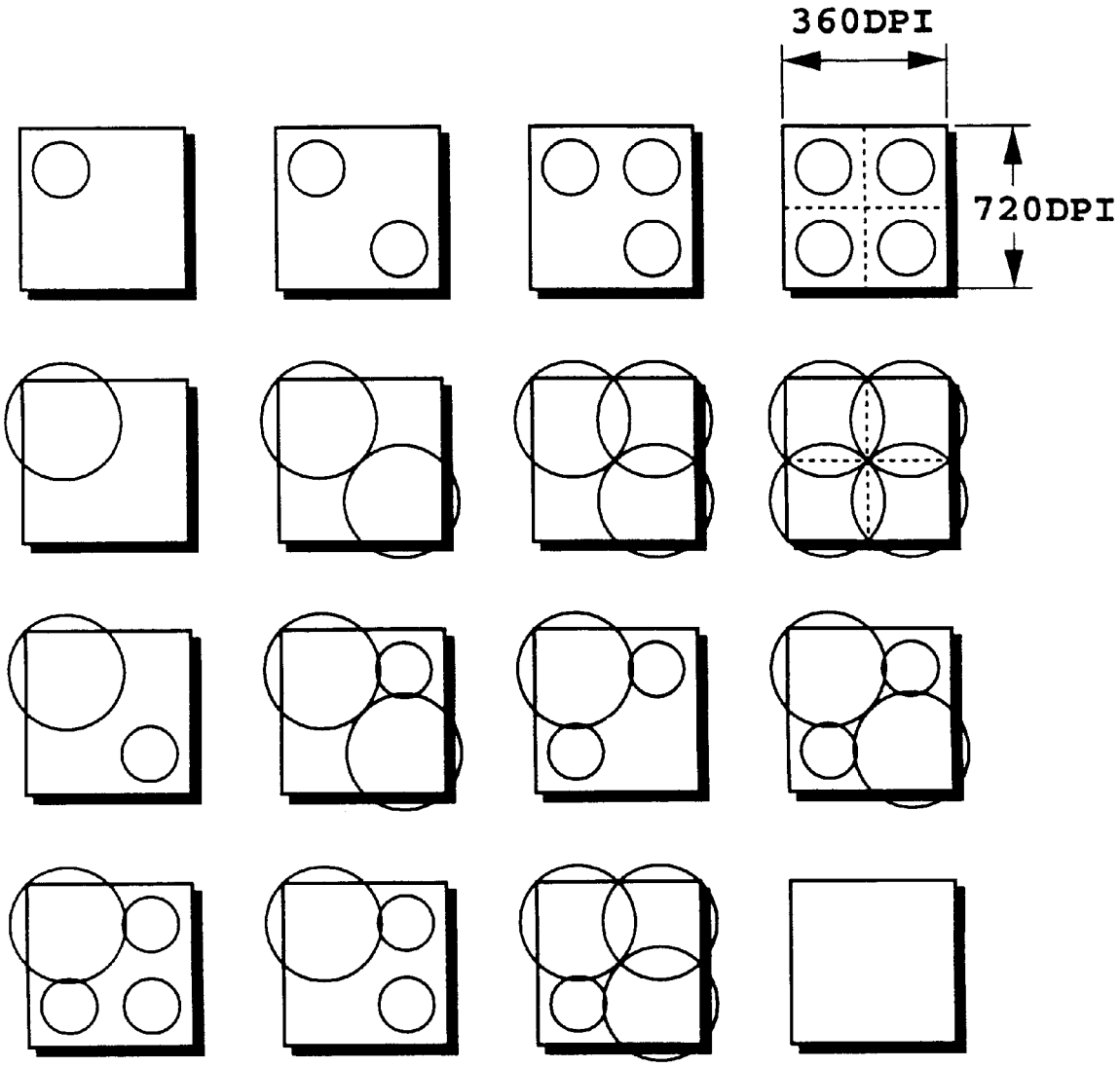
FIG. 45 is a diagrammatic illustration showing another example of the dot arrangement in the multi-value mode.

FIG. 45 is a diagrammatic illustration showing the dot pattern associated with another example of the multi-value printing mode.

The shown example is one where dots according to multi-value data of the pixels of 360 DPI are formed with ejection openings to be used for 720 DPI mode. More specifically, for one pixel, two ejection openings are used and ejection timing thereof are corresponded to 720 DPI mode printing to permit formation of four dots at the maximum. By this, greater number of levels of tone expression can be printed.

As set forth, in the pixel density of 360 DPI, the image having greater tone levels than normal expression can be printed. Similarly, even in the pixel density of 240 DPI, the image of increased number of gradation level can be printed by means of the shown embodiment of the ink-jet head.

As set forth above, according to the shown embodiment, respective basic mode printing of 720 DPI, 360 DPI and 240 DPI as printing modes and various modes utilizing the basic modes can be performed. As another modification, it is possible to perform printing of the image having different printing density employing one of three basic printing modes for each scanning cycle on the same printing medium.

It should be noted that while the ink-jet head having a maximum ejection opening density (resolution) of 720 DPI has been exemplified, the maximum ejection opening density is not limited to the shown example and can be of any desired density. For instance, the maximum ejection opening density can be set at 600 DPI. In the later case, it is desirable to provide 200 DPI mode and 300 DPI mode as other basic modes.

Further, it is possible to set the ejection amounts at smaller value in respective of the ejection amount modes and to adjust the ejection amounts in respective ejection amount modes by means for varying the ink-jet temperature.

(Head Drive Control)

Among various printing modes, it is possible to vary the ejection amount mode during printing for one line, such as that in the multi-value printing mode. More specifically, during printing for one line, ink ejection is performed successively through the same ejection opening depending upon the dot data, and the ejection amount can be varied during successive ejection. On the other hand, as in the shown embodiment, when the ink ejection amount is varied employing a plurality of heaters, variation range of the ink ejection amount is relatively large, Therefore, the ejection speed is variable depending upon the ink ejection amount. In concrete, larger ejection amount results higher ejection speed.

Accordingly, when the ejection amount mode is varied during printing for one line, the position to deposit the ejected ink can be shifted depending upon the magnitude corresponding to variation of the ejection speed and the carriage speed. Therefore, in the shown embodiment, the drive timing of the ink-jet head is varied for varying the ejection timing depending upon the ejection amount mode.

Figure 46A:
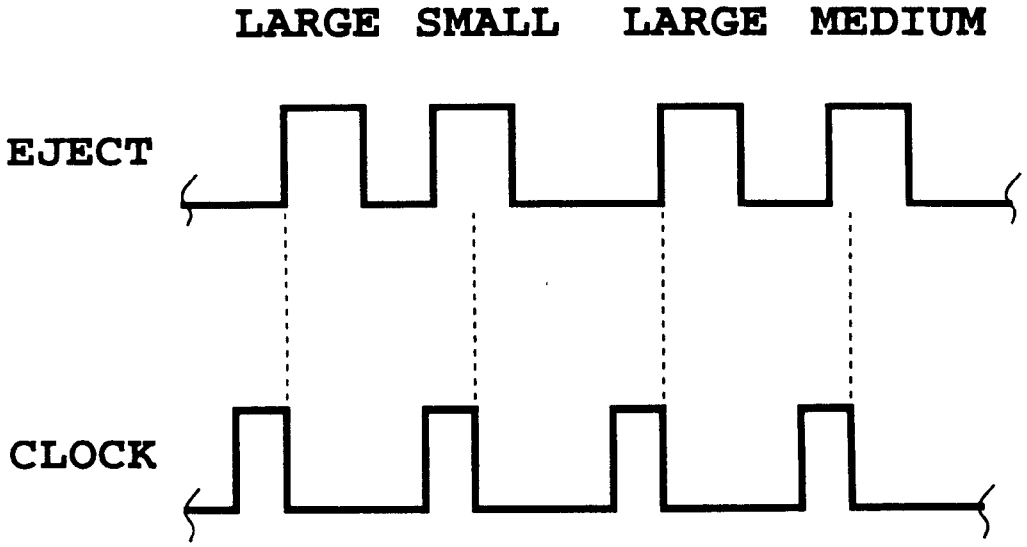
FIGS. 46A and 46B are illustrations of waveforms for explaining the ejection timing in the fourth embodiment.

FIG. 46A shows a waveform of one example of the ejection timing. The shown example is to establish synchronization of a leading edge of the ejection timing pulse of the large ejection amount mode to a trailing edge of the reference clock. On the other hand, for the medium ejection amount mode and the small ejection amount mode, the ejection timing pulses are shifted depending upon the ejection amounts, respectively. By this, the center positions of the large, medium and small dots can be aligned at the predetermined position.

It is clear that the ejection amount mode to be synchronized with the reference clock is not limited to the shown example, because the ejection timing between respective ejection amount modes encounters a problem in offset amount and ejection timing per se is relative matter.

Incidentally, the head drive control shown in FIG. 46A is to vary the timing of the signal pulse between successive ejections and thus requires relatively complicated circuit construction. In addition, as set forth above, the head drive control is a control in the case where the ejection amount mode is varied during printing for one line, for example. In contrast to this, in a multi-path printing method which will be discussed with reference to FIG. 47 and subsequent drawings, the ejection amount mode for each ejection opening is not varied during printing for at least one line. Therefore, a construction for shifting the ejection timing can be made simpler.

Figure 46B:
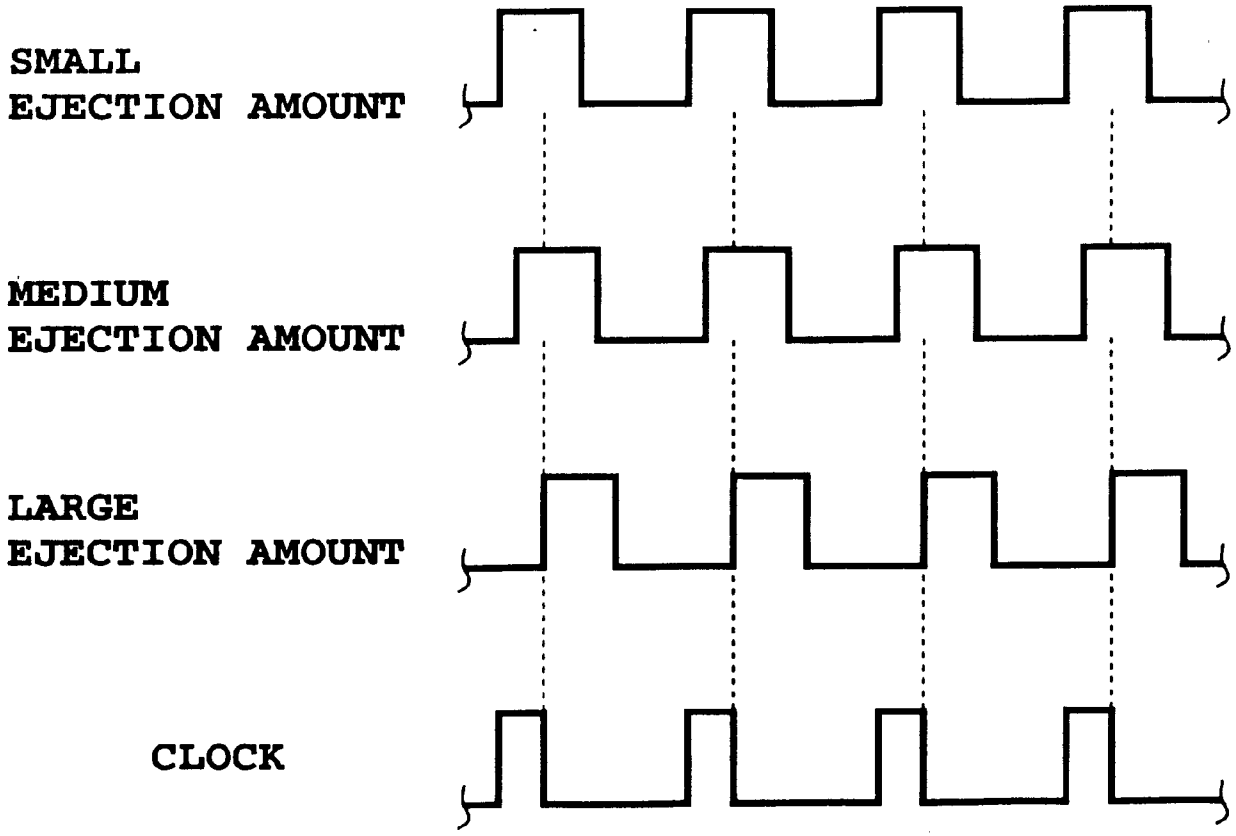

FIG. 46B shows a waveform showing an ejection timing pulse in the shown case.

The shown example is to set the timing for the large ejection amount mode by the initial setting. More specifically, the initial ejection timing pulse in one line is synchronized with the trailing edge of the reference clock. In contrast to this, when the medium ejection amount mode or the small ejection amount mode is set during paper feeding (line feeding), the initial ejection timing is controlled to be advanced with respect to the reference clock, and subsequently, the ejection timing is controlled at the same interval to the large ejection amount mode.

FIGS. 47 to 56 are diagrammatic illustrations for explaining multi-path printing methods employing the ink-jet head in respective embodiment. The multi-path printing method referred to in the shown embodiment is to perform ink ejection from a plurality of ejection openings at different scanning cycles. When this printing method is implemented by the shown embodiment, the dot to be formed through one scanning cycle becomes one of large, medium and small dots. At this time, when multi-value data with large and small dots (three values by large and small dot in one pixel in 720 DPI×720 DPI) is to be printed for example, by forming large dot in the forward scanning of printing and forming small dot in the reverse scanning of printing. By this, even when the respective colors of ink-jet heads are arranged in the scanning direction as in the shown embodiment, no color fluctuation is caused and image with high gradient can be attained.

Figure 47:
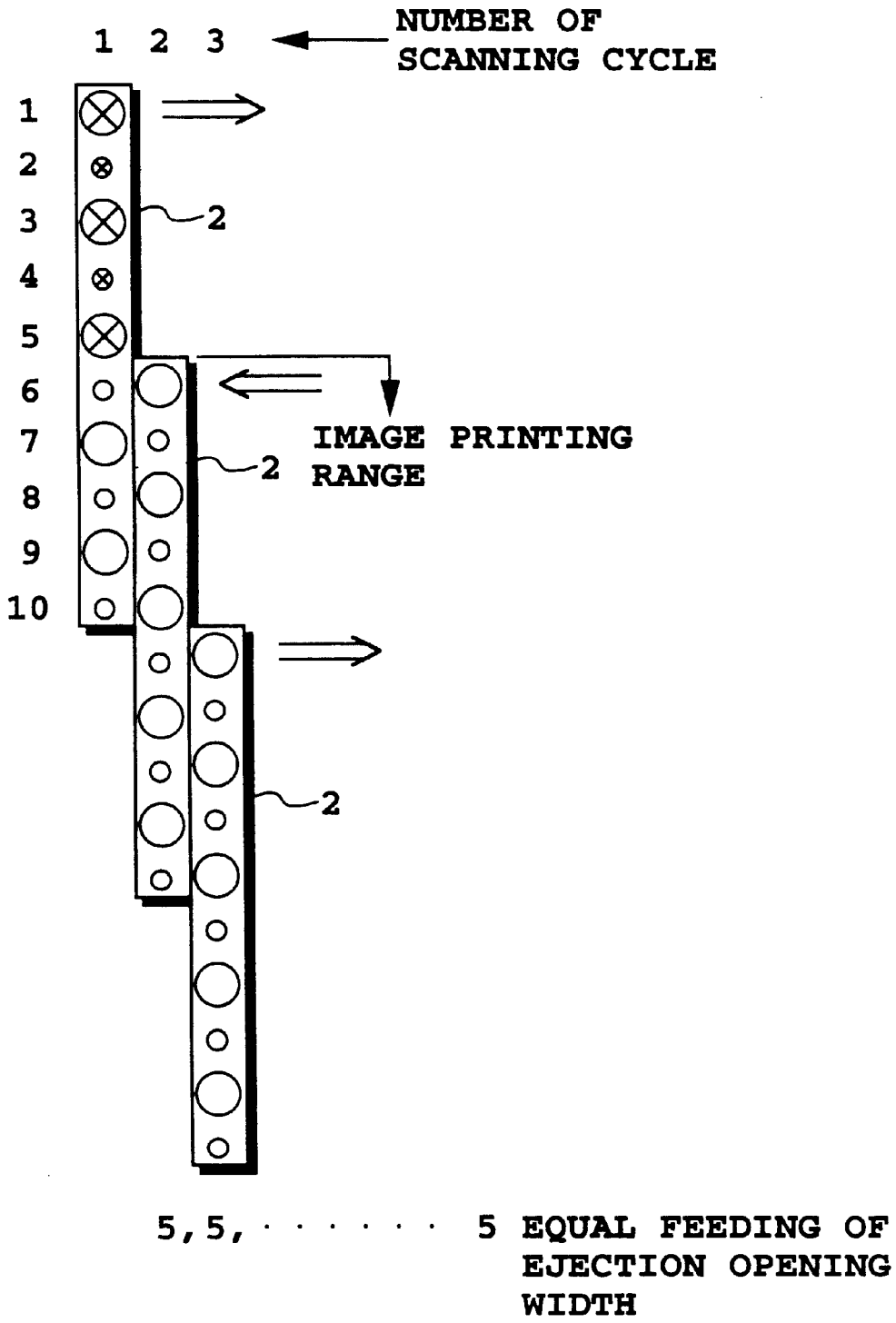
FIG. 47 is an illustration for explaining a multi-path printing method in the fourth embodiment.

FIG. 47 is an explanatory illustration showing first example of the multi-path printing in the shown embodiment.

As shown in FIG. 47, in the ejection opening array, the odd number of ejection openings are set to drive the large heater SH2 (see FIG. 4) to form large dot and the even number of ejection openings are set to drive small heater SH1 (see FIG. 4) to form small dot. the paper feeding (line feeding) magnitude is set to be a half of a length of the ejection opening array.

It should be noted that in FIG. 47, number of the ejection openings is illustrated to be ten for convenience of illustration. Also, in FIG. 47, the ejection openings of the large ejection amount mode and the small ejection amount mode are illustrated by large and small circles, respectively.

In FIG. 47, first, third, fifth, seventh and ninth ejection openings in the ink-jet head of the 10 ejection openings are set in the large ejection amount mode and second, fourth, sixth, eighth and tenth ejection openings are set in the small ejection amount mode. Then printing for one scanning cycle is performed. At this time, in the first scan, ejection is not performed through the first to fifth ejection openings. Next, with feeding paper in a magnitude corresponding to the width of five ejection openings, scanning is repeated with locating the first ejection opening at the line where the sixth ejection opening has scanned in the immediately preceding scanning cycle. Then, paper feed is performed in the magnitude corresponding to the width of five ejection openings. By repeating this operation, printing of three values per one pixel can be performed. It should be noted that, in the second and subsequent scanning cycles, ink ejection is effected through all of the ejection. openings, i.e. 10 ejection openings.

Considering only one color, the printing method shown in FIG. 47 is three value expression to express one pixel with forming the large dot or the small dot or not forming any dot, and a plurality of dots are never formed in the same pixel. As set forth, printing is performed by two scanning cycle with different two ejecting openings for one line, fluctuation of density due to non-uniformity of ejection characteristics of respective ejection openings can be reduced.

Furthermore, as in the shown embodiment, when color printing is to be performed, and if respective colors of the ink-jet heads are arranged in the scanning direction, even when this printing method is performed by reciprocal scan, variation of the order of ejection of the ink colors in the pixel array in the sub-scanning direction, is caused for each pixel. Therefore, difference of the order appears as relatively small unit so that banding (color fluctuation) is difficult to perceive visually. Thus, with making the advantage of the reciprocal printing, high speed printing becomes possible.

In addition, while the foregoing discussion has been given for the same where the paper feeding width (relative shifting width of the head) is set at a half of the ejection opening array, when the number of ejection openings is 4N (N is natural number), assuming the number of the ejection openings to be used is 2×(2N−1), the paper feeding width may be set at 2N−1.

On the other hand, number of the ejection openings of the ink-jet head represents the number of the only ejection openings to be employed for ink ejection. For example, even if the actual number of ejection opening is 15, it is possible that only 10 of 15 ejection openings are used for ejection.

Figure 48:
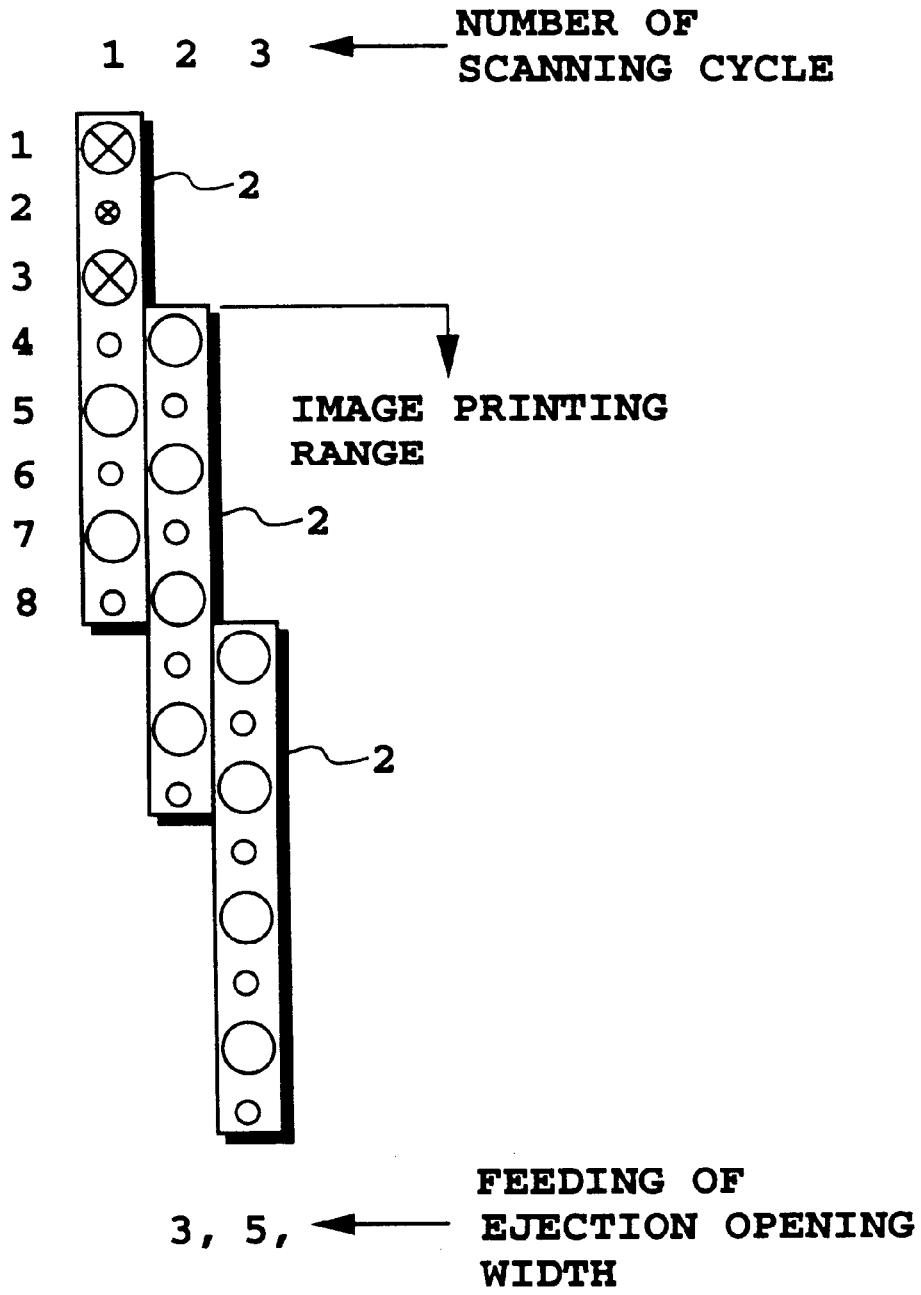
FIG. 48 is an illustration for explaining a multi-path printing method in the fourth embodiment.

FIG. 48 is an explanatory illustration showing second example of the multi-path printing of large and small dots.

As shown in FIG. 48, in the ink-jet head having 8 ejection openings, large dots are formed by first, third, fifth and seventh ejection openings and small dots are formed by second, fourth, sixth and eighth ejection openings.

More specifically, in the first scanning cycle, large or small dots are formed with all of the ejection openings except for first to third ejection openings. Then, paper feeding in the extent corresponding to three scanning openings and second scanning cycle of printing is performed. Subsequently, feeding the paper in the extent corresponding to the width of the five ejection openings is performed. Thereafter, similar printing is repeated per the unit of two scanning cycles. In this printing, paper feeding for all of the eight ejecting openings is performed by two times of paper feeding.

With the method set forth above, it becomes possible to reduce number of ejection openings not to be employed in the first scanning cycle.

Figure 49:
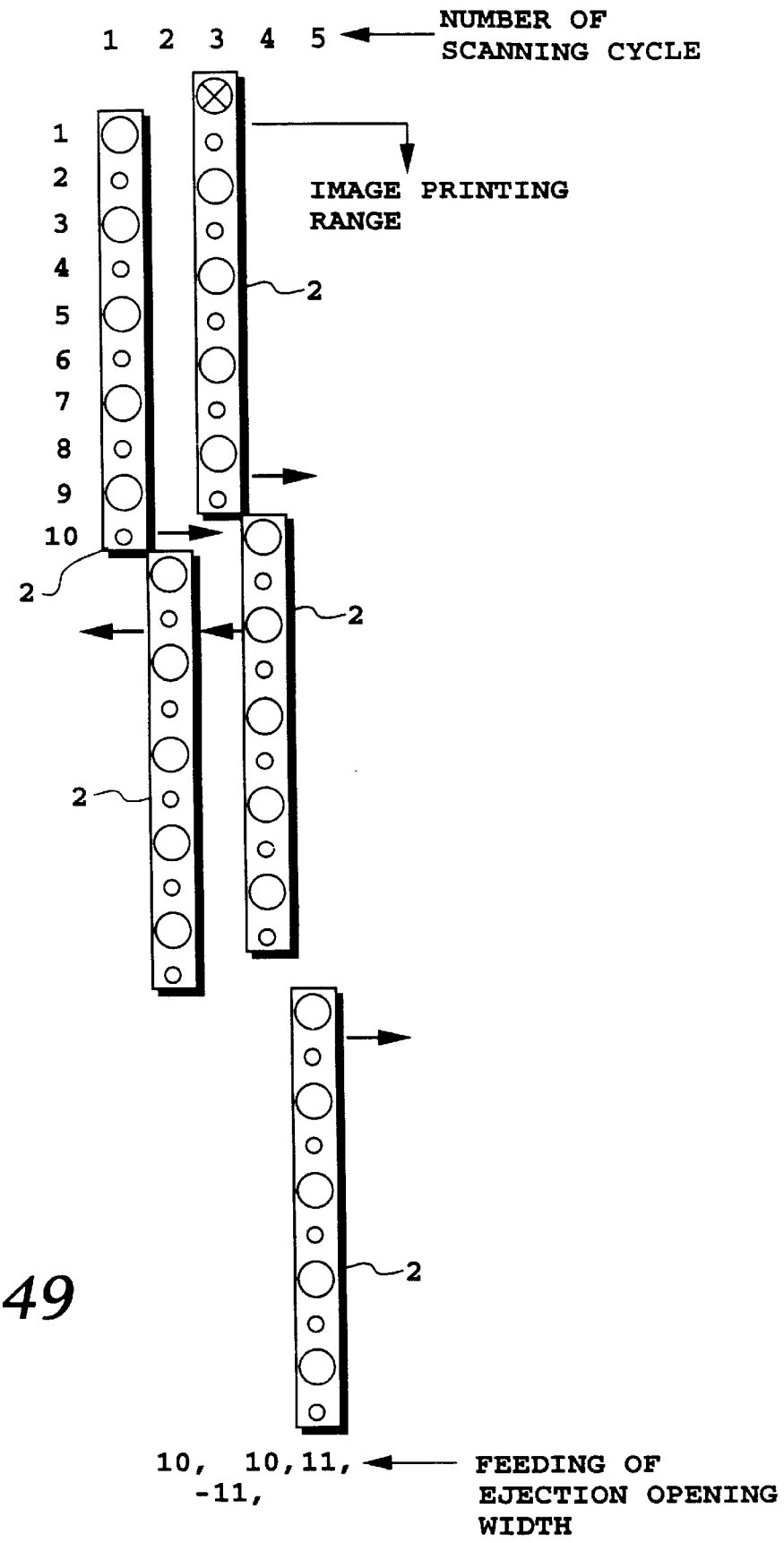
FIG. 49 is an illustration for explaining a multi-path printing method in the fourth embodiment.

FIG. 49 is an explanatory illustration showing the third example of the multi-path printing method. Here, as an example, the ink-jet head having 10 ejection openings are employed. In the shown case, the large dots are formed by first, third, fifth, seventh and ninth ejection openings and the small dots are formed by second, fourth, sixth, eighth and tenth ejection openings At first, in the first scanning cycle, printing is performed with employing all of the ejection openings Subsequently, paper is fed in the extent corresponding to ten ejection openings to perform second scanning cycle. Then, backward paper feeding for 11 ejection opening width is performed, Thereafter, third scanning cycle is performed. At this time, the first ejection opening is not used. Next, paper feeding for the width of ten ejection openings is performed. Thereafter, the printing operation is performed in the fourth scanning cycle. After completion of paper feeding, printing with the fourth scanning cycle is performed. After fourth scanning cycle, paper feeding for 11 ejection openings is performed and then the printing operation is performed in the fifth scanning cycle. Subsequently, the above-mentioned operation is performed, namely to perform printing by repeating one time of backward paper feeding for the magnitude equal to or greater than the width of all the ejection openings and three times of paper feeding for the magnitude equal to or greater than the width of all the ejection openings. By repeating this, three value printing can be performed. As set forth above, by four times of paper feeding, paper feeding in the magnitude of 20 ejection opening width is performed. Namely, in effect, paper shifting for the 10 ejection opening width (the width of printing in one scanning cycle) by twice of the paper feeding is effected.

Figure 50:
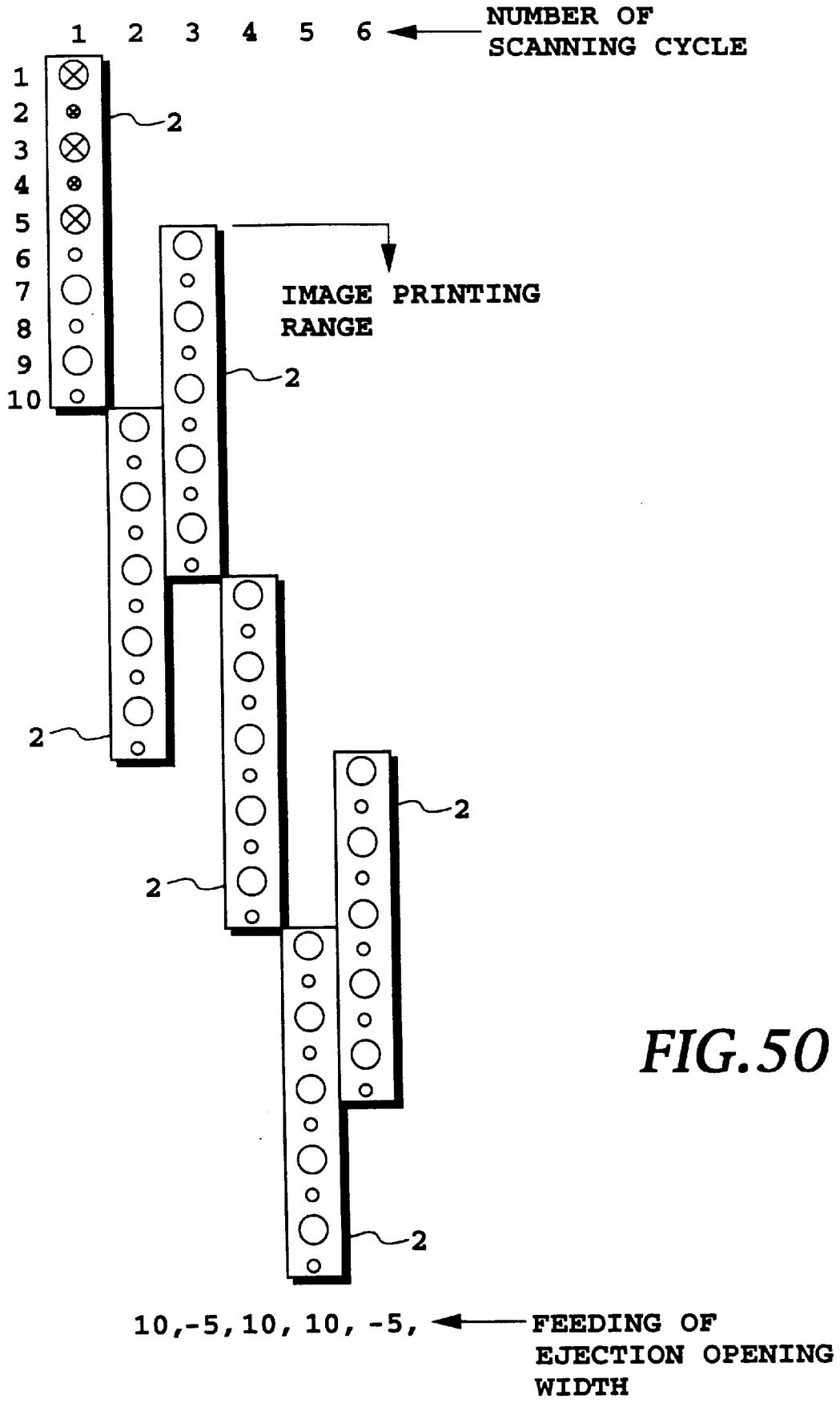
FIG. 50 is an illustration for explaining a multi-path printing method in the fourth embodiment.

FIG. 50 is an explanatory illustration of another example of operation having paper feeding in the backward direction as set forth above.

As shown in FIG. 50, similarly to the foregoing, among 10 ejection openings, the odd number ejection openings are driven in the large ejection amount mode and the even number ejection openings are driven in the small ejection amount mode. Repeating of the printing cycle is effected which includes twice of paper feeding for the width of 10 ejection openings and one time of backward paper feeding for the width of the 5 ejection openings, and three scanning cycles between paper feeding. With this example, printing is performed with one paper feeding, the paper is fed in the width of five ejection openings in average.

Figure 51:
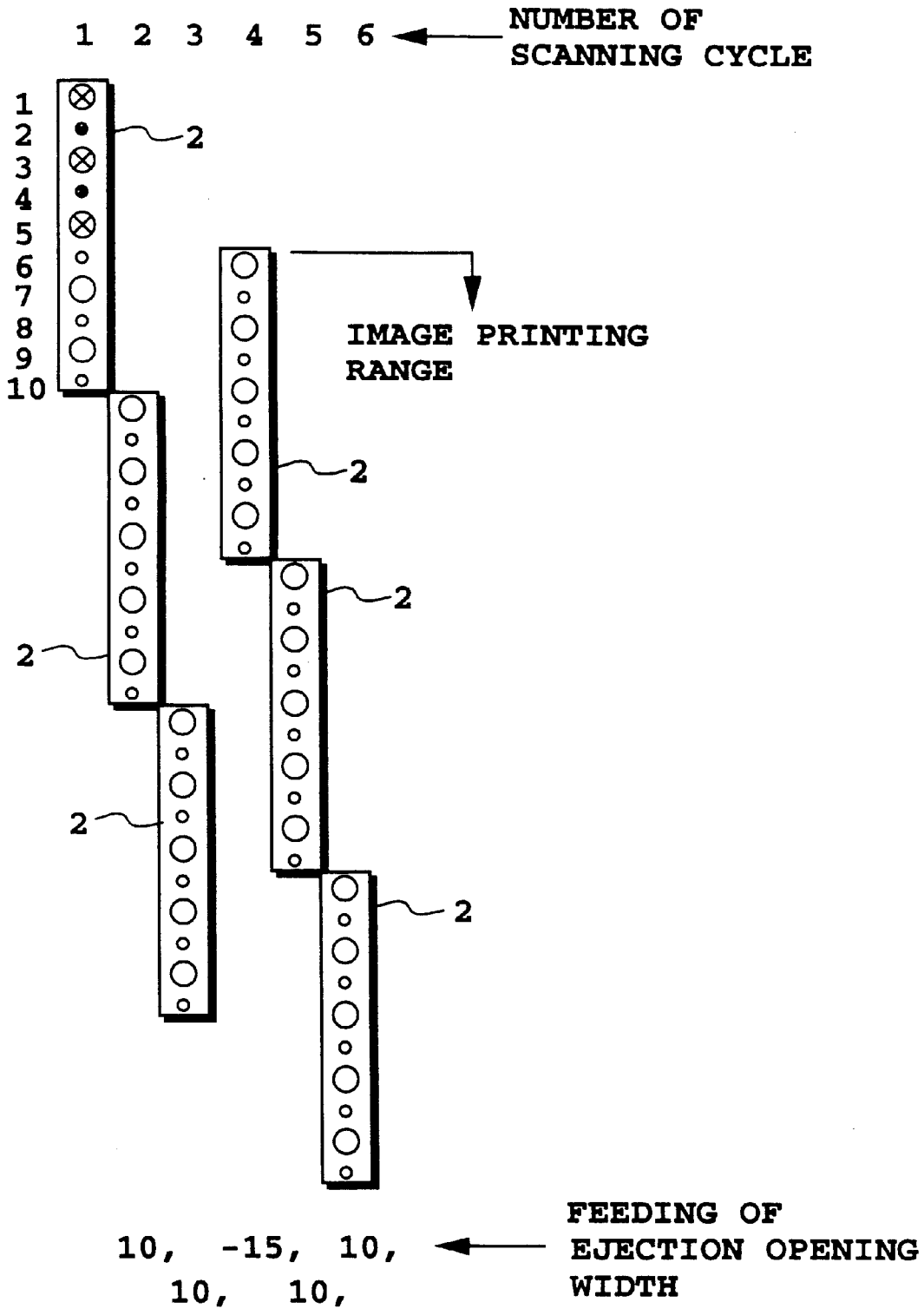
FIG. 51 is an illustration for explaining a multi-path printing method in the fourth embodiment.

FIG. 51 is an explanatory illustration for another example of the multi-path printing including operation for feeding the paper in the backward direction.

As shown in FIG. 51, four times of feeding for the width of the 10 ejection openings, one time of backward feeding in the magnitude of the width of the 15 ejection openings, and total five times of scanning between the paper feeding are taken as one printing cycle. By repeating the printing cycle, similarly to the foregoing, printing can be performed with paper feeding for the width of the five ejection openings in average.

When the examples of FIGS. 49 to 51 are generalized as 2k (k is natural value greater than one) times of paper feeding in the magnitude corresponding to the width of the 2n of ejection openings, one time of backward feeding for the extent of (2k−1), and (2k−1) times of scanning between the paper feeding. By repeating this printing cycle, printing with three values per one pixel can be performed.

In the multi-path printing as set forth above, the adjoining portion of the ink-jet head to be a boundary of the image per each scanning cycle can be dispersed per a half of the head width (in the case of FIGS. 50 and 51), adjoining portion becomes difficult to perceive and also, density fluctuation can not be perceived.

When k is set to be greater than or equal to 2, the same line is not printed by the successive scanning cycles, then good quality of printing becomes possible even when the printing medium has relative low absorption of the ink.

The multi-path printing as set forth above is directed to form large and small dots. Hereinafter will be discussed the case of printing of multi-value data of large, medium and small dot (four values of large, medium and small dots in one pixel in 720 DPI×720 DPI) with reference to FIGS. 52 to 56.

Figure 52:
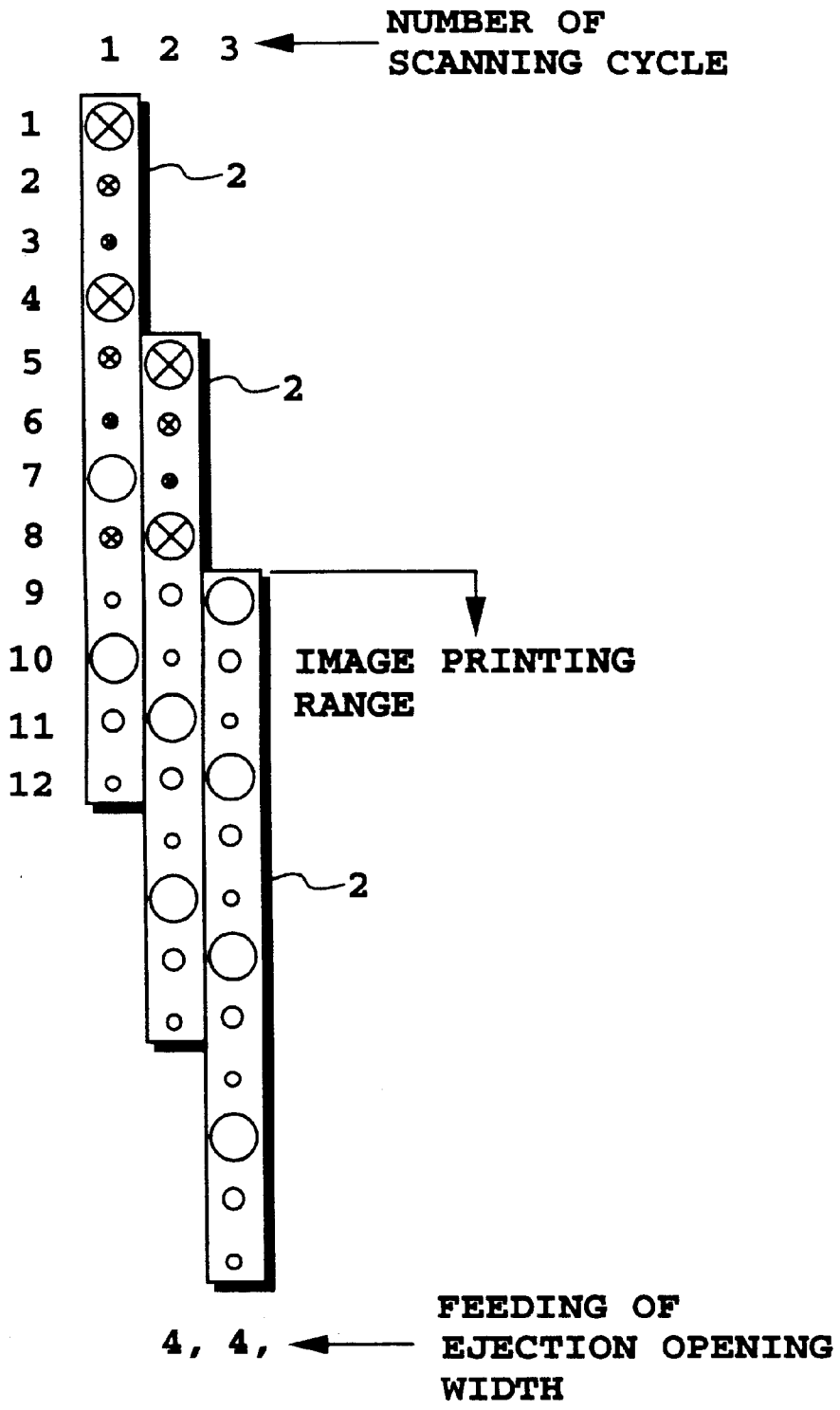
FIG. 52 is an illustration for explaining a multi-path printing method in the fourth embodiment.

FIG. 52 is an explanatory illustration explaining the first example.

As set forth above, by switching the heater or heaters to be driven, in the order of the ejection opening array, the ejection opening having the ejection opening number, remainder of division by three being 1, is set in the large ejection amount mode. Similarly, the ejection opening having the ejection opening number, remainder of division by three being 2, is set in the medium ejection amount mode and the ejection opening having the ejection opening number, remainder of division by three being 0, is set in the small ejection amount mode. In the first scanning cycle, printing is performed where large dot line, medium dot line and small dot line are repeated in order as shown in FIG. 52. In the next scanning cycle, small dots are formed in the line where the large dots are formed in the immediately preceding scanning cycle. Then, in the further next scanning cycle, the medium dots are formed in the line where the small dots are formed in the immediately preceding scanning cycle. Thus, respective pixels in the line are formed by any one of the large, medium and small dots or not formed by any dot. Thus multi-tone expression becomes possible.

More concretely, in the ink-jet head having twelve ink-jet openings as shown in FIG. 52, first, fourth and tenth ejection openings are set for large ejection amount mode, second, fifth, eighth and eleventh ejection openings are set for medium ejection amount mode and third, sixth, ninth and twelfth ejection openings are set for small ejection amount mode.

After performing printing in the first scanning cycle, paper feeding is performed in the extent corresponding to the width of four ejection openings. Thus, the first ejection opening opposes the line where medium dots are formed by the fifth ejection opening in the first scanning cycle. Then, printing in the second scanning cycle is performed. Subsequently, printing operation is repeated with feeding the paper for the width of the four ejection openings. Thus, four value image, in which each pixel has large dot, medium dot, small dot or no dot, can be obtained.

It should be noted that, in the foregoing example, ejection of ink is not performed through the first to eighth ejection openings in the first scanning cycle and through the first to fourth ejection openings in the second scanning cycle Thus, paper feeding for the width of all of the ejection openings (twelve ejection openings) can be done by three times of paper feeding. Here, since paper feeding is performed for the width of the ejection openings arranged in the equal distance, density fluctuation and adjoining line may not be perceptible to achieve high quality printed image.

Figure 53:
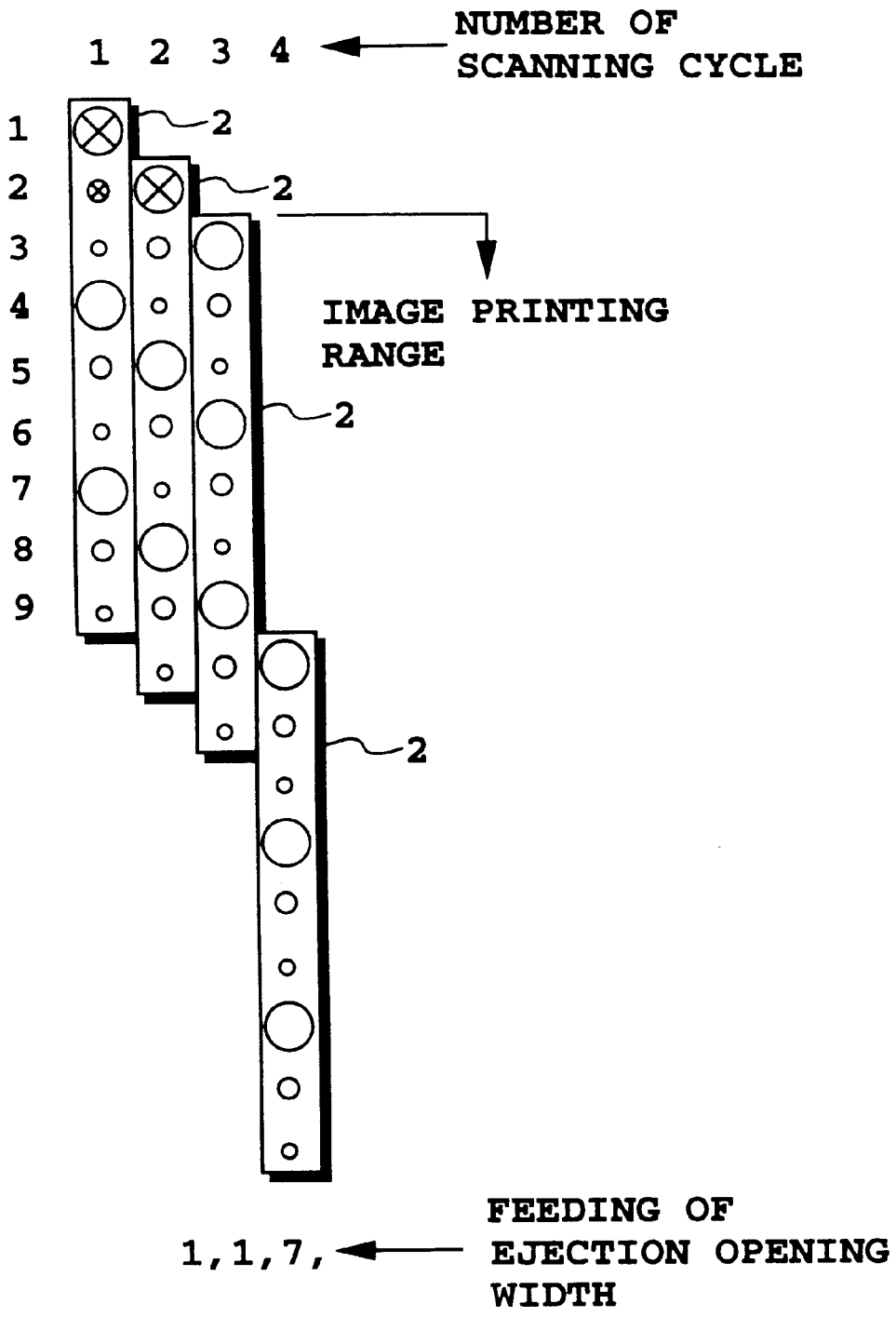
FIG. 53 is an illustration for explaining a multi-path printing method in the fourth embodiment.

FIG. 53 is an explanatory illustration of the second example of multi-path printing employing the large, medium and small ejection amount mode.

Here, an example of the ink-jet head having nine ejection openings is illustrated. The first, fourth and seventh ejection openings are set for the large ejection amount mode, the second, fifth and eighth ejection openings are set forth the medium ejection amount mode and third, sixth and ninth ejection openings are set for the small ejection amount mode. After printing in the first scanning cycle, paper is fed for a width of one ejection opening to perform printing in the second scanning cycle. Again, paper is fed for the width of one ejection opening and printing of the third scanning cycle is performed. Next, paper feeding for the width of seven ejection openings is performed to repeat the foregoing printing process. Through this, an image having four values per pixel can be obtained.

In this method, with high precision paper feeding for the width of one ejection opening, it becomes possible to reduce number of ejection openings, through which no ink ejection is performed in the initial stage of printing. Thus, the range of formation of the image (an image printing range) becomes greater.

Figure 54:
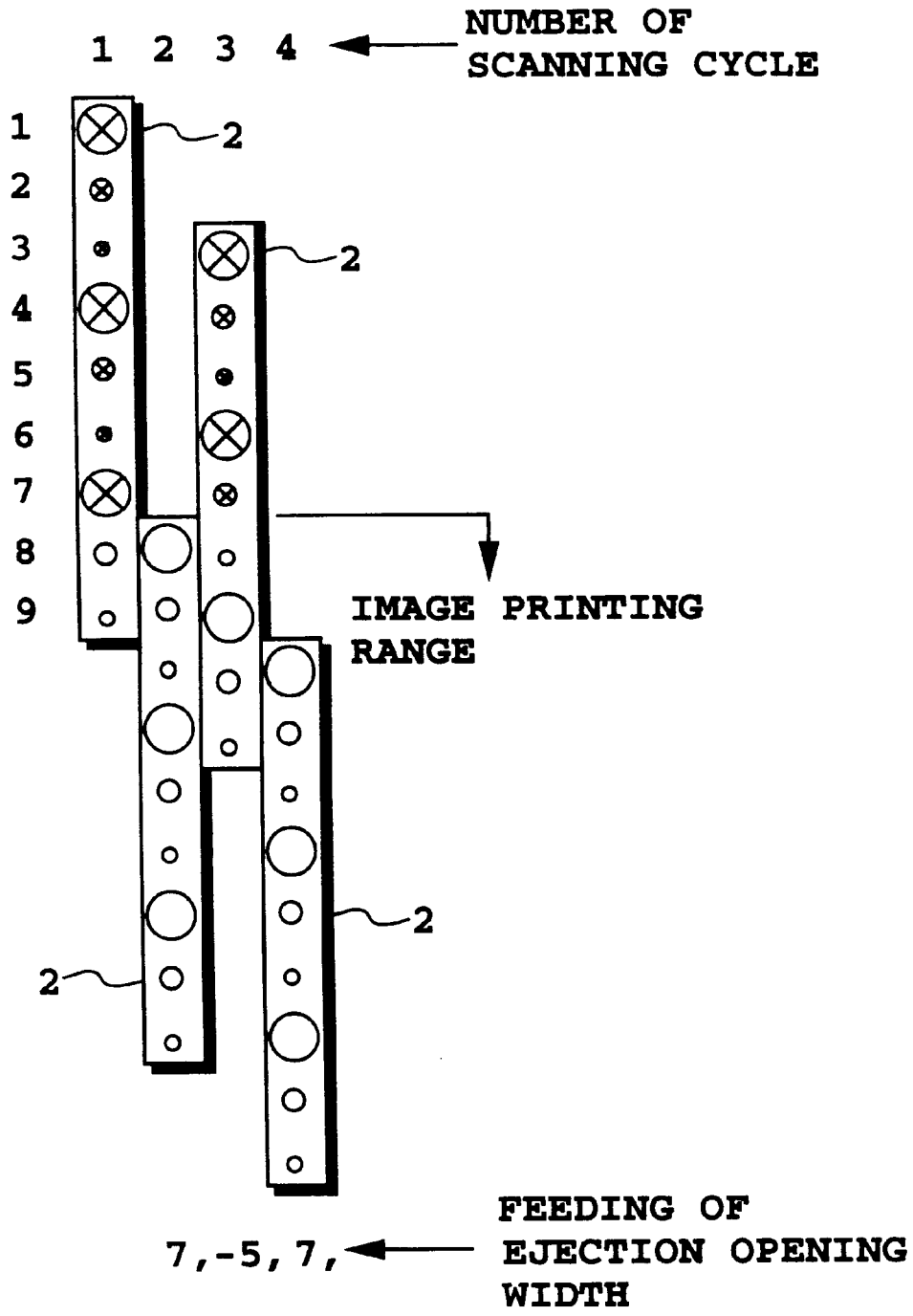
FIG. 54 is an illustration for explaining a multi-path printing method in the fourth embodiment.

FIG. 54 is an explanatory illustration of the third example of the multi-path printing forming large, medium and small dots. In this example, in the ink-jet head having nine ejection openings, one printing cycle is performed by twice of paper feeding for the width of seven ejection openings and one time of backward paper feeding for the width of the five ejection openings.

Figure 55:
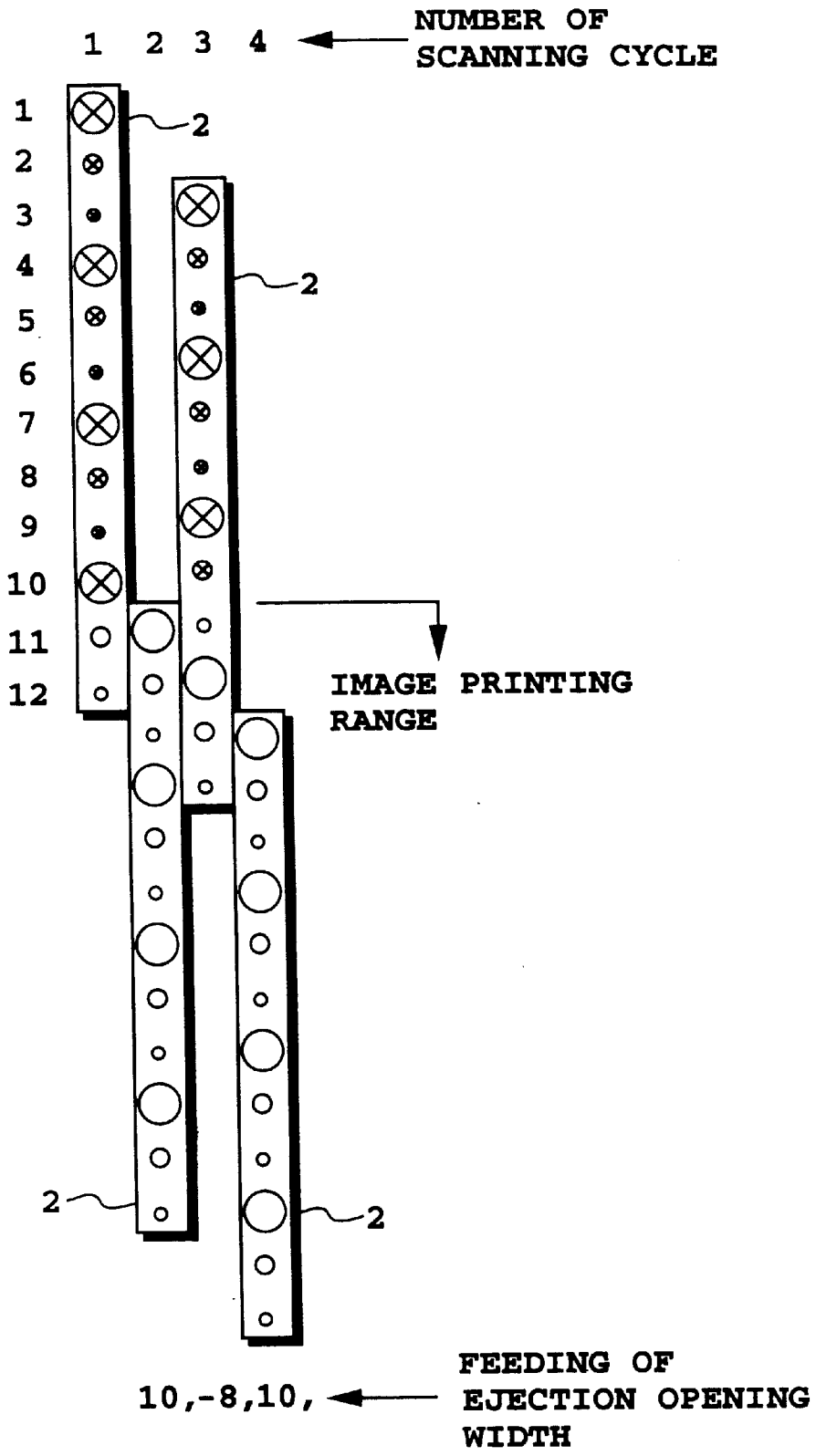
FIG. 55 is an illustration for explaining a multi-path printing method in the fourth embodiment.

FIG. 55 is an explanatory illustration showing the fourth example employing the ink-jet head having twelve ejection openings, in which one printing cycle is performed with twice of paper feeding for the width of ten ejection openings and one time of backward paper feeding for the width of eight ejection openings.

Figure 56:
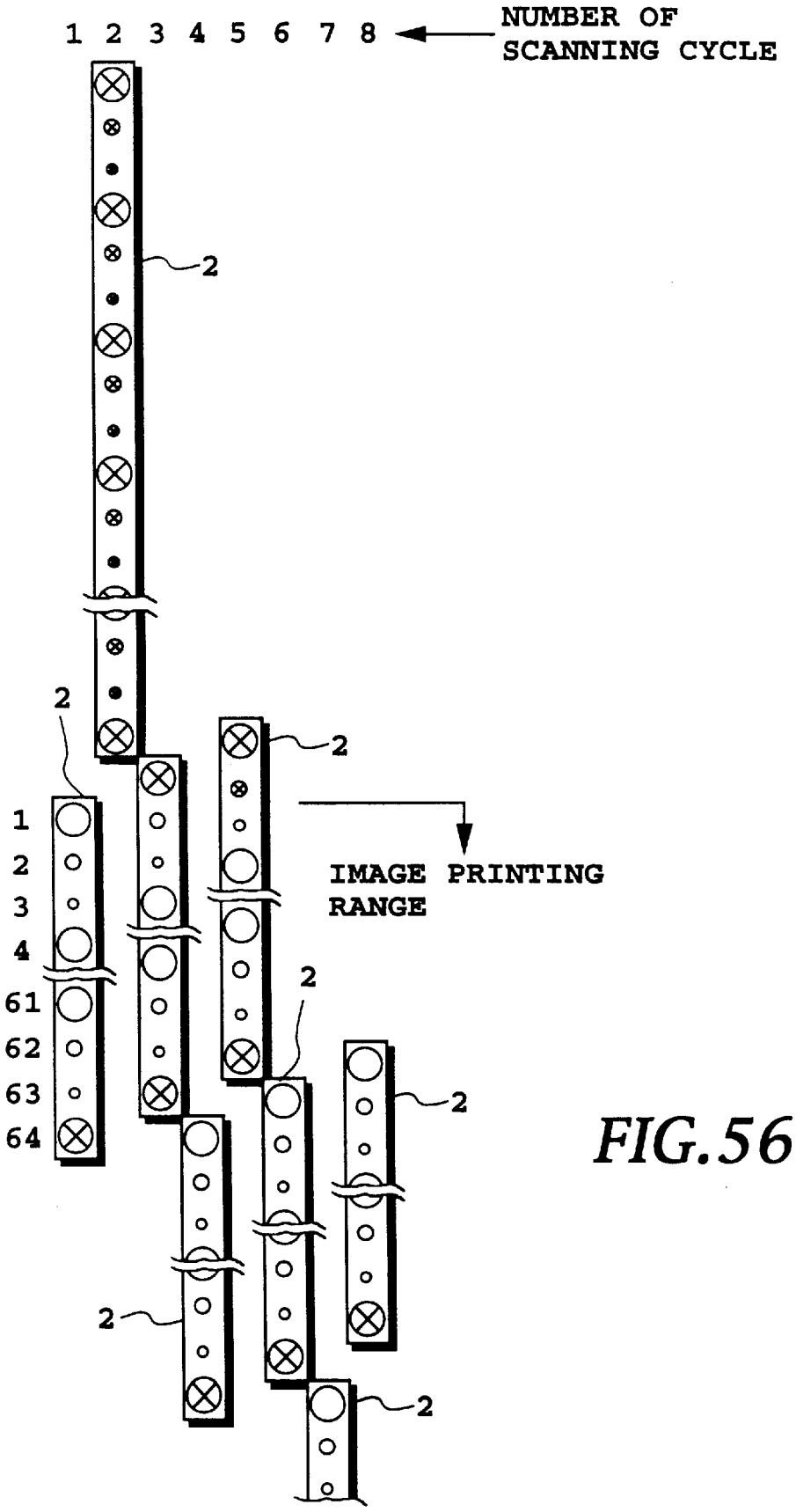
FIG. 56 is an illustration for explaining a multi-path printing method in the fourth embodiment.

FIG. 56 is an illustration for explaining the fifth example of the multi-path printing capable of printing of large, medium and small dots.

In the shown example, the ink-jet head having sixty-four ejection openings are employed. However, the sixty-fourth ejection opening is constantly held not in use. Here, one time of backward paper feeding for the width of sixty-five ejection openings and twice paper feeding for the width of sixty-three ejection openings results in one printing cycle with paper feeding for the width of the sixty-three ejection openings by three times of paper feeding. The printing is performed by repeating the foregoing printing cycles.

First Modification of the Fourth Embodiment

Figure 57A:
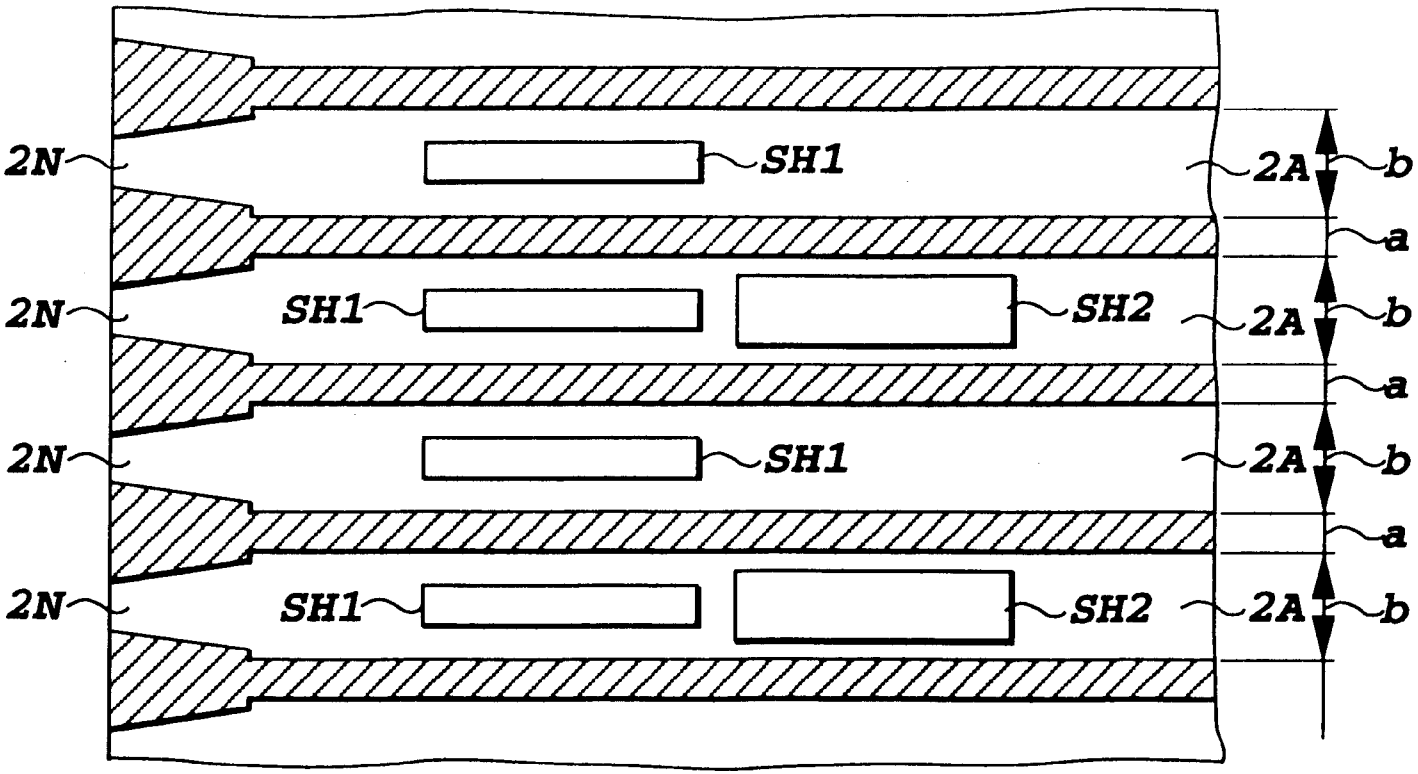
FIGS. 57A and 57B are sections showing the construction of the first modification of the ink-jet head of the fourth embodiment.
Figure 57B:
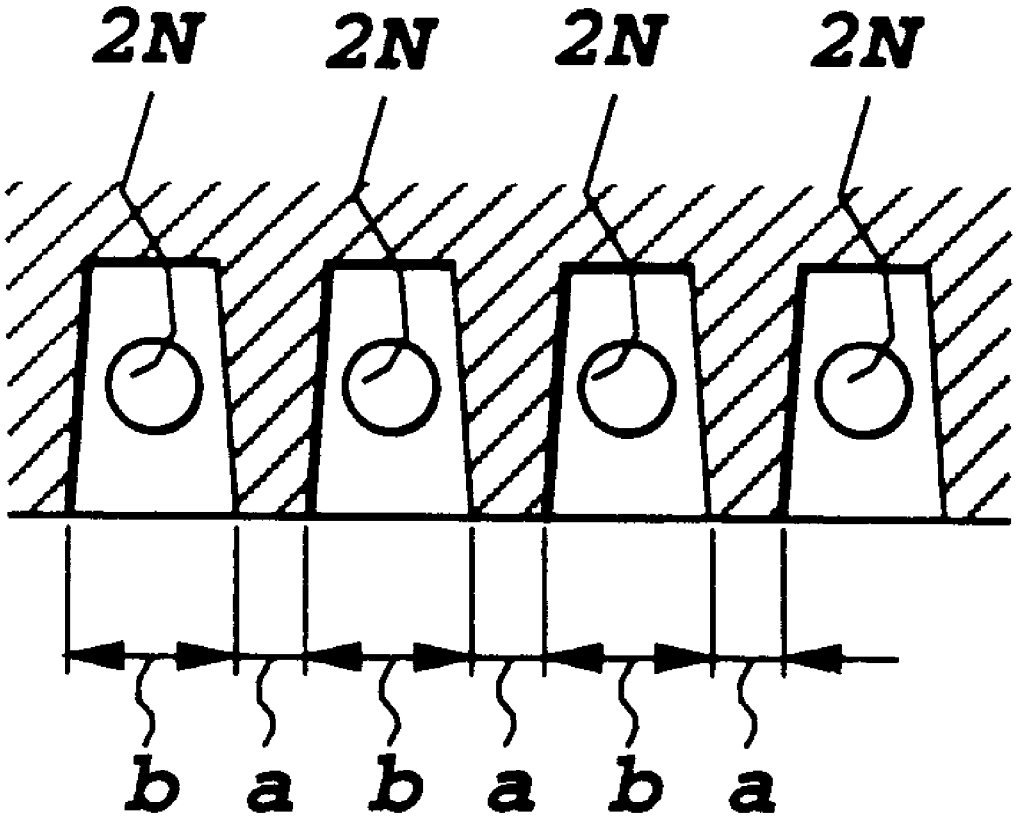

FIGS. 57A and 57B are sections as viewed from the upper side and back side and showing a construction of the ink-jet head of the first modification of the fourth embodiment.

As shown in FIGS. 57A and 57B, different from the fourth embodiment of the ink-jet head as set forth above, while small heaters are arranged in all of the ejection openings, the large heaters are arranged only in the ejection openings having even ejection opening number. In this head construction, different from the fourth embodiment, the construction for four value printing method for four value printing in 720 DPI×720 DPI and high density mode printing becomes somewhat complicated. However, other modes can be implemented substantially similar to the fourth embodiment.

With the shown modification, different from the head of the fourth embodiment, the number of the large heaters can be reduced to be half to permit reduction of the installation space and simplification of wiring for the electrodes and conductors and the heater driving circuit.

Second Modification of the Fourth Embodiment

Figure 58A:
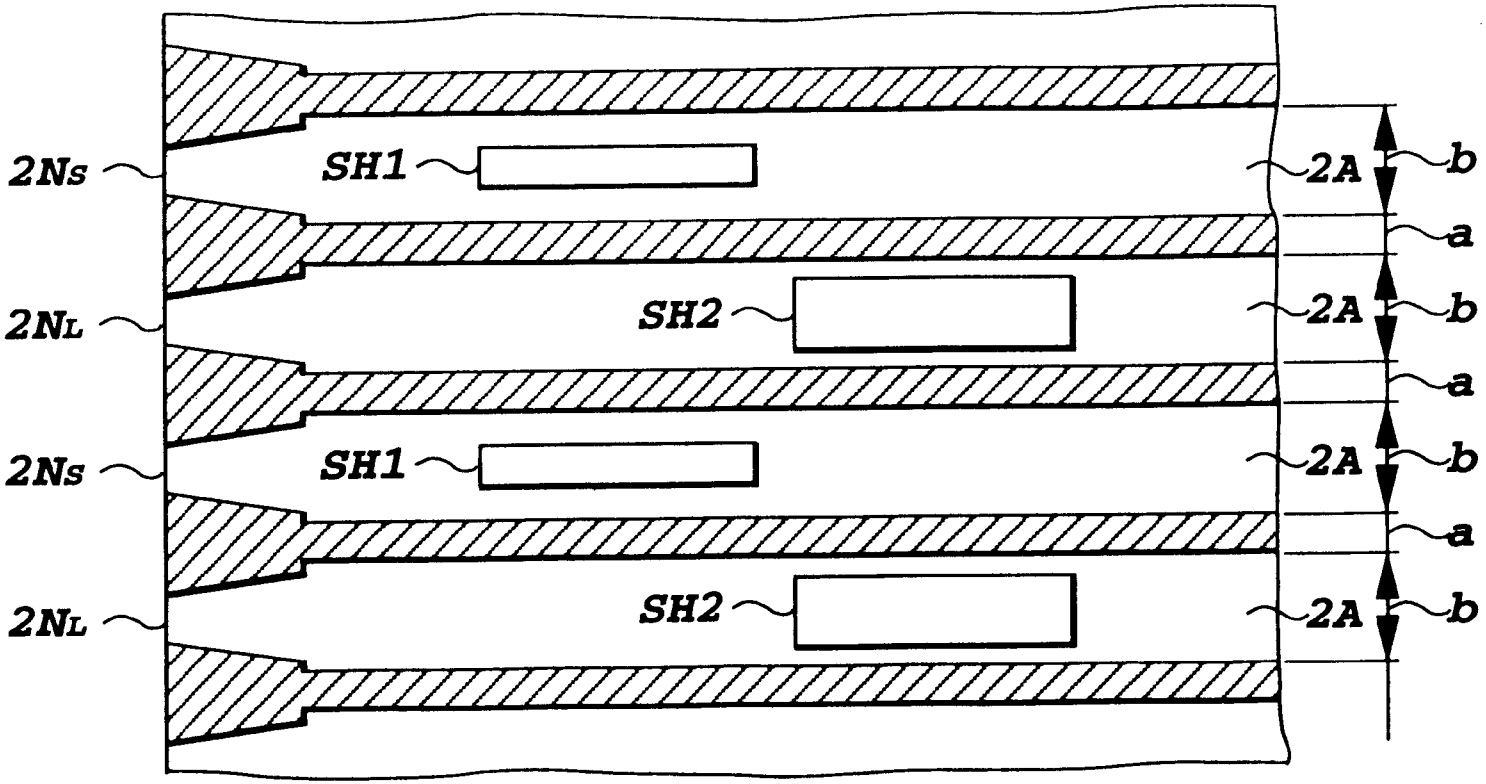
FIGS. 58A and 58B are sections showing the construction of the second modification of the ink-jet head of the fourth embodiment.
Figure 58B:
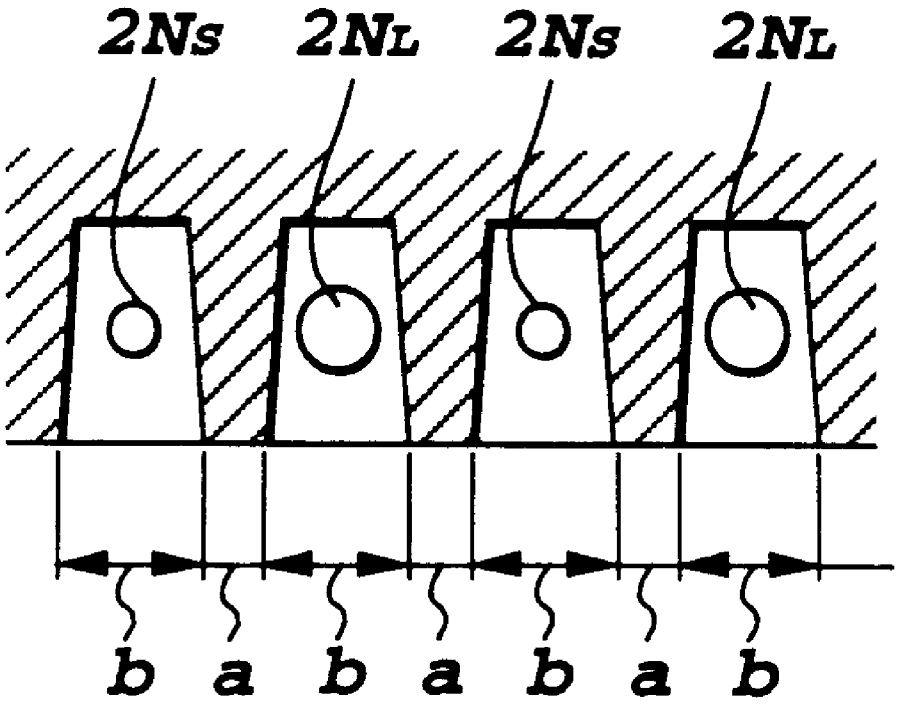

FIGS. 58A and 58B are similar sections to FIGS. 57A and 57B, but showing the construction of the ink-jet head in the second modification of the fourth embodiment.

The shown modification of the ink-jet head has large and small heaters alternately arranged per each ink path. Also, in the shown modification, a distance EH between the ejection opening and the heater and diameter of the ejection opening are made smaller in the ink path accommodating the small heater.

With the shown modification, the ejection speed of the large ink droplet and the small ink droplet respectively ejected through large and small ejection openings can be made constant by varying the diameter of the ejection openings. As a result, the foregoing delay control and so forth for respective dot becomes unnecessary to form the dot substantially at the center of the pixel.

Also, since the ejection speed is increased even in the small dot, a period where ink ejection is not performed can be made longer to maintain substantially normal ejection even when increasing of viscosity of the ink is caused in certain extent.

Furthermore, since a plurality of heaters are not provided in each ink path, number of heaters and number of wiring and so forth can be reduced.

Third Modification of Fourth Embodiment

Figure 59A:
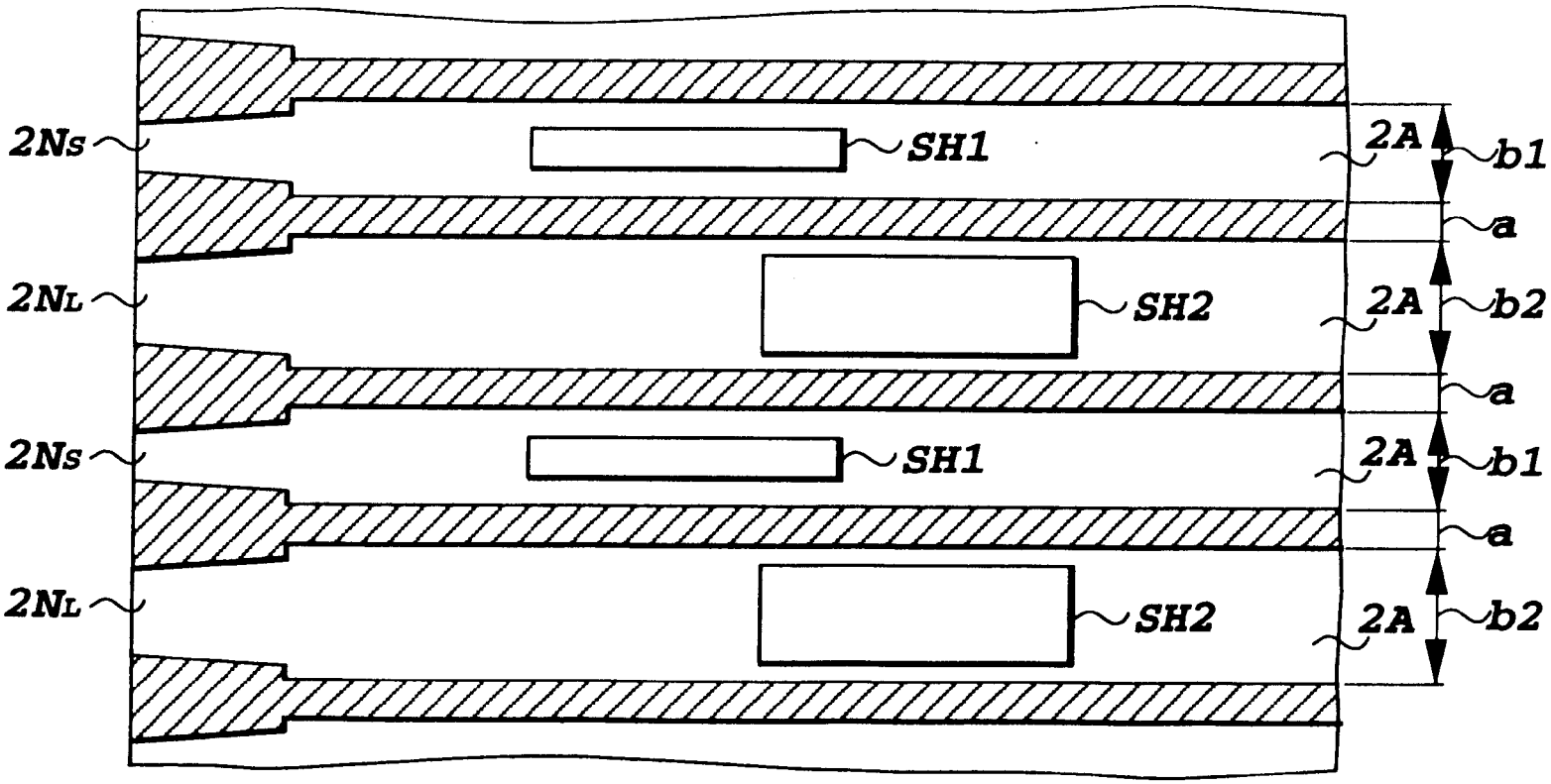
FIGS. 59A and 59B are sections showing the construction of the third modification of the ink-jet head of the fourth embodiment.
Figure 59B:
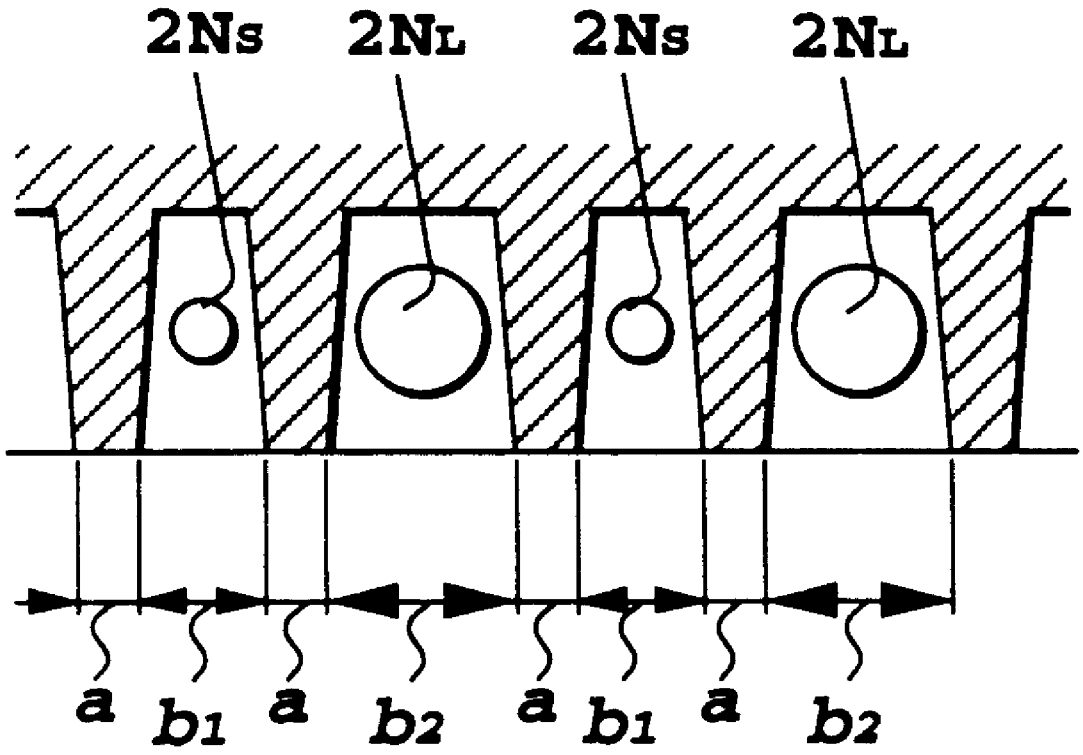

FIGS. 59A and 59B are similar sections to FIGS. 58A and 58B but showing a construction of the ink-jet head in the third modification of the fourth embodiment.

The ink-jet head of the shown modification optimizes the ink path width with respect to the second modification set forth above. More specifically, by providing greater sectional area of the ink path for the ink path corresponding to the large ejection opening, the heater size can be made greater. As a result, even when the ejection amount of the ink droplet to be ejected is differentiated, the ejection speed can be held substantially constant.

Figure 60A:
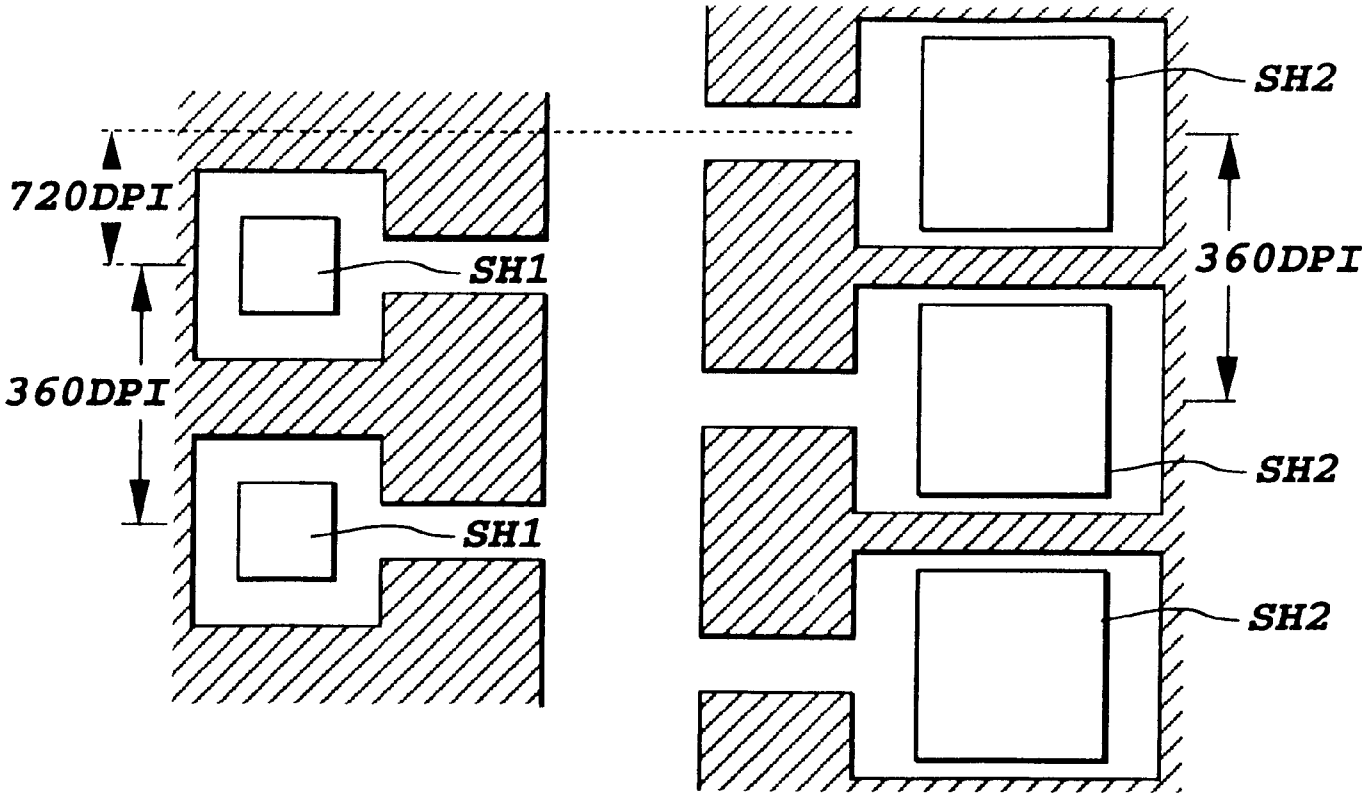
FIGS. 60A and 60B are sections showing another example of the ink-jet head applicable for the fourth embodiment.
Figure 60B:
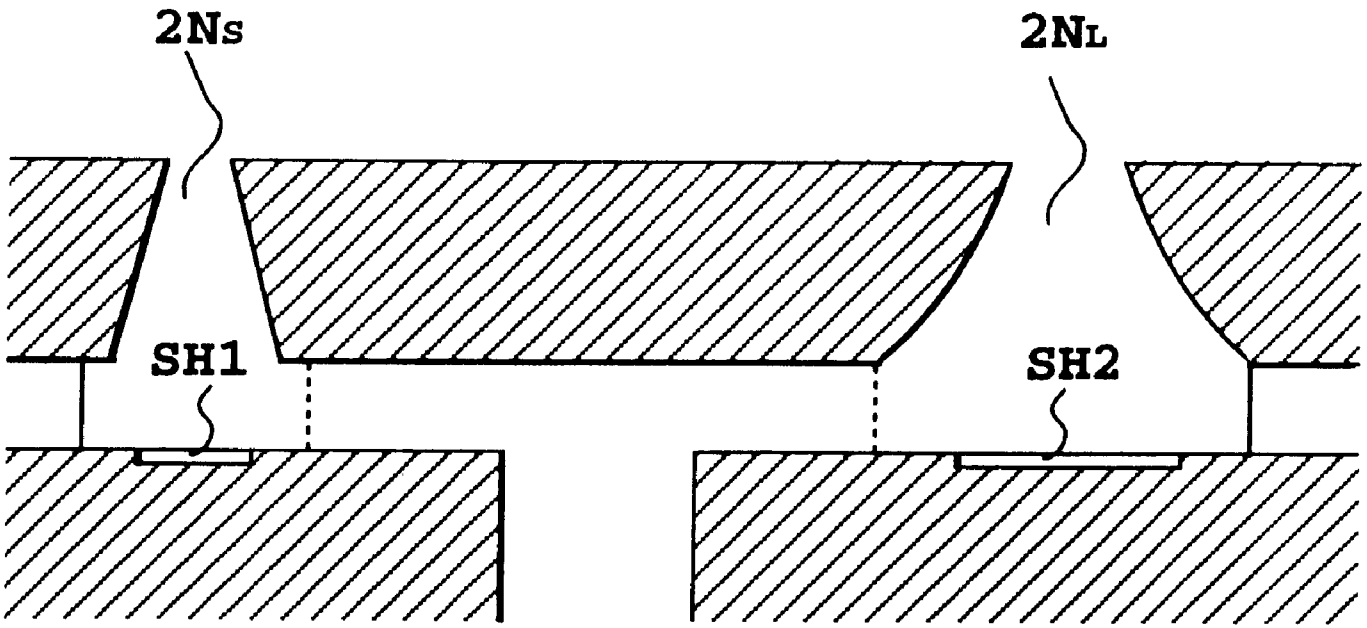
Figure 61:
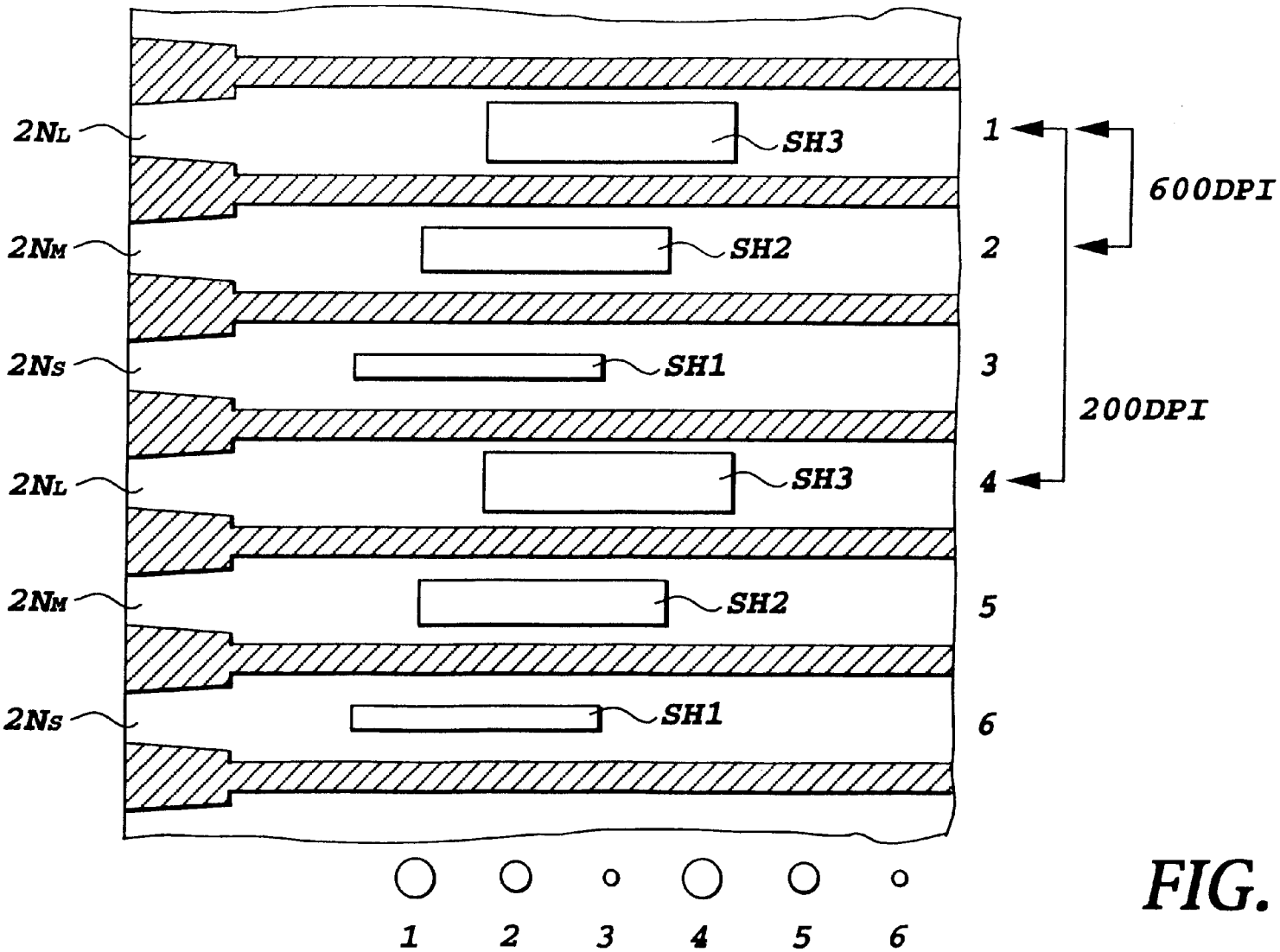
FIG. 61 is a section showing another example of the ink-jet head applicable for the fourth embodiment.
Figure 62:
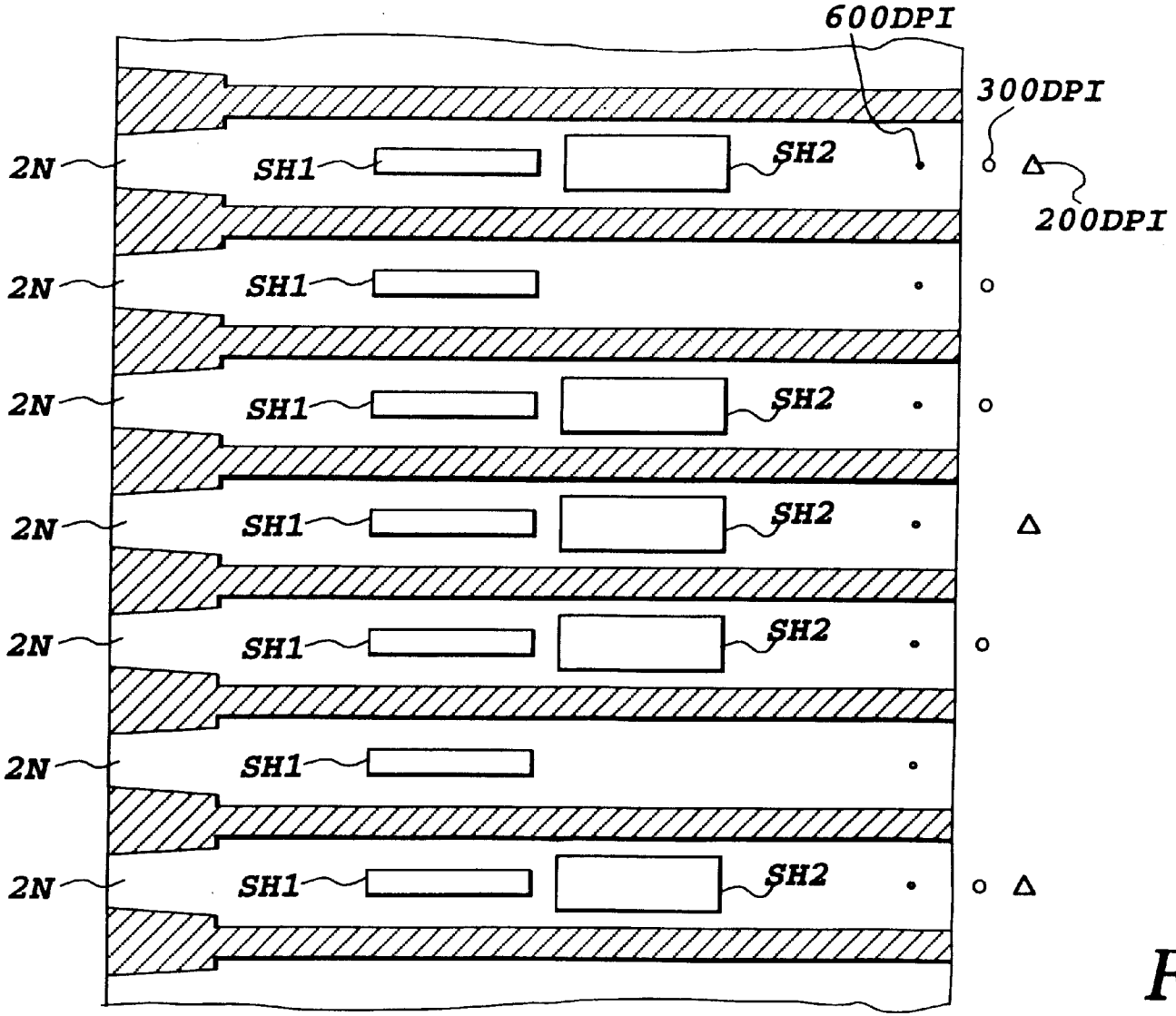
FIG. 62 is a section showing a still example of the ink-jet head applicable for the fourth embodiment.

FIGS. 60A, 60B, 61 and 62 show other constructions of the ink-jet heads to be employed in the foregoing embodiment and the modifications set forth above. Amongst them, FIGS. 60A and 60B show the side shooter type ink-jet head provided with the large and small heaters. On the other hand, FIGS. 61 and 62 are the ink-jet heads provided with the heaters corresponding to the manner of the multi-path printing.

It should be appreciated that while the foregoing discussion has been given for the examples where the ink-jet heads of respective colors are arranged in the primary scanning direction, the application of the present invention should not be limited to the shown arrangement. For instance, the present invention is, of course, applicable for the arrangement of the ink-jet head aligning the ejection openings of respective colors in the auxiliary scanning direction (paper feeding direction).

Also, with respect to the inks of different density, the present invention is naturally applicable for the case where different ink-jet heads are employed for different density of inks or for the case of integral construction of the ink-jet head with separated liquid chambers.

Furthermore, while the present invention has been applied to the system for ejecting ink by the action of bubble generated by thermal energy with employing the heater, the application of the present invention should not be specified to the shown system. For instance, the present invention is, of course, applicable for the ink-jet having a plurality of piezo elements and so forth.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This. is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet apparatus employing an ink-jet head having a plurality of heaters corresponding to one ejection opening, and ejecting ink from said ink-jet head to a printing medium, comprising:

driving means for applying a preceding pre-pulse, which does not cause ink ejection, and a subsequent main pulse, following the preceding pre-pulse, which generates a bubble for ejecting ink;

ejection amount mode setting means for setting an ejection amount mode by selecting at least one heater to be supplied with the subsequent main pulse from among said plurality of heaters; and pre-pulse control means for controlling said driving means to control application of the preceding pre-pulse in respective ejection amount modes set by said ejection amount mode setting means, on a basis of information relating to an ink temperature of the ink-jet head.

2. An ink-jet apparatus according to claim 1, wherein said driving means controls application of the preceding pre-pulse at least on a basis of temperature information of the ink-jet head and/or a temperature calculated value of the ink-jet head.

3. An ink-jet apparatus according to claim 2, wherein said driving means controls a preceding pre-pulse by varying a pulse width of the preceding pre-pulse.

4. An ink-jet apparatus accord ing to claim 2, wherein said driving means controls a preceding pre-pulse by varying a period between the preceding pre-pulse and the main heat pulse.

5. An ink-jet apparatus according to claim 2, wherein said driving means vari es a control mode of pre-heating in accordance with the ejection amount mode.

6. An ink-jet apparatus according to claim 5, wherein said driving means selects a heater to be driven by a preceding pre-pulse in accordance with head temperature information of the ink jet head.

7. An ink-jet apparatus according to claim 1, wherein said driving means varies settings of heaters driven by a preceding pre-pulse in accordance with the ejection amount mode.

8. An ink-jet apparatus according to claim 7, wherein said driving means performs pre-heating by driving with a preceding pre-pulse a heater driven with a subsequent main heating pulse for main heating.

9. An ink-jet apparatus according to claim 7, wherein said driving means performs pre-heating by driving a heater other than a heater driven for main heating.

10. An ink-jet apparatus employing an ink-jet head arranged with heaters corresponding to ejection openings and ejecting an ink droplet of a selected one of a plurality of ejection amounts by variously driving the heaters in combination, comprising:

a first heater and a second heater corresponding to one ejection opening; and driving means for driving said first heater and said second heater with a main heating pulse and a pre-heat pulse in advance of the main heating pulse.

11. An ink-jet apparatus according to claim 10, wherein said driving means has a first ejection amount mode established by driving said first heater, a second ejection amount mode established by driving said second heater, and a third ejection amount mode established by driving both said first heater and said second heater.

12. An ink-jet apparatus according to claim 11, wherein said driving means controls application of the pre-pulse at least on a basis of temperature information of the ink-jet head and/or a temperature calculated value of the ink-jet head.

13. An ink-jet apparatus according to claim 12, wherein said driving means controls a pre-heat pulse by varying a pulse width of the pre-heat pulse.

14. An ink-jet apparatus according to claim 12, wherein said driving means controls a pre-heat pulse by varying a period between the pre-heat pulse and a main heating pulse.

15. An ink-jet apparatus according to claim 12, wherein said driving means varies a control mode of pre-heating in accordance with the ejection amount mode.

16. An ink-jet apparatus according to claim 15, wherein said driving means selects a heater to be driven by a pre-heat pulse in accordance with head temperature information of the ink jet head.

17. An ink-jet apparatus according to claim 12, wherein said driving means drives different heaters with a pre-heat pulse and a main heating pulse, respectively.

18. An ink-jet apparatus according to claim 11, wherein said driving means varies settings of heaters driven by a pre-heat pulse in accordance with the ejection amount mode.

19. An ink-jet apparatus according to claim 18, wherein said driving means performs pre-heating by driving with a pre-heat pulse a heater driven with a main heating pulse for main heating.

20. An ink-jet apparatus according to claim 18, wherein said driving means performs pre-heating by driving a heater other than a heater driven for main heating.

21. An ink-jet apparatus employing an ink-jet head having a plurality of heaters corresponding to one ejection opening, and ejecting ink from the ink-jet head to a printing medium, comprising:

driving means for applying pulses, including a preceding pre-pulse, which does not cause ink ejection, a subsequent main pulse, which followings the preceding prepulse and generates a bubble for ejecting the ink, or both the pre-pulse and the main pulse, to each of the plurality of heaters corresponding to the one ejection opening;

ejection amount mode setting means for setting an ejection amount mode corresponding to selecting one or more heaters to be applied with the subsequent main pulse from among said plurality of heaters;

pulse waveform setting means for setting a waveform of the pulses correspondingly to information relating to an ink temperature of the ink-jet head, in respective ejection amount modes set by said ejection amount mode setting means; and pulse control means for controlling said driving means to cause the pulses to be applied to the plurality of heaters, on a basis of the setting by said pulse waveform setting means.

22. An ink-jet apparatus according to claim 21, wherein said ejection amount mode setting means sets one of an ejection amount mode of driving a first heater, an ejection amount mode of driving a second heater, and an ejection amount mode of driving both the first heater and the second heater.

23. An ink-jet apparatus according to claim 21, wherein said pulse control means controls said driving means to vary settings of heaters applied with the preceding pre-pulse and/or a control mode for the preceding pre-pulse, in accordance with the ejection amount mode.

24. An ink-jet apparatus according to claim 21, wherein said pulse control means controls said driving means to apply the preceding pre-pulse at least to the one or more heaters applied with the subsequent main pulse.

25. An ink-jet apparatus according to claim 21, wherein said pulse control means controls said driving means to apply the preceding pre-pulse to a heater other than the one or more heaters applied with the subsequent main pulse.

26. An ink-jet apparatus according to claim 21, wherein said pulse control means controls said driving means to apply the preceding pre-pulse at least on a basis of temperature information of the ink-jet head and/or a calculated temperature value of the ink-jet head.

27. An ink-jet apparatus according to claim 26, wherein said pulse control means controls said driving means to apply the preceding pre-pulse so as to vary a pulse width of the preceding pre-pulse.

28. An ink-jet apparatus according to claim 26, wherein said pulse control means controls said driving means to apply the preceding pre-pulse so as to vary an interval between the preceding pre-pulse and the subsequent main pulse.

29. An ink-jet apparatus according to claim 26, wherein said pulse control means controls said driving means to apply the preceding pre-pulse so as to vary a control mode of the preceding pre-pulse in accordance with the ejection amount mode set by said ejection amount mode setting means.

30. An ink-jet apparatus according to claim 21, wherein said pulse waveform setting means sets the waveform so that the waveform of the preceding pre-pulse is varied correspondingly to the information relating to the ink temperature of the ink-jet head, in respective ejection amount modes.

31. An ink-jet apparatus according to claim 21, wherein said pulse waveform setting means sets the waveform so that an interval between the preceding pre-pulse and the subsequent main pulse is varied correspondingly to the information relating to the ink temperature of the ink-jet head, in respective ejection amount modes.

32. An ink-jet apparatus employing an ink-jet head having a first heater and a second heater arranged correspondingly to one ejection opening, and selectively driving the first and the second heaters to eject ink in a plurality of ejection amounts, comprising:

means for selectively applying a main pulse causing ink ejection and a non-ejection pulse, which does not cause ink ejection, to the first and the second heaters, wherein the heater applied with the non-ejection pulse is switched among the first and the second heaters in accordance with the temperature of the ink-jet head.

33. An ink-jet apparatus according to claim 32, wherein said applying means applies the main pulse and the non-ejection pulse to different heaters among the first and the second heaters.

34. An ink-jet method employing an ink-jet head having a plurality of heaters corresponding to one ejection opening, and ejecting ink from the ink-jet head to a printing medium, said method comprising the steps of:

applying pulses, including a preceding pre-pulse, which does not cause ink ejection, a subsequent main pulse, which follows the preceding pre-pulse and generates a bubble for ejecting the ink, or both the pre-pulse and the main pulse, to each of the plurality of heaters corresponding to the one ejection opening;

setting an ejection amount mode corresponding to selecting of one or more heaters to be applied with the subsequent main pulse from among the plurality of heaters; and setting a waveform of the pulses correspondingly to information relating to an ink temperature of the ink-jet head, in respective ejection amount modes set in said ejection amount mode setting step, wherein said pulse applying step causes the pulses to be applied to the plurality of heaters, on a basis of the setting in said pulse waveform setting step.

35. An ink-jet method according to claim 34, wherein said pulse waveform setting step sets the waveform so that the waveform of the preceding pre-pulse is varied correspondingly to the information relating to the ink temperature of the ink-jet head, in respective ejection amount modes.

36. An ink-jet method according to claim 34, wherein said pulse waveform setting step sets the waveform so that an interval between the preceding pre-pulse and the subsequent main pulse is varied correspondingly to the information relating to the ink temperature of the ink-jet head, in respective ejection amount modes.

* * * * *

UNITED STATES PATENT AND TRADEMARK OFFICE

CERTIFICATE OF CORRECTION

PATENT NO. : 6,309,051 B1
DATED : October 30, 2001
INVENTOR(S) : Koitabashi et al.

It is certified that error appears in the above-identified patent and that said Letters Patent is hereby corrected as shown below:

Title page,
Item [62], Related U.S. Application Data,
"Division of application No. 08/579,241." should read -- Division of application No. 08/579,241, filed December 28, 1995, now U.S. Patent No. 6,325,492. --.

Drawings,
Sheet 33 of 81, Figure 29, "PRE-HEAD" should read -- PRE-HEAT --.

Column 1,
Line 43, "later" should read -- latter --.

Column 2,
Line 18, "through put" should read -- through-put --.

Column 4,
Line 22, "tion" should read -- tions --.

Column 5,
Lines 38 and 47, "a" should read -- with a --.

Column 6,
Line 25, "mutually different two" should read -- two mutually different --.
Line 43, "heaters;" should read -- heaters --.

Column 8,
Line 39, "the" (second occurrence) should read -- the first --.
Line 60, "the" (second occurrence) should read -- the fourth --.

Column 9,
Line 46, "still" should read -- further --.
Line 50, "EMBODIMENT" should read -- EMBODIMENTS --.

Column 10,
Line 30, "glide" should read -- guide --.

Column 11,
Line 32, "a" (second occurrence) should read -- an --.

UNITED STATES PATENT AND TRADEMARK OFFICE

CERTIFICATE OF CORRECTION

PATENT NO. : 6,309,051 B1
DATED : October 30, 2001
INVENTOR(S) : Koitabashi et al.

It is certified that error appears in the above-identified patent and that said Letters Patent is hereby corrected as shown below:

Column 12,
Line 11, "is" should read -- are --.
Line 48, "becomes" should read -- become --.
Line 59, "node" should read -- mode --.

Column 13,
Line 11, "e.g." should read -- e.g., --.

Column 14,
Line 53, "(i.e." should read -- (i.e., --.

Column 15,
Line 2, "mount" should read -- amount --.
Line 11, "a" should read -- an --.
Line 31, "or" should read -- of --.
Line 35, "relative" should read -- relatively --.
Line 41, "When" should read -- when --.

Column 16,
Line 1, "(T(n 3)," should read -- (T(n-3), --.
Line 10, "(step S205)" should read -- (step S205). --.
Line 39, "a" should read -- an --.
Line 41, "FIG. 15" should be deleted.
Line 63, "offser" should read -- offset --.

Column 17,
Line 58, "i.e." should read -- i.e., --.

Column 18,
Line 31, "(B)" should read -- (B)' --.
Line 58, "in" should read --is described in--.

Column 19,
Line 50, "pulse"" should read -- pulse") --.

UNITED STATES PATENT AND TRADEMARK OFFICE

CERTIFICATE OF CORRECTION

PATENT NO. : 6,309,051 B1
DATED : October 30, 2001
INVENTOR(S) : Koitabashi et al.

It is certified that error appears in the above-identified patent and that said Letters Patent is hereby corrected as shown below:

Column 20,
Line 17, "①" (second occurrence) should read -- ③ --.
Line 40, "e.g." should read -- e.g., --.

Column 21,
Line 10, "VdO" should read -- Vd0 --.
Line 24, "FIG." should read -- FIGS. --.

Column 22,
Line 4, "to" should read -- and --.
Line 16, "affect" should read -- effect --.

Column 23,
Line 25, "applied" should read -- applied with --.
Line 47, "i.e." should read -- i.e., --.
Line 52, "are" should read -- is --.

Column 25,
Line 12, "number" should read -- number) --.

Column 26,
Line 25, "are" should read -- is --.
Line 26, "the," should read -- the --.
Line 51, "timing" should read -- timings --.

Column 28,
Line 30, "the" should read -- The --.
Line 54, "ejection." should read -- ejection -- and "i.e." should read -- i.e., --.

Column 29,
Line 47, "openings" should read -- openings. --.

Column 30,
Line 45, "relative" should read -- relatively --.

UNITED STATES PATENT AND TRADEMARK OFFICE

CERTIFICATE OF CORRECTION

PATENT NO. : 6,309,051 B1
DATED : October 30, 2001
INVENTOR(S) : Koitabashi et al.

It is certified that error appears in the above-identified patent and that said Letters Patent is hereby corrected as shown below:

Column 31,
Line 40, "forth" should read -- for --.

Column 34,
Line 67, "This." should read -- This --.

Column 35,
Line 61, "accord ing" should read -- according --.
Line 66, "vari es" should read -- varies --.

Column 36,
Line 4, "ink jet" should read -- ink-jet --.
Line 47, "ink jet" should read -- ink-jet --.

Column 37,
Line 1, "followings" should read -- follows --.

Signed and Sealed this

Twelfth Day of November, 2002

*Attest:*

*Attesting Officer*

JAMES E. ROGAN
*Director of the United States Patent and Trademark Office*